US007237559B2

(12) United States Patent
Ashcraft et al.

(10) Patent No.: US 7,237,559 B2
(45) Date of Patent: Jul. 3, 2007

(54) WRAPPING MATERIALS FOR SMOKING ARTICLES

(75) Inventors: Charles Ray Ashcraft, Winston-Salem, NC (US); James Herbert Ellis, Jr., Lexington, SC (US); James Ray Hutchens, Walnut Cove, NC (US); Gregory Scott Pierce, Kernersville, NC (US); John Joseph Tomel, Jr., Mocksville, NC (US); Don Hayes White, King, NC (US); Sara Sutton Williard, Winston-Salem, NC (US); Paul Stuart Chapman, Winston-Salem, NC (US); Mark Stuart Powell, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 641 days.

(21) Appl. No.: 10/686,558

(22) Filed: Oct. 15, 2003

(65) Prior Publication Data

US 2005/0016556 A1 Jan. 27, 2005

Related U.S. Application Data

(63) Continuation-in-part of application No. 10/303,646, filed on Nov. 25, 2002, now Pat. No. 6,929,013, which is a continuation-in-part of application No. 09/929,609, filed on Aug. 14, 2001, now abandoned.

(51) Int. Cl.
*A24D 1/02* (2006.01)
*D21F 11/00* (2006.01)

(52) U.S. Cl. ..... 131/365; 131/360; 162/139; 162/158

(58) Field of Classification Search ..... 131/336, 131/360, 365; 162/139, 158
See application file for complete search history.

(56) References Cited

U.S. PATENT DOCUMENTS

| | | | |
|---|---|---|---|
| 1,555,320 | A | 9/1925 | Weil |
| 1,581,451 | A | 4/1926 | Knapp |
| 1,581,619 | A | 4/1926 | Sulzberger |
| 1,909,924 | A | 5/1933 | Schweitzer et al. |
| 1,996,002 | A | 3/1935 | Seaman |
| 1,999,222 | A | 4/1935 | Weinberger |
| 1,999,223 | A | 4/1935 | Weinberger |
| 1,999,224 | A | 4/1935 | Miles |
| 2,013,508 | A | 9/1935 | Seaman |
| 2,049,320 | A | 7/1936 | Ruben et al. |
| 2,098,619 | A | 11/1937 | Finnell |
| 2,149,896 | A | 3/1939 | McArdle et al. |
| 2,246,929 | A | 6/1941 | Seney |
| 2,307,088 | A | 1/1943 | Whitley |
| 2,580,568 | A | 1/1952 | Matthews et al. |
| 2,580,608 | A | 1/1952 | Schur et al. |
| 2,666,437 | A | 1/1954 | Lattof |
| 2,718,889 | A | 9/1955 | Claussen |
| 2,733,720 | A | 2/1956 | Schur et al. |
| 2,754,207 | A | 7/1956 | Schur et al. |
| 2,805,669 | A | 9/1957 | Merino |
| 2,886,042 | A | 5/1959 | Hoover |
| 2,976,190 | A | 3/1961 | Meyer |
| 2,998,012 | A | 8/1961 | Lamm |
| 3,030,963 | A | 4/1962 | Cohn |
| 3,044,924 | A | 7/1962 | Schur |
| 3,070,486 | A | 12/1962 | Novak |
| 3,106,210 | A | 10/1963 | Reynolds et al. |
| 3,370,593 | A | 2/1968 | Owaki |
| 3,395,714 | A | 8/1968 | Kahane |

(Continued)

FOREIGN PATENT DOCUMENTS

| | | |
|---|---|---|
| EP | 0 103 969 | 10/1986 |
| EP | 0 262 550 B1 | 4/1992 |
| EP | 0 483 998 A1 | 5/1992 |
| EP | 0 486 213 B1 | 5/1992 |
| EP | 0 513 985 A1 | 11/1992 |
| GB | 2 195 876 A | 4/1988 |
| JP | 2000-262266 | 9/2000 |

(Continued)

OTHER PUBLICATIONS

Durocher, Donald F., "The Influence of Paper Components on the Delivery of Low-Tar Cigarettes", Tobacco Journal International, Jun. 3, 1985, pp. 188-194.
Norman, Alan, "Cigarette Design and Materials", TOBACCO, Production, Chemistry and Technology, undated but before Nov. 25, 2002, edited by D. Layten Davis and Mark T. Nielsen, pp. 353-363.

*Primary Examiner*—Steven P. Griffin
*Assistant Examiner*—Dennis R. Cordray
(74) *Attorney, Agent, or Firm*—Brinks Hofer, Gilson & Lione

(57) ABSTRACT

Smokable rods of cigarettes are manufactured using wrapping materials that incorporate at least one fibrous material (e.g., flax fibers, hardwood pulp fibers and/or softwood pulp fibers) at least one filler material (e.g., calcium carbonate in particulate form). The wrapping materials possess multilayer coatings. The wrapping materials possess coatings in the form of series of spaced apart bands, each band possessing a series of layers. At least one of the coating layers can have a filler material dispersed or suspended within a film-forming material of that layer. For a representative wrapping material, a pattern of applied to the wire side major surface of the wrapping material substrate as a plurality of layers, and at least one of the layers includes ethylcellulose and calcium carbonate. For that layer, the calcium carbonate is present in an amount greater than the ethylcellulose, on a weight basis. The ethylcellulose and calcium carbonate typically are applied as part of a non-aqueous formulation incorporating iso-propyl acetate, triacetin and lecithin.

30 Claims, 7 Drawing Sheets

U.S. PATENT DOCUMENTS 3,409,021 A 11/1968 Owaki
3,477,440 A 11/1969 Licis
3,511,247 A 5/1970 Tamol
3,517,672 A 6/1970 Michelson
3,526,904 A 9/1970 Tamol
3,529,605 A 9/1970 Beringer et al.
3,586,005 A 6/1971 Lippman et al.
3,633,589 A 1/1972 Kahane et al.
3,640,285 A 2/1972 Briskin et al.
3,699,973 A 10/1972 Tamol et al.
3,705,588 A 12/1972 Tamol et al.
3,782,393 A 1/1974 Michelson
3,805,799 A 4/1974 Stewart, Jr. et al.
3,908,671 A 9/1975 Cogbill, II
3,911,932 A 10/1975 Houck, Jr. et al.
4,020,850 A 5/1977 Cogbill, II
4,061,147 A 12/1977 Falchi
4,077,414 A * 3/1978 Baker et al. ..... 131/336
4,088,142 A 5/1978 Horsewell et al.
4,129,134 A 12/1978 Hind et al.
4,146,040 A 3/1979 Cohn
4,187,862 A 2/1980 Cohn
4,225,636 A 9/1980 Cline et al.
4,230,131 A 10/1980 Simon
4,231,377 A 11/1980 Cline et al.
4,236,532 A 12/1980 Schweizer et al.
4,239,591 A 12/1980 Blake
4,243,053 A 1/1981 Cartwright et al.
4,450,847 A 5/1984 Owens
4,452,259 A 6/1984 Norman et al.
4,453,553 A 6/1984 Cohn
4,480,650 A 11/1984 Weinert
4,489,738 A 12/1984 Simon
4,590,955 A 5/1986 Dixit
4,598,720 A 7/1986 Gabriel
4,607,647 A 8/1986 Dashley et al.
4,615,345 A 10/1986 Durocher
4,622,983 A * 11/1986 Mathews et al. ..... 131/365
4,679,575 A 7/1987 Yamaguchi et al.
4,691,717 A 9/1987 Ikeda et al.
4,730,628 A 3/1988 Townsend et al.
4,739,775 A 4/1988 Hampl, Jr.
4,784,163 A 11/1988 Adams et al.
4,889,145 A 12/1989 Adams et al.
4,924,883 A 5/1990 Perfetti et al.
4,924,888 A 5/1990 Perfetti et al.
4,942,888 A 7/1990 Montoya et al.
4,945,932 A 8/1990 Mentzel et al.
4,998,542 A 3/1991 Kallianos et al.
4,998,543 A 3/1991 Goodman et al.
5,060,675 A 10/1991 Milford et al.
5,074,321 A 12/1991 Gentry et al.
5,092,353 A * 3/1992 Montoya et al. ..... 131/360
5,101,839 A 4/1992 Jakob et al.
5,105,838 A 4/1992 White et al.
5,143,098 A 9/1992 Rogers et al.
5,152,304 A 10/1992 Bokelman et al.
5,168,884 A 12/1992 Baldwin et al.
5,191,906 A * 3/1993 Myracle, Jr. ..... 131/365
5,220,930 A 6/1993 Gentry
5,244,530 A 9/1993 Collins et al.
5,263,500 A 11/1993 Baldwin et al.
5,263,999 A 11/1993 Baldwin et al.
5,271,419 A 12/1993 Arzonico et al.
5,417,228 A 5/1995 Baldwin et al.
5,450,862 A 9/1995 Baldwin et al.
5,450,863 A 9/1995 Collins et al.
5,474,095 A 12/1995 Allen et al.
5,540,242 A 7/1996 Chao et al.
5,589,034 A 12/1996 Hultman et al.
5,595,195 A 1/1997 Chang et al.
5,598,868 A 2/1997 Jakob et al.
5,690,787 A 11/1997 Hultman et al.
5,820,998 A 10/1998 Hotaling et al.
5,878,753 A 3/1999 Peterson et al.
5,878,754 A * 3/1999 Peterson et al. ..... 131/365
6,020,969 A 2/2000 Struckhoff et al.
6,129,087 A 10/2000 Wallace et al.
6,198,537 B1 3/2001 Bokelman et al.
6,568,403 B2 5/2003 Hampl, Jr. et al.
6,645,605 B2 11/2003 Hammersmith et al.
2002/0023655 A1 2/2002 Fietkau
2002/0092621 A1 7/2002 Suzuki
2002/0139381 A1 10/2002 Peterson et al.
2002/0166563 A1 11/2002 Jupe et al.
2002/0179105 A1 12/2002 Zawadzki et al.
2002/0179106 A1 12/2002 Zawadzki et al.
2002/0185143 A1 12/2002 Crooks et al.
2003/0099692 A1 5/2003 Lydzinski et al.
2003/0136420 A1 7/2003 Kraker
2003/0145869 A1 8/2003 Kitao et al.
2003/0150466 A1 8/2003 Kitao et al.
2003/0164173 A1 9/2003 Kawadzki et al.

FOREIGN PATENT DOCUMENTS

WO WO 99/34697 7/1999
WO WO 01/08514 A1 2/2001
WO WO 01/15555 A1 3/2001
WO WO 02/17737 A1 3/2002
WO WO 02/19848 A1 3/2002
WO WO 02/37990 A2 5/2002
WO WO 02/37991 A1 5/2002
WO WO 02/44700 A1 6/2002
WO WO 02/055294 A1 7/2002
WO WO 03/077686 A1 9/2003

* cited by examiner

WRAPPING MATERIALS FOR SMOKING ARTICLES

CROSS REFERENCE TO RELATED APPLICATION

This is a continuation-in-part of U.S. patent application Ser. No. 10/303,646, filed Nov. 25, 2002, now U.S. Pat. No. 6,929,013, which is a continuation-in-part of U.S. patent application Ser. No. 09/929,609, filed Aug. 14, 2001, now abandoned.

BACKGROUND OF THE INVENTION

The present invention relates to smoking articles, and in particular, to wrapping materials suitable for use as components of those smoking articles.

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) 1999. Various properties of paper materials used for cigarette manufacture, and of the cigarettes manufactured using those papers, are set forth in Durocher, *TJI,* 188-194 (3/1985).

A cigarette is employed by a smoker by lighting one end thereof and burning the tobacco rod. The smoker then receives mainstream smoke into his/her mouth by drawing on the opposite end (e.g., the filter end) of the cigarette. During the time that the cigarette is not being drawn upon by the smoker, that cigarette remains burning. Also, during the time that the cigarette is not being drawn upon, sidestream smoke is generated and directly enters the atmosphere from the lit end of the cigarette.

Numerous attempts have been made to provide cigarettes that generate relatively low levels of visible sidestream smoke. See, for example, U.S. Pat. Nos. 4,924,888 to Perfetti et al.; and U.S. Pat. No. 5,143,098 to Rogers et al. Certain attempts to reduce the levels of visible sidestream smoke generated by cigarettes have involved the use of tobacco rods having multiple layers of circumscribing wrapping materials. See, for example, U.S. Pat. No. 4,998,543 to Goodman; U.S. Pat. No. 5,220,930 to Gentry; and U.S. Pat. No. 5,271,419 to Arzonico et al.

Numerous references propose applying films to the paper wrapping materials of tobacco rods. See, for example, U.S. Pat. No. 1,909,924 to Schweitzer; U.S. Pat. No. 4,607,647 to Dashley; and U.S. Pat. No. 5,060,675 to Milford et al.

Numerous attempts have been made to control the manner that a cigarette burns when that cigarette is not being drawn upon. See, for example, U.S. Pat. No. 2,666,437 to Lattof; U.S. Pat. No. 3,030,963 to Cohn; U.S. Pat. No. 4,146,040 to Cohn; U.S. Pat. No. 4,453,553 to Cohn; U.S. Pat. No. 4,489,650 to Weinert; U.S. Pat. No. 4,489,738 to Simon; and U.S. Pat. No. 4,615,345 to Durocher.

Banded paper wrapping materials that are used for cigarette manufacture possess segments defined by the composition, location and properties of the various materials within those wrapping materials. Numerous references contain disclosures suggesting various banded wrapping material configurations. See, for example, U.S. Pat. No. 1,996,002 to Seaman; U.S. Pat. No. 1,999,222 to Weinberger; U.S. Pat. No. 2,013,508 to Seaman; U.S. Pat. No. 4,452,259 to Norman et al.; U.S. Pat. No. 4,889,145 to Adams et al.; U.S. Pat. No. 5,417,228 to Baldwin et al.; U.S. Pat. No. 5,878,753 to Peterson et al., U.S. Pat. No. 5,878,754 to Peterson et al.; and U.S. Pat. No. 6,198,537 to Bokelman et al.; US Pat. Application 2002/0139381 to Peterson et al.; and PCT WO 02/37991 and PCT WO 02/55294. Methods for manufacturing banded-type wrapping materials have been proposed. See, for example, U.S. Pat. No. 4,739,775 to Hampl, Jr.; U.S. Pat. No. 4,945,932 to Mentzel et al.; U.S. Pat. No. 5,474,095 to Allen et al.; and PCT WO 02/44700 and PCT WO 02/055294. Banded papers having segments of paper, fibrous cellulosic material, or particulate material adhered to a paper web also have been proposed. See, U.S. Pat. No. 5,191,906 to Myracle, Jr.; U.S. Pat. No. 5,263,999 to Baldwin et al.; U.S. Pat. No. 5,417,228 to Baldwin et al. and U.S. Pat. No. 5,450,863 to Collins et al.; and US Pat. Application 2002/0092621 to Suzuki.

It would be desirable to provide a cigarette manufacturer with a manner or method to produce a cigarette that possesses controlled burn characteristics resulting from alterations to the wrapping material of the tobacco rod of that cigarette.

SUMMARY

The present invention relates to wrapping materials for smoking articles, and to methods for making those wrapping materials. The present invention also relates to smoking articles, such as cigarettes, that are manufactured using those wrapping materials. The wrapping material incorporates at least one fibrous material (e.g., flax fibers, hardwood pulp fibers and/or softwood pulp fibers) and most preferably incorporates at least one filler material (e.g., an inorganic, essentially water insoluble material, such as calcium carbonate in particulate form). The wrapping material has deposited thereon, or otherwise applied thereto, at least one layer of coating, and most preferably, a multi-layer coating, in the form of a predetermined pattern.

In one aspect, the wrapping material possesses a coating in the form of a plurality of spaced apart bands. Each band possesses a series of layers, and those layers each can be continuous layers. Each layer most preferably comprises a film-forming material, such as a polymeric resin. A highly preferred film-forming material is ethylcellulose. At least one of the coating layers can have a filler material dispersed or suspended within the other components of the formulation used to provide that coating layer. A highly preferred filler is provided by particles of calcium carbonate.

In one aspect, the wrapping material includes a base sheet having a major surface and possessing a plurality of bands applied to that major surface in the form of a pattern. Each band possesses at least two layers, and each layer can be a continuous layer. Those layers include a first or bottom layer applied to a major surface of the base sheet, and a top layer applied over that bottom layer. In one aspect, the bottom layer has a width greater than that of the top layer. In another aspect, the bottom layer has a width essentially equal to that of the top layer. In another aspect, the top layer has a width greater than that of the bottom layer. If desired, at least one layer of coating (i.e., a primary coating) can be applied to the major surface prior to application of the aforementioned pattern. If desired, at least one layer of coating (i.e., an overcoating) can be applied to the major surface after application of the aforementioned pattern.

In another aspect, the wrapping material includes a base sheet having a major surface and possessing a plurality of bands applied to that major surface in the form of a pattern. Each band possesses at least three layers. Those layers include a first or bottom layer applied to a major surface of the base sheet, a middle layer applied over that bottom layer, and a top layer applied over that middle layer. In one aspect, the widths of all of the layers are essentially equal to one another. In one aspect, the bottom layer has a width different from that of the middle layer, and the middle layer has a width essentially equal to or different from that of the top layer. In another aspect, the bottom layer has a width essentially equal to that of the middle layer, and the middle layer has a width different than that of the top layer. The width of the bottom layer can be greater than that of the middle layer, and the width of the middle layer can be greater than that of the top layer. Either or both of the middle and top layers can have widths that are greater than that of the bottom layer. The top layer can have a width that is greater than that of the middle layer. For a layer that has a width different from that of another layer, each of those layers most preferably are positioned relative to one another so that both of the ends of that each layer are equally off-set relative to the respective ends of other layer. If desired, at least one layer of coating can be applied to the major surface prior to application of the aforementioned pattern. If desired, at least one layer of coating can be applied to the major surface after application of the aforementioned pattern.

In another aspect, the wrapping material includes a base sheet having a major surface and possessing a plurality of bands applied to that major surface in the form of a pattern. Each band possesses at least four layers, and each layer can be a continuous layer. Those layers include a first or bottom layer applied to a major surface of the base sheet, a second or bottom middle layer applied over that bottom layer, a third or top middle layer applied over the second layer, and a fourth or top layer applied over the third layer. For each band, the layer that is applied directly to the wrapping material (i.e., the first or bottom layer) has a second layer applied thereto. The width of the second layer can be essentially the same as, greater than, or less than, that of the first layer. For a second layer that has a width different from that of the first layer, the second layer most preferably is positioned relative to the first layer so that both of the ends of that second layer are equally off-set relative to the ends of the first layer. The second layer has a third layer applied thereto. The width of the third layer can be essentially the same as, greater than, or less than, that of the second layer. For a third layer that has a width different from that of the second layer, the third layer most preferably is positioned relative to the second layer so that both of the ends of that third layer are equally off-set relative to the ends of the second layer. The third layer has a fourth layer applied thereto. The width of the fourth layer can be essentially the same as, greater than, or less than, that of the third layer. For a fourth layer that has a width different from that of the third layer, the fourth layer most preferably is positioned relative to the third layer so that both of the ends of that fourth layer are equally off-set relative to the ends of the third layer. If desired, at least one layer of coating can be applied to the major surface prior to application of the aforementioned pattern. If desired, at least one layer of coating can be applied to the major surface after application of the aforementioned pattern.

In one preferred embodiment, the present invention relates to a wrapping material for a smoking article, and to a smoking article (e.g., a cigarette) manufactured using that wrapping material. Such a wrapping material most preferably possesses a wire side major surface and a felt side major surface. Such a wrapping material also has a pattern applied to at least one major surface of the wrapping material substrate as a plurality of layers, and most preferably, the pattern is applied to the wire side major surface. Preferably, at least one of those layers include ethylcellulose and calcium carbonate, with the calcium carbonate most preferably being present in an amount greater than the ethylcellulose, on a weight basis. A highly preferred wrapping material having such types of layers applied thereto possesses a smoking article wrapping material substrate including about 70 weight parts to about 90 weight parts fibrous material (e.g., wood pulp fiber and/or flax fiber) and about 10 weight parts to about 90 weight parts filler (e.g., calcium carbonate particles), based on the combined weight of fibrous material and filler; a basis weight of about 20 $g/m^2$ to about 30 $g/m^2$; an inherent porosity of about 20 CORESTA units to about 60 CORESTA units. Certain preferred wrapping materials include patterns that possess two, three or four layers, and for certain preferred wrapping materials, all of the layers include ethylcellulose and calcium carbonate, with the calcium carbonate being present in an amount greater than the ethylcellulose, on a weight basis. Layers including ethylcellulose and calcium carbonate also can optionally incorporate at least one plasticizer, at least one wetting agent, and/or at least one optical brightener. Typically, the components of the layers including ethylcellulose and calcium carbonate are applied to the wrapping material as a coating formulation comprising a major amount of at least one non-aqueous solvent (e.g., iso-propyl acetate).

DETAILED DESCRIPTION OF THE PREFERRED EMBODIMENTS

In accordance with the present invention, at least one layer of coating, and most preferably, several layers of coating formulation, are applied to a wrapping material, preferably using a printing process. Most preferably, the coating formulation is applied using intaglio processes. As such, gravure coating techniques, such as rotogravure printing techniques, are particularly preferred. Other techniques for the coating formulation to the wrapping material include blade coating, air-knife coating, roll-coating and shaft coating techniques. Alternatively and/or additionally, the layers of coating formulation can be applied by spraying, ink jet coating, or other similar coating techniques. A printed wrapping material is provided with a pattern such as is provided by application of at least one additive material to a formed wrapping material. The pattern is applied to the wrapping material in a so-called offline fashion (i.e., offline relative to the manufacture of that wrapping material).

Gravure printing techniques involve printing from the continuous surface of a metal cylinder engraved mechanically or by laser, or etched chemically so as to possess minute grooves or cells below the surface of that cylinder. A typical printing cylinder surface is provided by etching a smooth, polished copper surface and plating that etched surface with chrome. Those recessed cells or grooves hold liquid (or liquid dispersion) formulations form impressions, layers or "bumps" to be deposited onto the desired location of a substrate, such as a continuous web of paper wrapping material. Rotogravure printing presses have been commercially available from Bobst Champlain, Inc.; from Cerutti S.p.A.; from Rotomek, S.p.A.; from Intra-Roto, Inc.; as Merkur Heliostar from Wirdmoller & Holscher, and KBA TR 7B from Albert-Frankenhal AG. Gravure printing techniques are described in *Pocket Pal*, published by International Paper Company (1970); Scarlett et al., *What the Printer Should Know About Ink* (1984); and *Gravure, Process and Technology*, Grav. Educ. Fdn. and Grav. Assoc. Amer. (1991). Thus, the selection and operation of gravure printing equipment will be readily apparent to one skilled in the art of printing. See, for example, US Pat. Application 2002/0139381 to Peterson et al. Equipment and techniques for applying coatings and inks to paper wrapping materials suitable for the manufacture of tobacco rods for cigarettes are set forth in U.S. Pat. No. 5,060,675 to Milford et al.; U.S. Pat. No. 5,878,753 to Peterson et al.; U.S. Pat. No. 5,878,754 to Peterson et al.; and PCT WO 02/37991. See, also, U.S. Pat. No. 4,474,110 to Rosner.

Figure 1:
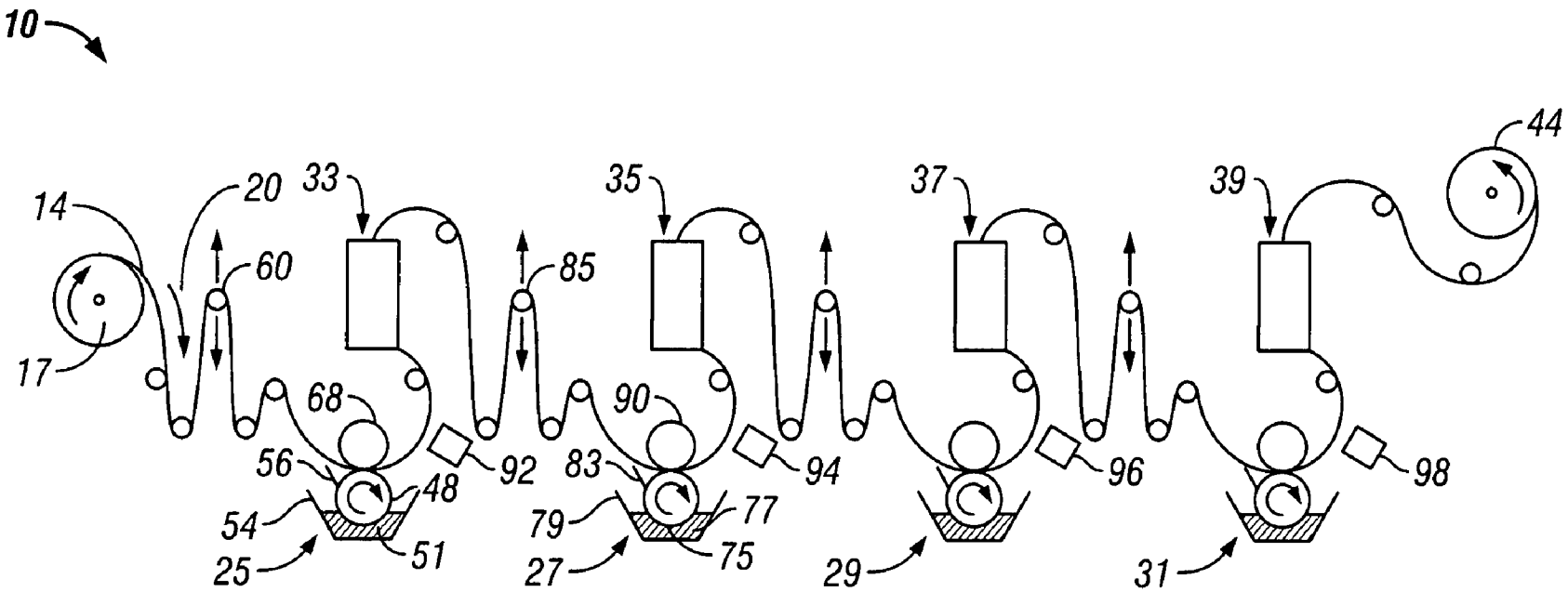
FIG. 1 is a schematic illustration of an apparatus for applying printed patterns to wrapping materials, there being shown a side view of several gravure printing press stations.

Referring to FIG. 1, there is shown a gravure printing press 10 of the type useful for printing desired components as predetermined patterns onto wrapping materials. In operation, a wrapping material 14 is unwound from a large payout roll 17. The payout roll 17 is shown rotating in a clockwise direction, causing the continuous web of wrapping material 14 to travel in the direction shown by arrow 20. The size of the payout roll can vary, and an exemplary payout roll provides a continuous sheet of about 31 inches wide and about 16,000 meters in length. The continuous web of wrapping material is passed, in succession, through a plurality printing stations and drying stations, shown as a series of four printing stations 25, 27, 29 and 31, and four drying stations 33, 35, 37, 39. The resulting printed and dried web then is wound onto a take-up roll 44 (i.e., the wrapping material is adapted in such a manner that it can be wound on or as a roll).

The take-up roll then is unwound and slit to provide a plurality of webs of the desired size, and those webs are re-wound into bobbins for use on cigarette making machines for the manufacture of tobacco rods for cigarettes (not shown). Dried wrapping materials of the present invention preferably have residual liquid carrier or solvent levels that are less than about 300 mg/ream (a ream being 3,000 square feet).

The first printing station 25 includes a first etched printing cylinder 48 that is rotated clockwise through a first liquid (or liquid dispersion) coating mixture or printing formulation 51. That printing formulation or ink 51 is located in a first trough or pan 54, and some of that ink within that trough is picked up onto the printing surface face (not shown) of that cylinder 48. An exemplary printing cylinder is a metal cylinder having a cylinder face length of about 54 inches, and a diameter of about 11.28 inches; and such a cylinder can have an etched region sufficient to print the web in the desired manner (e.g., a 31 inch etched region on the cylinder face is sufficient to print a web of 31 inch width). Optionally, the cylinder 48 and the trough 54 containing the ink 51 can be equipped with heating equipment (not shown). Heating of the ink to elevated temperatures is desirable for certain printing formulations that might otherwise exhibit relatively high viscosities at temperatures approximating those of ambient conditions.

A first doctor blade 56 (e.g., a steel blade extending along the printing surface face of the cylinder) is located downstream from the trough 54, and is positioned against the etched surface of the first printing cylinder 48 in a manner so as to wipe off surplus ink from that cylinder while allowing the desired ink for printing to be retained within the etched grooves of that cylinder. The continuous web of wrapping material 14 passes through a tension compensation roll system 60, and between the first printing cylinder 48 and a first impression cylinder 68. When that wrapping material passes the region between the printing cylinder 48 and the impression cylinder 68, the compressive forces provided between the surfaces of those two cylinders cause the ink to be transferred from the printing cylinder, and to be pressed onto (and hence applied) to the wrapping material. Depending upon the pattern etched into the surface of the printing cylinder, a pattern is printed onto a major surface (not shown) of the wrapping material. The amount of ink deposited onto the substrate in a particular region of that substrate depends upon factors such as the depth of each etched cell, the area of each cell, and the spacing between the cells. Great numbers of relatively large volume etched cells that are closely spaced allow a relatively large amount of ink to be deposited onto a substrate. For example, exemplary coatings can have layers whereby the line screen is such that the first layer is coated at about 101 dots per square inch, and the subsequent second, third and fourth layers each are coated at about 81 dots per square inch; and alternatively, exemplary coatings can have layers whereby the line screen is such that all of the layers are coated at about 81 dots per square inch. The ink is printed onto the major surface of the wrapping material in the form of a discrete layer or bump.

After the coating formulation is applied to the wrapping material, the carrier liquid or liquid solvent of the ink is removed from the wrapping material. Typically, the liquid is removed by evaporation techniques, which usually are provided by heating the wrapping material. As such, printed wrapping material is passed through a first dryer 33 to remove liquid solvent or carrier (e.g., by evaporation) from the printed region of the wrapping material. An exemplary dryer is a gas fired, high velocity forced air oven having a longitudinally-extending heating space of about 40 feet. Typically, the dryer is set to a desired temperature (e.g., about 140° F.), and a given portion of the printed wrapping material is present within the dryer for about 1 second to about 5 seconds, and normally about 2 to about 3 seconds. Each respective dryer can be set at a different temperature, depending upon factors such as the volatility and amount of the particular liquid solvent or carrier. Typically, the wrapping material is heated and treated sufficiently to remove residual solvent of the coating formulation such that any residual amount of solvent is present in an amounts that are low enough to not adversely affect to any significant degree the performance characteristics, chemical nature or sensory characteristics of the smoke generated by a smoking article manufactured from that wrapping material.

The continuous web of wrapping material 14 then is passed through a second printing station 27. The second printing station 27 includes a second etched printing cylinder 75 that is rotated clockwise through a second liquid (or liquid dispersion) coating mixture or printing formulation 77. That printing formulation or ink 77 is located in a second trough or pan 79, and some of that ink within that trough is picked up onto the printing surface face (not shown) of that cylinder 75. Optionally, the ink can be subjected to elevated temperatures by heating the cylinder 75 and trough 79.

A second doctor blade 83 is located downstream from the trough 79, and is positioned against the etched surface of the second printing cylinder 75 in a manner so as to wipe off surplus ink from that cylinder while allowing the desired ink for printing to be retained within the etched grooves of that cylinder. The continuous web of wrapping material 14 passes through a tension compensation roll system 85, and between the second printing cylinder 75 and a second impression cylinder 90. The ink is transferred from the printing cylinder 75, and hence applied to the wrapping material 14, when that wrapping material passes the region between the printing cylinder and the impression cylinder 90. Depending upon the pattern etched into the surface of the printing cylinder, a second pattern is printed onto a major surface (not shown) of the wrapping material. The ink is printed onto the major surface of the wrapping material in the form of a discrete layer or bump. The printed wrapping material then is passed through a second dryer 35 to remove liquid solvent or carrier (e.g., by evaporation) from the printed region of the wrapping material. Preferably, the ink of the second printing station is printed directly on top of the previously printed layer; that is, using types of printing techniques known as "trap printing."

The continuous web of wrapping material 14 then is passed through third and fourth printing stations 29, 31, and third and fourth drying stations 37, 39, respectively and successively. The types of components and manner of operation of those third and fourth printing stations and drying stations are essentially identical to those of the first two printing and drying stations that have been described previously. Besides the printing press 10 of the type shown in FIG. 1 (i.e., a press possessing four printing stations), similar types of printing presses possessing other numbers of printing stations (e.g., 2, 3, 5, 6, 7, 8, 9 or 10 printing stations) can be employed.

Certain printing stations of the printing press 10 can be modified, if desired. For example, certain printing stations can be suitably configured so as to allow printing on both sides (i.e., on both major surfaces) on the wrapping material. Additionally, printing stations can be suitably configured with heating apparatus so as to allow certain film-forming materials to be printed in a solid (i.e., solvent-free) form.

The various printed layers are aligned or registered in order that a coating of a predetermined pattern can by provided on a major surface of the wrapping material. It is most desirable to employ automatic detection devices 92, 94, 96 and 98, in order to identify and control the positioning of various coated layers, and hence provide for alignment or registration of those layers. Each respective detector system is positioned downstream of the print cylinder/impression cylinder combination, detects that just printed bump, and provides an output for controlling registration of the printing of a subsequent coating layer on top of the previously printed layer. Such automatic detection devices are particularly useful for registering the application of multiple printing formulations upon materials that are moving at relatively high speeds (e.g., in excess of about 500 feet/minute). Suitable automatic detection devices are those optical detection devices that operate in the visible, ultraviolet or near infrared range. As such, an appropriate sensor is linked to a computer and/or controller that can perform the function of automatically controlling the location at which subsequent printing cylinders apply the various layers into the desired printed pattern (i.e., there is control of the registration of the various printed layers).

Certain coating formulations, such as those that are clear and colorless, can be difficult to align, particularly when using visual alignment techniques. In order to employ detection devices, such as visible and ultraviolet sensors, in order to assist in locating printed layers on the wrapping material, it is often desirable to incorporate an effective amount of a suitable optical brightener into the coating formulation. Exemplary registration systems include the Autotron 2600D from PressTech Controls Ltd., the View Point Vision System from CC1, the PC3100 series systems available from Eltromat Electronics, Inc., and those ultraviolet detection systems available from Dr. Grobel UV-Elektronic GmbH. Such types of systems can be used for quality control purposes as well as for ensuring the proper, desired alignment of the numerous printed layers of the desired pattern.

Typically, registration marks in the "dead space" on either extreme side of the wrapping material are identified using suitable detection equipment, and the collected data associated with the location of a printed layer are used to align and register the location where subsequent layers are printed using subsequent printing cylinders. It also is desirable to provide each cylinder printing face with a marked reference point to provide a unique printed shape onto the dead space region on the opposite side of the wrapping material at a predetermined location. As such, a machine operator can manually identify those printed marks (e.g., through the use of a suitable strobe light), compare the location of those marks, and determine whether or not subsequent printing cylinders are properly applying subsequent printing formulations in the appropriate locations. In the event that the various layers are not being applied in the desired locations, adjustment of the operation of subsequent printing cylinders can be made in order to ensure proper alignment of the various printed layers.

If desired, the wrapping material can be evaluated to determine its porosity and basis weight prior to the time that the wrapping material is wound onto the take-up roll. Typical devices designed for determining the porosity and coating weight of the printed wrapping material often do not provide accurate and reliable measurement of wrapping material that travels at the relatively high speeds common during the use of gravure printing equipment. Although a printed sample can be obtained from a roll and evaluated for proper porosity and coating weight, it is desirable to measure those properties of a printed wrapping material in an "online" fashion, particularly to help ensure consistent and effective application of printing formulation. In order to facilitate automatic online measurement of porosity and coating weight (e.g., using equipment available from sources such as Borgwaldt and Extrol, respectively), a festoon system (similar to those found on typical gravure presses), is incorporated into the printing press, particularly in that region of the printing press after the last printing cylinder and before the take-up roll. In the region of that festoon system are located the application weight sensors and porosity inspection systems. The decrease in the speed of travel of the wrapping material in the region of the festoon system provides the opportunity for appropriate measurement devices to record readings accurately. As such, appropriate adjustments to the process conditions readily can be make in the event that wrapping material that is out of specification is observed.

Operation of a festoon system and its use to measure and control properties of a printed wrapping material can be described as follows. After the final print station, an outfeed nip is employed to control the tension of the running web. After this outfeed nip region, a festoon section is employed to accumulate web in the desired time increments. A second, separate outfeed nip following the festoon section controls tension of the web prior to winding on a take-up roll. Typically, when measurements are taken on the printed web, the winding speed of the finished roll is reduced while the printing equipment continues to maintain a steady production speed. The additional printed web that is not wound on the finished roll accumulates in the festoon section as the portion of the web beyond the festoon slows down to an appropriate speed for accurate online measurement. Once the appropriate measurements are recorded, the finished roll is allowed to regain speed to the appropriate line speed, and remove the excess web from the festoon section. Such process steps occur in the desired time increments dictated by the components necessary for desired process control.

After printing is complete, the printed wrapping material 14 then can be taken from take-up roll 44 and slit to the desired dimensions. Slit wrapping materials normally are provided in the form of bobbins for use on conventional cigarette manufacturing equipment. An exemplary slit wrapping material is about 27 mm across, and as such, can be used to provide a tobacco rod of about 24.5 mm circumference and about 2.5 mm for an overlap seam or lap zone for an adhesive line. The wrapping material can be slit to other dimensions, depending up factors such as the desired circumference of the tobacco rod and the desired overlap for the adhesive line.

Figure 2:
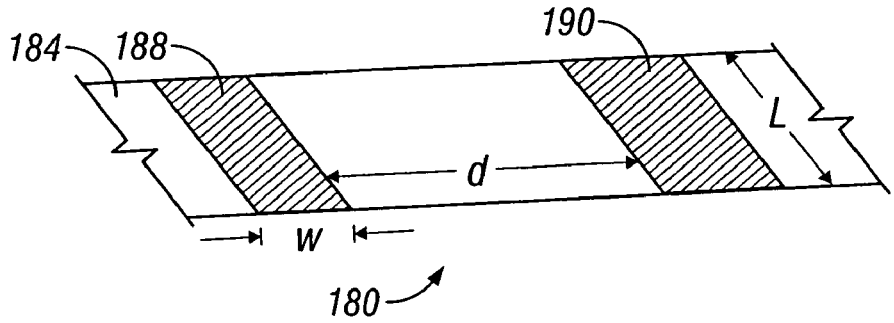
FIG. 2 is a perspective of a portion of a web of a wrapping material.

Referring to FIG. 2, there is shown a portion of a slit web of printed wrapping material 180 shown as cut away at each end. The printed wrapping material 180 possesses a base sheet 184, and there are two bands, 188, 190 shown as being printed on the upper major surface of the wrapping material and positioned so as to extend transversely to the longitudinal axis of the wrapping material. The printed wrapping material 180 has a length across L of about 27 mm. The bands 188, 190 are shown as each having a width w; and the bands are spaced apart by a distance d. It is most highly preferred that the bands 188, 190 each are continuous bands (i.e., those bands totally cover the regions of the wrapping material over which they are printed, and no portion of the wrapping material remains unprinted within the banded regions). However, certain preferred continuous bands can include two or more layers, and at least one of those layers can have the form of discontinuous patterns.

Figure 3:
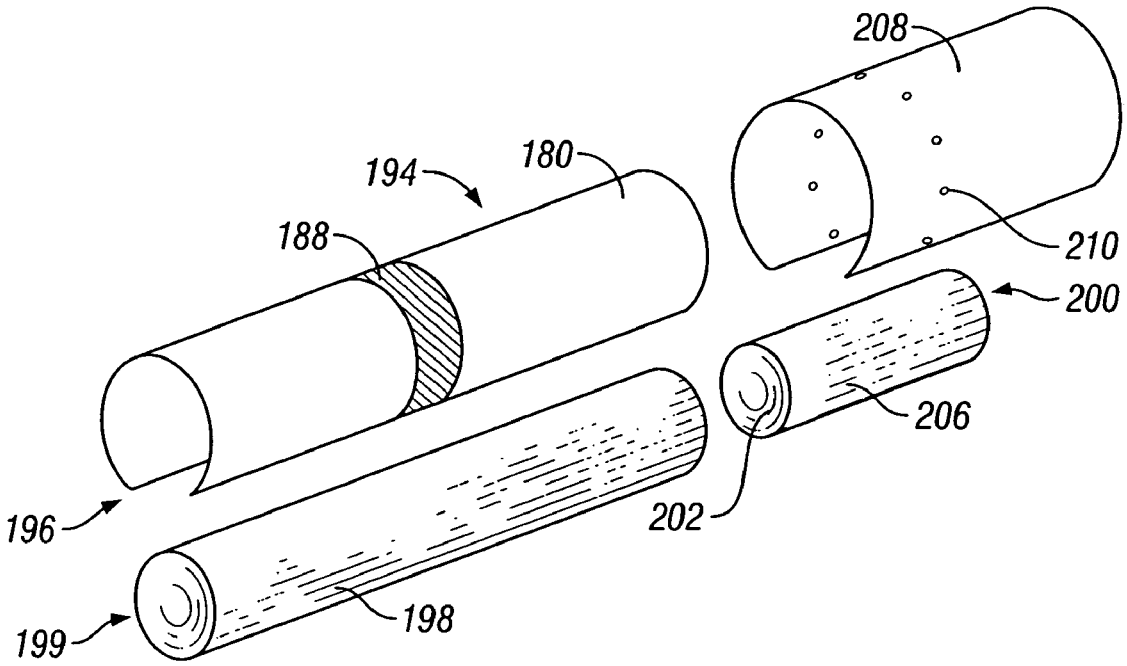
FIG. 3 is an exploded perspective of smoking article, showing the smokable material, the wrapping material components, and the filter element.

Referring to FIG. 3, there are shown the components of a smoking article 194 in the form of a cigarette. The cigarette 194 includes a generally cylindrical rod 196 of a charge or roll of smokable filler material 198 contained in a circumscribing wrapping material 180 of the present invention. The rod 196 is conventionally referred to as a "tobacco rod". The ends of the tobacco rod are open to expose the smokable filler material. At one end of the tobacco rod 196 is the lighting end 199, and at the other end is shown a filter element 200. The cigarette 194 is shown as having one printed band 188 on printed wrapping material 180, and that band circumscribes the cigarette rod in a direction transverse to the longitudinal axis of the cigarette. That is, the band provides a cross-directional region relative to the longitudinal axis of the cigarette. The band can be printed on the inner surface of the wrapping material (i.e., facing the smokable filler material) or on the outer surface of the wrapping material. Although the cigarette shown in FIG. 3 possesses wrapping material having one band, the cigarette also can possess wrapping material having spaced bands numbering two, three, or more. For a cigarette having a wrapping material possessing multiple bands, the bands can be identical, or virtually identical, in terms of composition, weight, dimension, or the like. In addition, it is desirable that the leading edge of the printed band positioned closest to the lighting end 199 of the cigarette be positioned at least about 5 mm, and often at least about 10 mm, from the extreme lighting end of the cigarette.

The cigarette 194 normally includes a filter element 200 or other suitable mouthpiece positioned adjacent one end of the tobacco rod 196 such that the filter element and tobacco rod are axially aligned in an end-to-end relationship, preferably abutting one another. Filter element 200 has a generally cylindrical shape, and the diameter thereof is essentially equal to the diameter of the tobacco rod. The ends of the filter element are open to permit the passage of air and smoke therethrough. The filter element 200 includes filter material 202 (e.g., plasticized cellulose acetate tow) that is overwrapped along the longitudinally extending surface thereof with circumscribing plug wrap material 206. The filter element 200 can have two or more filter segments, and/or flavor additives incorporated therein.

The filter element 200 is attached to the tobacco rod 196 by tipping material 208 which circumscribes both the entire length of the filter element and an adjacent region of the tobacco rod. The inner surface of the tipping material 208 is fixedly secured to the outer surface of the plug wrap 206 and the outer surface of the wrapping material 180 of the tobacco rod, using a suitable adhesive. A ventilated or air diluted smoking article is provided with an air dilution means, such as a series of perforations 210, each of which extend through the tipping material and plug wrap.

The tobacco rod 196, the filter element 200 and the cigarette 194 resulting from the combination thereof can be manufactured using conventional cigarette and cigarette component manufacturing techniques and equipment, without any extensive modification, if any, to those conventional techniques and equipment. Manners and methods suitable for the commercial production of cigarettes of the present invention will be readily apparent to those skilled in the art of cigarette manufacture.

Cigarettes of the present invention possessing tobacco rods manufactured using certain appropriately treated wrapping materials of the present invention, when tested using the methodology set forth in the Cigarette Extinction Test Method by the National Institute of Standards and Technology (NIST), Publication 851 (1993) using 10 layers of Whatman No. 2 filter paper, meet criteria requiring extinction of greater than about 50 percent, preferably greater than about 75 percent, and most preferably about 100 percent, of cigarettes tested. Certain cigarettes of the present invention possessing tobacco rods manufactured using certain appropriately treated wrapping materials of the present invention, when tested using the methodology set forth in ASTM Designation: E2187-02b using 10 layers of Whatman No. 2 filter paper, meet criteria requiring extinction of greater than about 50 percent, preferably greater than about 75 percent, and most preferably about 100 percent, of cigarettes tested.

Preferably, each cigarette possesses at least one band located in a region of its tobacco rod such that the band is capable of providing that cigarette with the ability to meet those cigarette extinction criteria. For a tobacco rod of a particular length incorporating a wrapping material possessing bands that are aligned transversely to the longitudinal axis of the wrapping material in a spaced apart relationship, the ratio of the length of the tobacco rod to the sum of the width of a band and the distance between the bands is 1 to 2, preferably about 1.1 to about 1.4, and most preferably about 1.2.

For an exemplary full flavor cigarette having a tobacco rod length of about 63 mm and a filter element length of about 21 mm, cross directional bands of about 6 mm width can be spaced at about 20 mm intervals on the wrapping materials used to manufacture those cigarettes. Alternatively, for those types of cigarettes, bands of about 4 mm width can be spaced at about 22 mm intervals on the wrapping materials used to manufacture those cigarettes. Alternatively, for those types of cigarettes, bands of about 6 mm width can be spaced at about 39 mm intervals. For an exemplary full flavor cigarette having a tobacco rod length of about 70 mm and a filter element length of about 30 mm, cross directional bands of about 6 mm width can be spaced at about 44 mm intervals on the wrapping materials used to manufacture those cigarettes. For an exemplary ultra low tar cigarette having a tobacco rod length of about 57 mm and a filter element length of about 27 mm, cross directional bands of about 7 mm width can be spaced at about 20 mm intervals. Alternatively, for those types of cigarettes, bands of about 6 mm width can be spaced at about 33 mm intervals, or at about 39 mm intervals, on the wrapping materials used to manufacture those cigarettes. For an exemplary ultra low tar cigarette having a tobacco rod length of about 68 mm and a filter element length of about 31 mm, cross directional bands of about 6 mm width can be spaced at about 44 mm intervals on the wrapping materials used to manufacture those cigarettes. Full flavor cigarettes are classified as those that yield about 14 mg or more of FTC "tar." Ultra low tar cigarettes are classified as those that yield less than about 7 mg of FTC "tar." Those cigarettes, which possess tobacco rods having appropriate wrapping materials possessing bands including appropriate amounts of appropriate components, have the ability to meet the aforementioned cigarette extinction criteria.

Cigarettes of the present invention can be manufactured from a variety of components, and can have a wide range of formats and configurations. Typical cigarettes of the present invention having cross directional bands applied to the wrapping materials of the tobacco rods of those cigarettes have static burn rates (i.e., burn rates of those cigarettes under non-puffing conditions) of about 50 to about 60 mg tobacco rod weight per minute, in the non-banded regions of those cigarettes. Typical cigarettes of the present invention having cross directional bands applied to the wrapping materials of the tobacco rods of those cigarettes have static burn rates (i.e., burn rates of those cigarettes under non-puffing conditions) of less than about 50 mg tobacco rod weight per minute, preferably about 40 to about 45 mg tobacco rod weight per minute, in the banded regions of those cigarettes.

The tobacco materials used for the manufacture of cigarettes of the present invention can vary. Descriptions of various types of tobaccos, growing practices, harvesting practices and curing practices are set for in *Tobacco Production, Chemistry and Technology*, Davis et al. (Eds.) (1999). The tobacco normally is used in cut filler form (e.g., shreds or strands of tobacco filler cut into widths of about 1/10 inch to about 1/60 inch, preferably about 1/20 inch to about 1/35 inch, and in lengths of about 1/4 inch to about 3 inches). The amount of tobacco filler normally used within a cigarette ranges from about 0.6 g to about 1 g. The tobacco filler normally is employed so as to filler the tobacco rod at a packing density of about 100 mg/cm$^3$ to about 300 mg/cm$^3$, and often about 150 mg/cm$^3$ to about 275 mg/cm$^3$. Tobaccos can have a processed form, such as processed tobacco stems (e.g., cut-rolled or cut-puffed stems), volume expanded tobacco (e.g., puffed tobacco, such as propane expanded tobacco and dry ice expanded tobacco (DIET)), or reconstituted tobacco (e.g., reconstituted tobaccos manufactured using paper-making type or cast sheet type processes).

Typically, tobacco materials for cigarette manufacture are used in a so-called "blended" form. For example, certain popular tobacco blends, commonly referred to as "American blends," comprise mixtures of flue-cured tobacco, burley tobacco and Oriental tobacco, and in many cases, certain processed tobaccos, such as reconstituted tobacco and processed tobacco stems. The precise amount of each type of tobacco within a tobacco blend used for the manufacture of a particular cigarette brand varies from brand to brand. See, for example, *Tobacco Encyclopedia*, Voges (Ed.) p. 44-45 (1984), Browne, *The Design of Cigarettes,* 3rd Ed., p.43 (1990) and *Tobacco Production, Chemistry and Technology*, Davis et al. (Eds.) p. 346 (1999). Other representative tobacco blends also are set forth in U.S. Pat. No. 4,924,888 to Perfetti et al.; U.S. Pat. No. 5,056,537 to Brown et al.; and U.S. Pat. No. 5,220,930 to Gentry; and Bombick et al., *Fund. Appl. Toxicol.,* 39, p. 11-17 (1997). Yet other representative tobacco blends also are set forth in PCT WO 02/37990; U.S. Pat. No. 4,836,224 to Lawson et al.; U.S. Pat. No. 5,159,942 to Brinkley et al.; U.S. Pat. No. 5,360,023 to Blakley et al.; and U.S. Pat. No. 5,714,844 to Young et al.; U.S. Pat. Applications 2002/0000235; 2003/0075193; and 2003/0131859; and U.S. patent application Ser. No. 10/285,395, filed Oct. 31, 2002 and Ser. No. 10/463,211, filed Jun. 17, 2003.

If desired, in addition to the aforementioned tobacco materials, the tobacco blend of the present invention can further include other components. Other components include casing materials (e.g., sugars, glycerin, cocoa and licorice) and top dressing materials (e.g., flavoring materials, such as menthol). The selection of particular casing and top dressing components is dependent upon factors such as the sensory characteristics that are desired, and the selection of those components will be readily apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972).

Smoking articles also can incorporate at least one flavor component within the side seam adhesive applied to the wrapping material during the manufacture of the tobacco rods. That is, for example, various flavoring agents can be incorporated in a side seam adhesive CS-2201A available from R.J. Reynolds Tobacco Company, and applied to the seam line of the wrapping material. Those flavoring agents are employed in order to mask or ameliorate any off-taste or malodor provided to the smoke generated by smoking articles as a result of the use of the wrapping materials of the present invention, such as those wrapping materials having printing formulations incorporating ethylcellulose, nitrocellulose or starch applied thereto. Exemplary flavors include methyl cyclopentenolone, vanillin, ethyl vanillin, inulin, 4-parahydroxyphenyl-2-butanone, gamma-undecalactone, 2-methoxy-4-vinylphenol, 2-methoxy-4-methylphenol, 5-ethyl-3-hydroxy-4-methyl-2(5H)-furanone, methyl salicylate, clary sage oil and sandalwood oil. Typically, such types of flavor components are employed in amounts of about 0.2 percent to about 6.0 percent, based on the total weight of the adhesive and flavor components.

The wrapping materials of the present invention also can be used in the manufacture of tobacco rods having more than one layer of circumscribing wrapping material, such as the so-called "double wrap" tobacco rods. That is, the wrapping material of the present invention can be used as the inner wrap or the outer wrap of such double wrap tobacco rods. Exemplary cigarettes, and exemplary components, parameters and specifications thereof, are described in U.S. Pat. No. 5,220,930 to Gentry; PCT WO 02/37990 and US Pat. Application 2002/0166563. Representative filter element components and designs are described in Browne, *The Design of Cigarettes,* 3rd Ed. (1990); *Tobacco Production, Chemistry and Technology*, Davis et al. (Eds.) (1999); U.S. Pat. No. 4,508,525 to Berger; U.S. Pat. No. 4,807,809 to Pryor et al.; U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones, Jr. et al.; U.S. Pat. No. 5,101,839 to Jakob et al.; U.S. Pat. No. 5,105,834 to Saintsing et al.; U.S. Pat. No. 5,105,838 to White et al.; U.S. Pat. No. 5,271,419 to Arzonico et al.; U.S. Pat. No. 5,360,023 to Blakley et al; U.S. Pat. No. 5,595,218 to Koller et al.; U.S. Pat. No. 5,718,250 to Banerjee et al.; and U.S. Pat. No. 6,537,186 to Veluz; US Patent Applications 2002/0014453; 2002/0020420; and 2003/0168070; U.S. patent application Ser. No. 10/600,712, filed Jun. 23, 2003; PCT WO 03/059096; and European Patent No. 920816. Representative filter materials can be manufactured from tow materials (e.g., cellulose acetate or polypropylene tow) or gathered web materials (e.g., gathered webs of paper, cellulose acetate, polypropylene or polyester).

Wrapping materials of the present invention are useful for the manufacture of cigarettes designed to exhibit reduced ignition propensity. That is, cigarettes incorporating certain wrapping materials of the present invention, when placed on a flammable substrate, tend to self extinguish before burning that substrate. Of particular interest are those cigarettes possessing tobacco rods manufactured using appropriate wrapping materials possessing bands including appropriate amounts of appropriate components so as to have the ability to meet the aforementioned cigarette extinction criteria.

The wrapping material that is further processed to provide the patterned wrapping material of the present invention can have a wide range of compositions and properties. The selection of a particular wrapping material will be readily apparent to those skilled in the art of cigarette design and manufacture. Typical paper wrapping materials are manufactured from fibrous materials, and optional filler materials, to form so-called "base sheets." Wrapping materials of the present invention can be manufactured without significant modifications to the production techniques or processing equipment used to manufacture those wrapping materials.

Typical wrapping material base sheets suitable for use as the circumscribing wrappers of tobacco rods for cigarettes have basis weights that can vary. Typical dry basis weights of base sheets are at least about 15 g/m$^2$, and frequently are at least about 20 g/m$^2$; while typical dry basis weights do not exceed about 80 g/m$^2$, and frequently do not exceed about 60 g/m$^2$. Many preferred wrapping material base sheets have basis weights of less than 50 g/m$^2$, and even less than 40 g/m$^2$. Certain preferred paper wrapping material base sheets have basis weights between about 20 g/m$^2$ and about 30 g/m$^2$.

Typical wrapping material base sheets suitable for use as the circumscribing wrappers of tobacco rods for cigarettes have inherent porosities that can vary. Typical base sheets have inherent porosities that are at least about 5 CORESTA units, usually are at least about 10 CORESTA units, often are at least about 15 CORESTA units, and frequently are at least about 20 CORESTA units. Typical base sheets have inherent porosities that are less than about 200 CORESTA units, usually are less than about 150 CORESTA units, often are less than about 85 CORESTA units, and frequently are less than about 70 CORESTA units. A CORESTA unit is a measure of the linear air velocity that passes through a 1 cm 2 area of wrapping material at a constant pressure of 1 centibar. See, CORESTA Publication ISO/TC0126/SC I N159E (1986). The term "inherent porosity" refers to the porosity of that wrapping material itself to the flow of air. A particularly preferred paper wrapping material base sheet includes wood pulp and calcium carbonate, and exhibits an inherent porosity of about 20 to about 50 CORESTA units.

Typical paper wrapping material base sheets suitable for use as the circumscribing wrappers of tobacco rods for cigarettes incorporate at least one type of fibrous material, and can incorporate at least one filler material, in amounts that can vary. Typical base sheets include about 55 to about 100, often about 65 to about 95, and frequently about 70 to about 90 percent fibrous material (which most preferably is a cellulosic material); and about 0 to about 45, often about 5 to about 35, and frequently about 10 to about 30 percent filler material (which most preferably is an inorganic material); based on the dry weight of that base sheet.

The wrapping material incorporates a fibrous material. The fibrous material can vary. Most preferably, the fibrous material is a cellulosic material, and the cellulosic material can be a lignocellulosic material. Exemplary cellulosic materials include flax fibers, hardwood pulp, softwood pulp, hemp fibers, esparto fibers, kenaf fibers, jute fibers and sisal fibers. Mixtures of two or more types of cellulosic materials can be employed. For example, wrapping materials can incorporate mixtures of flax fibers and wood pulp. The fibers can be bleached or unbleached. Other fibrous materials that can be incorporated within wrapping materials include microfibers materials and fibrous synthetic cellulosic materials. See, for example, U.S. Pat. No. 4,779,631 to Durocher and U.S. Pat. No. 5,849,153 to Ishino. Representative fibrous materials, and methods for making wrapping materials therefrom, are set forth in U.S. Pat. No. 2,754,207 to Schur et al; and U.S. Pat. No. 5,474,095 to Allen et al.; and PCT WO 01/48318.

The wrapping material normally incorporates a filler material. Preferably, the filler material has the form of essentially water insoluble particles. Additionally, the filler material normally incorporates inorganic components. Filler materials incorporating calcium salts are particularly preferred. One exemplary filler material has the form of calcium carbonate, and the calcium carbonate most preferably is used in particulate form. See, for example, U.S. Pat. No. 4,805,644 to Hampl; U.S. Pat. No. 5,161,551 to Sanders; and U.S. Pat. No. 5,263,500 to Baldwin et al.; and PCT WO 01/48,316. Other filler materials include agglomerated calcium carbonate particles, calcium tartrate particles, magnesium oxide particles, magnesium hydroxide gels; magnesium carbonate-type materials, clays, diatomaceous earth materials, titanium dioxide particles, gamma alumina materials and calcium sulfate particles. See, for example, U.S. Pat. No. 3,049,449 to Allegrini; U.S. Pat. No. 4,108,151 to Martin; U.S. Pat. No. 4,231,377 to Cline; U.S. Pat. No. 4,450,847 to Owens; U.S. Pat. No. 4,779,631 to Durocher; U.S. Pat. No.

4,915,118 to Kaufman; U.S. Pat. No. 5,092,306 to Bokelman; U.S. Pat. No. 5,109,876 to Hayden; U.S. Pat. No. 5,699,811 to Paine; U.S. Pat. No. 5,927,288 to Bensalem; U.S. Pat. No. 5,979,461 to Bensalem; and U.S. Pat. No. 6,138,684 to Yamazaki; and European Pat. Application 357,359. Certain filler-type materials that can be incorporated into the wrapping materials can have fibrous forms. For example, components of the filler material can include materials such as glass fibers, ceramic fibers, carbon fibers and calcium sulfate fibers. See, for example, U.S. Pat. No. 2,998,012 to Lamm; U.S. Pat. No. 4,433,679 to Cline; and U.S. Pat. No. 5,103,844 to Hayden et al.; PCT WO 01/41590; and European Pat. Application 1,084,629. Mixtures of filler materials can be used. For example, filler material compositions can incorporate mixtures of calcium carbonate particles and precipitated magnesium hydroxide gel, mixtures of calcium carbonate particles and calcium sulfate fibers, or mixtures of calcium carbonate particles and magnesium carbonate particles.

There are various ways by which the various additive components can be added to, or otherwise incorporated into, the base sheet. Certain additives can be incorporated into the wrapping material as part of the paper manufacturing process associated with the production of that wrapping material. Alternatively, additives can be incorporated into the wrapping material using size press techniques, spraying techniques, printing techniques, or the like. Such techniques, known as "off-line" techniques, are used to apply additives to wrapping materials after those wrapping materials have been manufactured. Various additives can be added to, or otherwise incorporated into, the wrapping material simultaneously or at different stages during or after the paper manufacturing process.

The base sheets can be treated further, and those base sheets can be treated so as to impart a change to the overall physical characteristics thereof and/or so as to introduce a change in the overall chemical compositions thereof. For example, the base sheet can be electrostatically perforated. See, for example, U.S. Pat. No. 4,924,888 to Perfetti et al. The base sheet also can be embossed, for example, in order to provide texture to major surface thereof. Additives can be incorporated into the wrapping material for a variety of reasons. Representative additives, and methods for incorporating those additives to wrapping materials, are set forth in U.S. Pat. No. 5,220,930 to Gentry, which is incorporated herein by reference. See, also, U.S. Pat. No. 5,168,884 to Baldwin et al. Certain components, such as alkali metal salts, can act a burn control additives. Representative salts include alkali metal succinates, citrates, acetates, malates, carbonates, chlorides, tartrates, propionates, nitrates and glycolates; including sodium succinate, potassium succinate, sodium citrate, potassium citrate, sodium acetate, potassium acetate, sodium malate, potassium malate, sodium carbonate, potassium carbonate, sodium chloride, potassium chloride, sodium tartrate, potassium tartrate, sodium propionate, potassium propionate, sodium nitrate, potassium nitrate, sodium glycolate and potassium glycolate; and other salts such as monoammonium phosphate. See, for example, U.S. Pat. No. 2,580,568 to Matthews; U.S. Pat. No. 4,461,311 to Matthews; U.S. Pat. No. 4,622,983 to Matthews; U.S. Pat. No. 4,941,485 to Perfetti et al.; U.S. Pat. No. 4,998,541 to Perfetti et al.; and PCT WO 01/08514. Certain components, such as metal citrates, can act as ash conditioners or ash sealers. See, for example, European Pat. Application 1,084,630. Other representative components include organic and inorganic acids, such as malic, levulinic, boric and lactic acids. See, for example, U.S. Pat. No. 4,230,131 to Simon. Other representative components include catalytic materials. See, for example, U.S. Pat. No. 2,755,207 to Frankenburg. Typically, the amount of chemical additive does not exceed about 3 percent, often does not exceed about 2 percent, and usually does not exceed about 1 percent, based on the dry weight of the wrapping material to which the chemical additive is applied. For certain wrapping materials, the amount of certain additive salts, such as burn chemicals such as potassium citrate and monoammonium phosphate, preferably are in the range of about 0.5 to about 0.8 percent, based on the dry weight of the wrapping material to which those additive salts are applied. Relatively high levels of additive salts can be used on certain types of wrapping materials printed with printed regions that are very effective at causing extinction of cigarettes manufactured from those wrapping materials. Exemplary flax-containing cigarette paper wrapping materials having relatively high levels of chemical additives have been available as Grade Names 512, 525, 527, 540, 605 and 664 from Schweitzer-Mauduit International. Exemplary wood pulp-containing cigarette paper wrapping materials having relatively high levels of chemical additives have been available as Grade Names 406 and 419 from Schweitzer-Mauduit International.

Flavoring agents and/or flavor and aroma precursors (e.g., vanillin glucoside and/or ethyl vanillin glucoside) also can be incorporated into the paper wrapping material. See, for example, U.S. Pat. No. 4,804,002 to Herron; and U.S. Pat. No. 4,941,486 to Dube et al. Flavoring agents also can be printed onto cigarette papers. See, for example, the types of flavoring agents used in cigarette manufacture that are set forth in Gutcho, *Tobacco Flavoring Substances and Methods*, Noyes Data Corp. (1972) and Leffingwell et al., *Tobacco Flavoring for Smoking Products* (1972).

Films can be applied to the paper. See, for example, U.S. Pat. No. 4,889,145 to Adams; U.S. Pat. No. 5,060,675 to Milford et al., and PCT WO 02/43513 and PCT WO 02/055294. Catalytic materials can be incorporated into the paper. See, for example, PCT WO 02/435134.

Typical paper wrapping materials that can be used in carrying out the present invention are manufactured under specifications directed toward the production of a wrapping material having an overall generally consistent composition and physical parameters. For those types of wrapping materials, the composition and parameters thereof preferably are consistent when considered over regions of each of the major surfaces of those materials. However, typical wrapping materials tend to have a "two-sided" nature, and thus, there can be changes in the composition and certain physical parameters of those materials from one major surface to the other.

Though less preferred, the wrapping material can be manufactured using a paper making process adapted to provide a base web comprising multiple layers of cellulosic material. See, U.S. Pat. No. 5,143,098 to Rogers et al.

Much less preferred paper wrapping materials can have compositions and/or properties that differ over different regions of each of their major surfaces. The wrapping material can have regions of increased or decreased porosity provided by control of the composition of that material, such as by controlling the amount or type of the filler. The wrapping material can have regions of increased or decreased air permeability provided by embossing or perforating that material. See, for example, U.S. Pat. No. 4,945,932 to Mentzel et al. The wrapping material can have regions (e.g., pre-determined regions, such as bands) treated with additives, such as certain of the aforementioned salts.

For wrapping materials having compositions and/or properties that differ over regions of their major surfaces, alignment and registration of the printed bands with patterned regions of the wrapping materials offers manufacturing complications.

Paper wrapping materials suitable for use in carrying out the present invention are commercially available. Representative cigarette paper wrapping materials have been available as Ref. Nos. 419, 454, 456, 460 and 473 Ecusta Corp.; Ref. Nos. Velin 413, Velin 430, VE 825 C20, VE 825 C30, VE 825 C45, VE 826 C24, VE 826 C30 and 856 DL from Miquel; Tercig LK18, Tercig LK24, Tercig LK38, Tercig LK46 and Tercig LK60 from Tervakoski; Velin Beige 34, Velin Beige 46, Velin Beige 60, and Ref. Nos. 454 DL, 454 LV, 553 and 556 from Wattens; and as 38 CORESTA unit Printed Diagonal Lines, 46 CORESTA unit Printed Diagonal Lines, 60 CORESTA unit Printed Diagonal Lines, 38 CORESTA unit Longitudinal Verge Lines, 46 CORESTA unit Longitudinal Verge Lines, 60 CORESTA unit Longitudinal Verge Lines, 46 CORESTA unit Beige Velin and 60 CORESTA unit Beige Velin from Trierenberg Holding. Exemplary flax-containing cigarette paper wrapping materials have been available as Grade Names 105, 114, 116, 119, 170, 178, 514, 523, 536, 520, 550, 557, 584, 595, 603, 609, 615 and 668 from Schweitzer-Mauduit International. Exemplary wood pulp-containing cigarette paper wrapping materials have been available as Grade Names 404, 416, 422, 453, 454, 456, 465, 466 and 468 from Schweitzer-Mauduit International.

The number of layers of coatings that are applied to the wrapping material can vary. One coating layer can be applied to either or both sides of the paper. More than one coating layer can be applied to either or both sides of the paper. For wrapping materials intended to be used for the manufacture of cigarettes designed to meet certain cigarette extinction test criteria, it often is desirable to apply at least two layers, and most preferably at least three layers, of printing formulation to those wrapping materials.

The composition of the coating formulation can vary. Generally, the composition of the coating is determined by the ingredients of the coating formulation. Preferably, the coating formulation has an overall composition, and is applied in a manner and in an amount, such that the physical integrity of the wrapping material is not adversely affected when individual layers of coating formulation are applied to the wrapping material. It also is desirable that components of the coating formulation not introduce undesirable sensory characteristics to the smoke generated by a smoke article incorporating a wrapping material treated with that coating formulation. Thus, suitable combinations of various components can act to reduce the effect of coatings on sensory characteristics of smoke generated by the smoking article during use.

Examples of coating formulations are set forth in U.S. Pat. No. 4,889,145 to Adams; and U.S. Pat. No. 5,060,675 to Milford et al.; PCT WO 02/043513; PCT WO 02/055294; and European Pat. Application 1,234,514. Other coating formulations are described herein.

The coating formulation most preferably includes a film-forming agent. The film-forming agent most preferably is a polymeric material or resin. Exemplary film-forming agents include alginates (e.g., sodium alginate or ammonium alginate, including those alginates available as Kelcosol from Kelco), pectins (e.g., including those available as TIC Pretested HM from TIC Gums), derivatives of cellulose (e.g., nitrocellulose, hydroxy ethylcellulose, ethylcellulose, carboxymethylcellulose and cellulose acetate propionate), ethylene vinyl acetate copolymers, guar gum (e.g., including Type M, Type MM, Type MM high viscosity from Frutarom; and Ticagel from TIC Gums), xanthan gum (e.g., including Keltrol from Kelco), starch (e.g., corn starch or rice starch), modified starch (e.g., dextrin, oxidized tapioca starch and oxidized corn starch), polyvinyl acetate and polyvinyl alcohol. Exemplary film-forming agents are available as Klucel hydroxypropylcellulose HPC, Aqualon sodium carboxymethylcellulose CMC, Natrosol hydroxyethylcellulose HEC and Aqualon ethylcellulose EC from Hercules Incorporated; and Walocel nitrocellulose and Walsroder nitrocellulose from Bayer AG. Suitable combinations of various film-forming agents also can be employed. Exemplary blends include blends of ethylene vinyl acetate copolymer and polyvinyl alcohol, blends of ethylcellulose and ethylene vinyl acetate copolymer, blends of nitrocellulose and ethylene vinyl acetate copolymer, and blends of ethylcellulose and nitrocellulose. The aforementioned blends of film-forming agents, most preferably those that have hydrophobic characters, are suitable for primary or first layer coatings for multi-layered coatings.

Starch-based materials optionally can be used to provide certain of the layers of multi-layers patterns. The type of starch-based material can vary. Exemplary starches include tapioca, waxy maize, corn, potato, wheat, rice, and sago starches. Modified starches also can be employed. Starch can be treated with acid to provide a thin boiling starch, treated with sodium hypochlorite to provide an oxidized starch, treated with acid and roasted to provide a dextrin, polymerized to provide a crosslinked specialty starch, or chemically substituted. Combinations of starches and modified starches can be employed; and as such, suitable coating formulations can incorporate at least two starch-based materials. Exemplary starch-based materials include materials characterized as being derived from tapioca starch, as being derived from waxy maize starch, and as being dextrins, See, for example, the trade booklet *Corn Starch*, Corn Industries Research Foundation, Inc. (1955). Typically, starches and/or modified starches are dispersed in water, and heated sufficiently to cause the starch-based material to undergo hydration. See, for example, the types of starch-based formulations set forth in U.S. patent application Ser. No. 10/645,996, filed Aug. 22, 2003, and European Patent Application EP 1234514, which are hereby incorporated by reference herein.

The solvent or liquid carrier for the coating formulation can vary. The solvent can be a liquid having an aqueous character, and can include relatively pure water. An aqueous liquid is a suitable solvent or carrier for film-forming agents such as water-based emulsions, starch-based materials, sodium carboxymethylcellulose, ammonium alginate, guar gum, xanthan gum, pectins, polyvinyl alcohol and hydroxyethylcellulose. Starch-based materials are film-forming agents that include starch or components derived from starch. The solvent also can be a non-aqueous solvent. A non-aqueous solvent is a suitable solvent for film-forming agents such as ethylcellulose, nitrocellulose, polyvinyl acetate and ethylene vinyl acetate copolymers. Exemplary non-aqueous solvents are organic liquids, such as ethanol, n-propyl alcohol, iso-propyl alcohol, ethyl acetate, n-propyl acetate, iso-propyl acetate, toluene, and the like. Mixtures of organic solvents can be employed. Mixtures of organic and aqueous liquids (e.g., mixtures of water and ethanol) also can be employed. Solvents that do not adversely affect the quality of the wrapping material (e.g., by causing swelling of the fibers of the wrapping material, by causing puckering of the wrapping material, or by causing wrinkling of the wrapping material) are particularly preferred. Hydrophobic non-aqueous solvents typically have less of a tendency to adversely affect the physical nature of the wrapping material than do aqueous solvents, and hence often are the preferred solvents for printing formulations that are applied directly to the surface of a wrapping material (e.g., as a first or bottom layer of a multi-layer pattern).

Generally, the selection of solvent depends upon the nature of the film-forming polymeric material, and the particular polymeric material that is selected readily dissolves (i.e., is soluble) or is highly dispersible in a highly preferred solvent. Although not all components of the coating formulation are soluble in the liquid carrier, it is most preferable that the film-forming polymeric material be soluble (or at least highly dispersible) in that liquid. By "soluble" in referring to the components of the coating formulation with respect to the liquid solvent is meant that the components for a thermodynamically stable mixture when combined with the solvent, have a significant ability to dissolve in that solvent, and do not form precipitates to any significant degree when present in that solvent.

Mixtures of non-aqueous solvents can be used, and those mixtures can vary. A representative mixture is a combination of iso-propyl alcohol and ethyl acetate (e.g., about 5 percent to about 25 percent, preferably about 15 percent to about 20 percent iso-propyl alcohol, and 75 percent to about 95 percent, preferably about 80 to about 85 percent ethyl acetate, by weight), which is a suitable solvent for film-forming agents such as ethylcellulose and nitrocellulose. Another representative mixture is a combination of n-propyl alcohol and n-propyl acetate (e.g., about 15 percent to about 25 percent n-propyl alcohol, and about 75 percent to about 85 percent n-propyl acetate, by weight), which is a suitable solvent for film-forming agents such as ethylcellulose and nitrocellulose. Another representative mixtures is toluene and n-propyl alcohol (e.g., about 90 percent to about 95 percent toluene, and about 5 percent to about 10 percent n-propyl alcohol, by weight), which is a suitable solvent mixtures for film-forming agents such as ethylene vinyl acetate copolymers. Another representative mixture is iso-propyl acetate and ethanol (e.g., about 5 percent to about 25 percent, preferably about 15 percent to about 20 percent ethanol, and about 75 percent to about 95 percent, preferably about 75 to about 80 percent iso-propyl acetate, by weight), which is a suitable solvent mixture for a film-forming agent such as ethylcellulose.

The coating formulation also can include a filler material. Exemplary filler materials can be the essentially water insoluble types of filler materials previous described. Preferred filler materials have a finely divided (e.g., particulate) form. Typical fillers are those that have particle sizes that are less than about 3 microns in diameter. Typical particle sizes of suitable fillers range from about 0.3 micron to 2 microns in diameter. The filler materials can have a variety of shapes. Exemplary filler materials are those that include inorganic materials including metal particles and filings, calcium carbonate (e.g., precipitated-type fillers, including those having a prismatic form), calcium phosphate, clays (e.g., attapulgite clay), talc, aluminum oxide, mica, magnesium oxide, calcium sulfate, magnesium carbonate, magnesium hydroxide, aluminum oxide and titanium dioxide. See, for example, the types of filler materials set forth in U.S. Pat. No. 5,878,753 to Peterson et al. Representative calcium carbonate fillers are those available as Albacar PCC, Albafil PCC, Albaglos PCC, Opacarb PCC, Jetcoat PCC and Calopake F PCC from Specialty Minerals, Inc. Prismatic forms of calcium carbonate are especially preferred. Exemplary filler materials also can include organic materials including starches, modified starches and flours (e.g., rice flour), particles of polyvinyl alcohol, particles of tobacco (e.g., tobacco dust), extracts of tobacco (e.g., spray dried tobacco extract), and other like materials. The filler material also can be fibrous cellulosic materials. See, for example, U.S. Pat. No. 5,417,228 to Baldwin et al. Although less preferred, alternate fillers can include carbon-based materials (e.g., graphite-type materials, carbon fiber materials and ceramics), metallic materials (e.g., particles of iron), and the like. The filler material can be a water soluble salt (e.g., an alkali metal chloride or citrate salt) when a non-aqueous solvent is used as the solvent for film-forming materials such as ethylcellulose and nitrocellulose.

The coating formulations can incorporate other ingredients in addition to the aforementioned coating materials. Those ingredients can be dispersed or suspended within the coating formulation. Those other ingredients can be employed in order to provide specific properties or characteristics to the wrapping material. Those ingredients can be preservatives (e.g., potassium sorbate), humectants (e.g., ethylene glycol and propylene glycol), pigments, dyes, burn promoters and enhancers, burn retardants and inhibitors, plasticers (e.g., dibutyl phthalate, polyethylene glycol, polypropylene glycol and triacetin), sizing agents, syrups (e.g., high fructose corn syrup), flavoring agents (e.g., ethyl vanillin and caryophyllene oxide), sugars (e.g., rhamnose), flavor precursors, hydrate materials, such as metal hydrates (e.g., borax, magnesium sulfate decahydrate, magnesium sulfate heptahydrate, sodium silicate pentahydrate and sodium sulfate decahydrate), viscosity reducing agents (e.g., urea), waxes, oils, tackifying resins, defoaming agents, acidic materials (e.g., inorganic acids, such as boric acid, and organic acids, such as citric acid), basic materials (e.g., alkali metal hydroxides), and the like. Certain of those ingredients are soluble in the solvent of the coating formulation (e.g., certain salts, acids and bases are soluble in solvents such as water). Certain of those ingredients are insoluble in the solvent of the coating formulation (e.g., particles of metallic materials are insoluble in most of the solvents used for coating formulations). Various types of suitable salts, including suitable water soluble salts, are set forth in U.S. Pat. No. 2,580,568 to Matthews; U.S. Pat. No. 4,461,311 to Matthews; U.S. Pat. No. 4,622,983 to Matthews; U.S. Pat. No. 4,941,485 to Perfetti et al.; U.S. Pat. 4,998,541 to Perfetti et al.; and PCT WO 01/08514.

Although not preferred, tobacco of some form can be incorporated into at least one of the coating formulations that are applied to the wrapping material. Finely divided tobacco (e.g., as milled tobacco stem or lamina, as finely ground pieces of extracted tobacco pulp) can be dispersed in a liquid carrier along with other components of the coating formulation for use as a coating formulation. Tobacco extracts, such as spray dried extracts, freeze dried extracts, supercritical fluid extracts and non-aqueous solvent extracts, also can be employed. Slurries of tobacco in liquid carriers also can be employed. Representative forms of tobacco, including tobacco extracts, are set forth in U.S. patent application Ser. No. 10/463,211, filed Jun. 17, 2003. If desired, other components of a coating formulation may be incorporated into a tobacco extract/solvent mixture (e.g., a mixture of water and a water-soluble tobacco extract) or a mixture of tobacco and solvent (e.g., an aqueous tobacco slurry) to form a coating formulation. One representative tobacco-containing liquid formulation incorporates, for example, about 41 weight parts spray dried aqueous tobacco extract of tobacco stem and lamina, about 41 weight parts water, about 15 weight parts glycerin and about 3 weight parts of a tamarind gum. If desired, an appropriate further amount of an appropriate film-forming agent can be incorporated into such a formulation.

The coating formulation typically has a liquid form, and is applied to the wrapping material in a liquid form. Depending upon the actual ingredients that are combined with the solvent, the coating formulation has the form of a liquid, an emulsion (e.g., a water-based emulsion), or a liquid having solid materials dispersed therein. Generally, the film-forming agent is dissolved or dispersed in a suitable solvent to form the coating formulation. Certain other optional ingredients also are dissolved, dispersed or suspended in that formulation. Additionally, optional filler material also is dispersed within that formulation. Preferably, the filler material is essentially insoluble and essentially chemically non-reactive with the solvent, at least at those conditions at which the formulation is employed.

The relative amounts of the various components of the coating formulation can vary. Typically, the coating formulation includes at least about 30 percent solvent, usually at least about 40 percent solvent, and often at least about 50 percent solvent, based on the total weight of that formulation. Typically, the amount of solvent within the coating formulation does not exceed about 99 percent, usually does not exceed about 95 percent, and often does not exceed about 90 percent, based on the total weight of that formulation. Most preferably, the coating formulation includes at least about 0.5 percent film-forming agent, usually at least about 1 percent film-forming agent, and often at least about 2 percent film-forming agent, based on the total weight of that formulation. Typically, the amount of film-forming agent within the coating formulation does not exceed about 30 percent, usually does not exceed about 20 percent, and often does not exceed about 10 percent, based on the total weight of that formulation. Typically, the coating formulation includes at least about 3 percent of the optional filler material, usually at least about 5 percent filler material, and often at least about 10 percent filler material, based on the total weight of that formulation. Typically, the amount of optional filler material within the coating formulation does not exceed about 35 percent, usually does not exceed about 30 percent, and often does not exceed about 25 percent, based on the total weight of that formulation.

The amounts of other optional components of the coating formulation can vary. The amount of plasticizer often ranges from about 0.5 percent to about 5 percent, preferably about 2 to about 3 percent, based on the total weight of the formulation. The amount of humectant often ranges from about 1 percent to about 5 percent, preferably about 2 to about 3 percent, based on the total weight of the formulation. The amount of wetting agent often ranges from about 0.5 percent to about 2 percent, preferably about 0.8 to about 1 percent, based on the total weight of the formulation. The amount of preservative often ranges from about 0.01 percent to about 0.3 percent, preferably about 0.5 percent, based on the total weight of the formulation. The amount of burn chemical often ranges from about 1 percent to about 15 percent, preferably about 5 to about 10 percent, based on the total weight of the formulation. The amount of viscosity reducing agent often ranges from about 1 percent to about 10 percent, preferably about 2 percent to about 6 percent, based on the total weight of the formulation. The amount of metal hydrate often ranges from about 3 percent, usually at least about 5 percent, and often at least about 10 percent, based on the total weight of that formulation; but the amount of metal hydrate usually does not exceed about 35 percent, often does not exceed about 30 percent, and frequently does not exceed about 25 percent, based on the total weight of that formulation.

Other components of coating formulation can include those materials that allow for the use of automated equipment to ensure proper registry or alignment of the various layers of the coating. Optical brighteners provide the ability to accurately and precisely identify the locations of printed layers, and hence allow for proper alignment and registry of various printed layers. Those materials often are fluorescent materials that are referred to as optical brighteners. Exemplary optical brighteners include thiophenedyl benzoxazoles, such as those commercially available as Uvitex OB from Ciba Specialty Chemicals, and those optical brighteners available as Eccobrite RB-6 and Eccowhiter AC-10 from Eastern Color & Chemical Co. The amount of optical brightener employed is an amount sufficient to allow the various layers to be identified for registration, and that amount typically makes up a very small fraction of the printing formulation. Typically, the amount of optical brightener used comprises about 0.01 to about 0.2 weight percent of the printing formulation. Preferred optical brighteners are those that remain within the regions of the wrapping material to which they are applied, and particularly in those regions upon which electromagnetic detection systems that are used to control layer registry are focused. Preferred optical brighteners are those that do smear across or rub off of the wrapping material, at least prior to the time that the optical brightener is detected by the relevant electromagnetic detection system.

Flavoring agents can be incorporated into the printing formulations. The printing formulations incorporating flavoring agents can be applied over the whole surface of the wrapping material, over portions of the surface of the wrapping material, or as some or all of the layers of the printed bands. Preferably, the flavoring agents exhibit sensory characteristics that can be described as having notes that are sweet, woody, fruity, or some combination thereof. The flavoring agents preferably are employed in amounts that depend upon their individual detection thresholds. Typically, the flavoring agents are employed in sufficient amounts so as to mask or ameliorate the off-tastes and malodors associated with burning paper. Combinations of flavoring agents (e.g., a flavor package) can be employed in order to provide desired overall sensory characteristics to smoke generated from the smoking articles incorporating those flavoring agents. Most preferably, those flavoring agents are employed in amounts and manners so that the sensory characteristics of those flavoring agents are hardly detectable; and those flavoring agents do not adversely affect the overall sensory characteristics of smoking article into which they are incorporated. Preferred flavoring agents can be incorporated into printing formulations, have low vapor pressures, do not have a tendency to migrate or evaporate under normal ambient conditions, and are stable under the processing conditions experienced by wrapping materials of the present invention. Exemplary flavoring agents that provide sweet notes include ethyl vanillin, vanillin, inulin (a fructose oligomer), heliotropin, methylcyclopentenolone; and those flavoring agents typically are employed in amounts of 0.001 to about 0.01 percent, based on the total weight of the printing formulation into which they are incorporated. An exemplary flavoring agent that provides woody notes includes caryophyllene oxide; and that flavoring agent typically is employed in amounts of 0.2 to about 0.6 percent, based on the total weight of the printing formulation into which it is incorporated. Exemplary flavoring agents that provide fruity notes include ketones such as 4-hydroxphenyl-2-butanone and lactones such as gamma-dodecalactone; and those flavoring agents typically are employed in amounts of 0.001 to about 0.1 percent, based on the total weight of the printing formulation into which they are incorporated.

Exemplary coating formulations are available as C42626E5 and C42626E5A from American Inks & Coatings Corp. and as FSBMOH62 and FSBMOA7AP from Color Converting Industries.

Certain layers can be applied to the wrapping material in the form of a coating formulation that is in a so-called "solid polymer" form. That is, film-forming materials, such as ethylene vinyl acetate copolymers and certain starches, can be mixed with other components of the coating formation, and applied to the wrapping material without the necessity of dissolving those film-forming materials in a suitable solvent. Typically, solid polymer coating formulations are applied at elevated temperatures relative to ambient temperature; and the viscosities of the film-forming materials of those heated coating formulations typically are in the range of about 100 centipoises to about 10,000 centipoises, frequently about 1,000 centipoises to about 5,000 centipoises.

In most applications, it is desirable for the wrapping materials to have patterns applied thereto in a manner such that those patterns do not adversely affect the appearance of the cigarette manufactured using those wrapping materials. In certain applications, such as when patterns that are applied to white cigarette papers are provided from layers that are colorless or slightly colored in nature, those patterns can be visible to the smoker of cigarettes manufactured from those wrapping materials; even if the pattern is applied to the major surface of that wrapping material that provides the inside surface of the cigarette wrapping material (i.e., the surface that contacts the smokable filler). For this reason, certain components that provide whitening characteristics to those layers (and hence those patterns) can be incorporated into coating formulations. In one respect, fillers, such as calcium carbonate or titanium dioxide, can be incorporated into coating formulations to provide a white appearance to the layers provided by those coating formulations. Coating formulations also can incorporate components that cloud those formulations, and hence dry to yield opaque or hazy appearances. For example, a coating formulation incorporating a non-aqueous solvent that is not miscible in water (e.g., iso-propyl acetate) and a suitable film-forming polymeric material soluble in that solvent (e.g., ethylcellulose) can be provided with a white character (and hence rended less visible when applied to a white cigarette paper wrapping material, particularly when applied as a first or bottom layer of a multi-layered pattern) by incorporating a small amount of water (e.g., about 2 percent, based on the weight of the solvent of that coating formulation) into that coating formulation. One way to render printed patterns less visible on white cigarette paper wrapping materials involves employing a coating formulation incorporating a non-aqueous solvent that is not miscible with water (e.g., iso-propyl acetate), a suitable film-forming polymer (e.g., ethylcellulose) and either a ethylene vinyl acetate copolymer or a water-based emulsion incorporating ethylene vinyl acetate copolymer, particularly when that coating formulation is applied as a first or bottom layer of a multi-layered pattern. Typically, such a mixture incorporates about 10 percent to about 20 percent, preferably about 15 percent ethylene vinyl acetate copolymer, and about 80 percent to about 90 percent, preferably about 85 percent ethylcellulose, based on the total weight of those components.

Preferably, film-forming agents are polymeric materials of relatively low molecular weight, in order to ensure easy application thereof to the wrapping material. Preferred coating formulations employing solvents have viscosities such that those formulations can be efficiently and effectively applied to the wrapping materials. Typical coating formulations have viscosities of about 20 centipoises to about 10,000 centipoises, with about 20 centipoises to about 300 centipoises being preferred. See, for example, US Patent Application 2003/0136420 to Kraker, which is incorporated herein by reference.

Certain preferred coating formulations incorporate at least one non-aqueous solvent, a film-forming agent such as ethylcellulose, a filler such as calcium carbonate, a plasticizer such as triacetin, and a wetting agent such as lecithin. Such preferred formulations also can incorporate an optical brightener, such as a composition useful for allowing for the use of electromagnetic radiation to inspect the application of the formulation upon the wrapping material. For such preferred coating formulations, the amount of solvent often can comprise about 70 percent to about 85 percent of the formulation, based on the total weight of that formulation. A typical non-aqueous solvent is iso-propyl acetate.

For certain preferred coating formulations, the amount of film-forming agent relative to filler ranges from about 1.5:1 to about 1:3, preferably about 1:1 to about 1:2.5, on a dry weight basis. Thus, for example, certain preferred coating formulations can incorporate ethylcellulose and calcium carbonate in relative amounts of about 1:1 to about 1:2.5, on a dry weight basis. Typically, the weight of filler within a preferred coating formulation is greater than the weight of the film-forming agent within the formulation. For an exemplary coating formulation, the amount of filler (e.g., calcium carbonate) within that formulation ranges from about 5 percent to about 20 percent, based on the total weight of the formulation. For an exemplary preferred coating formulation, the amount of filler (e.g., calcium carbonate) within that formulation ranges from about 14 percent to about 18 percent, based on the total weight of the formulation.

The plasticizer can vary. Plasticizers can assist in controlling the viscosity of the coating formulation, in improving the ability of the coating formulation to flow in a desired manner, and in improving the ability of the coating formulation to form a good quality film on the wrapping material substrate. Exemplary plasticizers include triacetin, propylene glycol, and the like. See, for example, Flick, *Handbook of Adhesive Raw Materials*, p. 109-113, Noyes Publications (1982); and Dick, *Compounding Materials for the Polymer Industries*, p. 271-275, Noyes Publications (1987). For certain preferred coating formulations, the plasticizer comprises about 2 percent to about 3 percent of the total weight of the formulation.

The wetting agent can vary. Wetting agents assist in increasing the propensity of the various components of coating formulation to remain dispersed or suspended within that formulation. Wetting agents also assist in increasing the propensity of the wrapping material substrate to be receptive of the coating formulation. Wetting agents also assist in increasing the propensity of the coating formulation to form good quality film on the wrapping material substrate. An exemplary wetting agent is lecithin. See, for example, Flick, *Handbook of Adhesive Raw Materials*, p. 71-74 and p. 214-223, Noyes Publications (1982). For certain preferred coating formulations, the plasticizer comprises about 0.1 percent to about 1 percent of the total weight of the formulation.

The optical brightener can vary. Exemplary optical brighteners include those available as Uvitex OB from Ciba Specialty Chemicals, and the like. For certain preferred coating formulations, the optical brightener comprises about 0.005 percent to about 0.1 percent of the total weight of the formulation. Optical brighteners can be used to help ensure that patterns are properly located on wrapping material substrates, and that patterned layers are properly registered relative to one another. Such components, even when employed at very low levels, can facilitate the use of electronic detection equipment. For example, appropriate video viewing systems equipped with appropriate zoom lens and black strobe lights can be used to freeze images of printed bands at line typical speeds of wrapping materials during printing processes (e.g., at about 300 to about 800 feet per minute).

The amount of coating formulation that is applied to the paper wrapping material can vary. Typically, coating of the wrapping material provides a printed wrapping material having an overall dry basis weight (i.e., the basis weight of the whole wrapping material, including coated and uncoated regions) of at least about 1.05 times, often at least about 1.1 times, and frequently at least about 1.2 times, that of the dry basis weight of that wrapping material prior to the application of coating thereto. Typically, coating of the wrapping material provides a printed paper having an overall dry basis weight of not more about 1.4 times, and often not more than about 1.3 times, that of the dry basis weight of the wrapping material that has the coating applied thereto. Typical overall dry basis weights of those wrapping materials are about 20 $g/m^2$ to about 40 $g/m^2$; preferably about 25 $g/m^2$ to about 35 $g/m^2$. For example, a paper wrapping material having a dry basis weight of about 25 $g/m^2$ can be coated in accordance with the present invention to have a resulting overall dry basis weight of about 26.5 $g/m^2$ to about 35 $g/m^2$, and often about 28 $g/m^2$ to about 32 $g/m^2$.

The dry weights of the printed regions of wrapping material of the present invention can vary. For wrapping materials that are used for the manufacture of cigarettes designed to meet certain cigarette extinction test criteria, it is desirable that the wrapping materials have sufficient coating formulation applied thereto to in the form of appropriately shaped and spaced bands in order that the dry weight of printed material applied to those wrapping materials totals at least about 3 pounds/ream, often at least about 4 pounds/ream, and sometimes at least about 6 pounds/ream; while the total dry weight of that printed material normally does not exceed about 10 pounds/ream. For those types of wrapping materials possessing multi-layered bands, the dry weight of individual layers of printed material applied to those wrapping materials is at least about 0.25 pounds/ream to about 0.5 pounds/ream, or more.

Typical coated regions of paper wrapping materials of the present invention that are suitable for use as the circumscribing wrappers of tobacco rods for cigarettes have inherent porosities that can vary. Typically, the inherent porosities of the coated regions of the wrapping materials are less than about 8.5 CORESTA units, usually are less than about 8 CORESTA units, often are less than about 7 CORESTA units, and frequently are less than about 6 CORESTA units. Typically, the inherent porosities of the coated regions of the wrapping materials are at least about 0.1 CORESTA unit, usually are at least about 0.5 CORESTA unit, often are at least about 1 CORESTA unit. Preferably, the inherent porosities of the coated regions of the wrapping materials, particularly those wrapping materials that are used for the manufacture of cigarettes designed to meet certain cigarette extinction test criteria, are between about 0.1 CORESTA unit and about 4 CORESTA units.

Preferably, the wrapping materials of the present invention are used for the manufacture of tobacco rods without further chemical or physical treatment. However, although not preferred, those materials can be subjected to further processing. Those wrapping materials can be perforated (e.g., using electrostatic perforation techniques) or embossed. Examples of printed wrapping materials are designated as Ref. No. 749 by Ecusta, which is a printed paper (e.g., printed with layers of a coating formulation incorporating ethylcellulose and calcium carbonate) having a base paper inherent porosity of about 46 CORESTA units, which is electrostatically perforated to a net porosity of about 115 CORESTA units; and Ref. No. 879 by Ecusta Corp., which is a printed paper (e.g., printed with layers of a coating formulation incorporating ethylcellulose and calcium carbonate) having a base paper inherent porosity of about 33 CORESTA units, which is electrostatically performated to a net porosity of about 75 CORESTA units. Perforation of the wrapping material can be carried out over the entire major surface of the wrapping material, or solely over the unprinted regions of that wrapping material. Additionally, those wrapping materials can have further additives applied thereto (e.g., water soluble salts can be applied as an aqueous solution using a size press, particularly for wrapping materials that possess films formed from film-forming agents such as ethylcellulose).

The paper wrapping material of the present invention can have can be coated in patterns having predetermined shapes. The coating can have the form of bands, cross directional lines or bands (including those that are perpendicular to the longitudinal axis of the wrapping material), stripes, grids, longitudinally extending lines, circles, hollow circles, dots, ovals, checks, spirals, swirls, helical bands, diagonally crossing lines or bands, triangles, hexagonals, honeycombs, ladder-type shapes, zig zag shaped stripes or bands, sinusoidal shaped stripes or bands, square wave shaped stripes or bands, patterns including printed regions that are generally "C" or "U" shaped, patterns including printed regions that are generally "E" shaped, patterns including printed regions that are generally "S" shaped, patterns including printed regions that are generally "T" shaped, patterns including printed regions that are generally "V" shaped, patterns including printed regions that are generally "W" shaped, patterns including printed regions that are generally "X" shaped, patterns including printed regions that are generally "Z" shaped, or other desired shapes. Combinations of the foregoing shapes also can used to provide the printing pattern. Printing patterns incorporating certain of the foregoing shapes can be employed as the discontinuous layers of certain multi-layered printed patterns, such as multi-layered bands.

The relative sizes or dimensions of the various shapes and designs can be selected as desired. For example, shapes of coated regions, compositions of the coating formulations, or amounts or concentrations of coating materials, can change over the length of the wrapping material. The relative positioning of the printed regions can be selected as desired. For example, wrapping materials that are used for the production of cigarettes designed to meet certain cigarette extinction test criteria, the pattern most preferably has the form of spaced continuous bands that are aligned transversely or cross directionally to the longitudinal axis of the wrapping material. However, cigarettes can be manufactured from wrapping materials possessing discontinuous bands positioned in a spaced apart relationship. For wrapping materials of those cigarettes, it is most preferred that discontinuous bands (e.g., bands that include a pattern, such as a series of dots, grids or stripes) cover at least about 70 percent of the surface of the band area or region of the wrapping material.

Preferred wrapping materials possess coatings in the form of bands that extend across the wrapping material, generally perpendicular to the longitudinal axis of the wrapping material. The widths of the individual bands can vary, as well as the spacings between those bands. Typically, those bands have widths of at least about 0.5 mm, usually at least about 1 mm, frequently at least about 2 mm, and most preferably at least about 3 mm. Typically, those bands have widths of up to about 8 mm, usually up to about 7 mm. Preferred bands have widths of about 4 mm to about 7 mm. Such bands can be spaced apart such that the spacing between the bands is at least about 10 mm; often at least about 15 mm, frequently at least about 20 mm, often at least about 25 mm, in certain instances at least about 30 mm, and on occasion at least about 35 mm; but such spacing usually does not exceed about 50 mm. For certain preferred wrapping materials, the bands are spaced apart such that the spacing between the bands is between about 15 mm and about 25 mm.

Cigarettes of the present invention can possess certain appropriately treated wrapping materials of the present invention. The wrapping material can possess patterns of predetermined shapes and sizes positioned at predetermined locations, and hence, cigarettes appropriately manufactured from that wrapping material can possess patterns of predetermined shapes and sizes positioned at predetermined locations on their smokable rods. The wrapping material can possess patterns of predetermined composition positioned at predetermined locations, and hence, cigarettes appropriately manufactured from that wrapping material can possess patterns of predetermined composition positioned at predetermined locations on their smokable rods. The foregoing types of patterns can introduce certain properties or behaviors to specific regions of those smokable rods (e.g., the patterns can provide specific regions of increased weight, decreased permeability and/or increased burn retardant composition to wrapping material). For example, a wrapping material that possesses bands that surround the column of smokable material of the smokable rod and that decrease the permeability of the wrapping material (e.g., the wrapping material can have bands applied thereto and the bands can be positioned thereon) can be such that each acceptable smokable rod manufactured from that wrapping material can possess at least two identical bands on the wrapping material surrounding the tobacco column, and the spacing between the bands, measured from the inside adjacent edges of the bands, is no less than 15 mm and no greater than 25 mm.

Preferred wrapping materials possessing coatings in the form of bands have those coatings applied in a layered form. That is, a layer of coating is applied to the major surface of the wrapping material, and successive layers are applied to the wrapping material over all or part of each successive layer. The composition of each layer can be the same, or the compositions of the various layers can be different from one another. In certain circumstances, a hydrophobic coating is applied as the first layer to the major surface of the wrapping material; either as a band layer, a coated region, or as a layer that fully covers the surface of the wrapping material. As such, a first coating is deposited directly onto the substrate, and that coating can be effective to reduce the water absorption capabilities of that substrate.

Certain preferred wrapping materials possessing coatings in the form of layered bands possess band layers that are of virtually identical width. Representative preferred wrapping materials are coated with patterned coatings that can have multiple layers numbering 2, 3 or 4 layers. For example, for a wrapping material intended to possess a series of spaced bands (e.g., each band having a width of about 7 mm), and intended to have each band provided by three layers of coating formulation, it is desirable that each of the band layers be about 7 mm in width, and that each layer overlying the layer below virtually totally cover that layer below. As a result, each such multi-layer band having a pre-determined nominal width (e.g., about 7 mm) possesses an actual width that very closely (if not exactly) approximates that nominal width, due to well controlled positioning of the various layers of equal width precisely over the layers below. However, due to processing variables, slightly imprecise positioning of layers of equal width upon one another can cause the actual width of such a multi-layered band to be slightly greater than its nominal width.

There are several factors that determine a specific coating pattern for a wrapping material of the present invention. It is desirable that the components of the coating formulations applied to wrapping materials not adversely affect to any significant degree (i) the appearance of cigarettes manufactured from those wrapping materials, (ii) the nature or quality of the smoke generated by those cigarettes, (iii) the desirable burn characteristics of those cigarettes, or (iv) the desirable performance characteristics of those cigarettes. It also is desirable that wrapping materials having coating formulations applied thereto not introduce undesirable off-taste, or otherwise adversely affect the sensory characteristics of the smoke generated by cigarettes manufactured using those wrapping materials. In addition, preferred cigarettes of the present invention do not have a tendency to undergo premature extinction, such as when lit cigarettes are held in the smoker's hand or when placed in an ashtray for a brief period of time.

Cigarettes designed to meet certain cigarette extinction test criteria can be produced from wrapping materials of the present invention. Banded regions on a wrapping material are produced using film-forming materials that are effective in reducing the inherent porosity of the wrapping material in those regions. Film-forming materials and fillers applied to the wrapping material in those banded regions are effective in increasing the weight of the wrapping material in those regions. Filler materials that are applied to the wrapping material in those banded regions are effective in decreasing the burn rate of the wrapping materials in those regions. Typically, when wrapping materials of relatively high inherent porosity are used to manufacture cigarettes, those wrapping materials possess relatively high weight bands that introduce a relatively low inherent porosity to the banded regions. Film-forming materials have a tendency to reduce the porosity of the wrapping material, whether or not those materials are used in conjunction with fillers. However, coatings that combine porosity reduction with added coating weight to wrapping materials also are effective in facilitating extinction of cigarettes manufactured from those wrapping materials. Low porosity in selected regions of a wrapping material tends to cause a lit cigarette to extinguish due to the decrease in access to oxygen for combustion for the smokable material within that wrapping material. Increased weight of the wrapping material also tends to cause lit cigarette incorporating that wrapping material to extinguish.

For certain cigarette paper wrapping materials printed with bands, it often is desirable to provide bands which include (i) about 4 layers or more when the inherent porosity of the wrapping material is greater than about 60 CORESTA units, (ii) about 3 to about 4 layers when the inherent porosity of the wrapping material is between about 40 and about 60 CORESTA units, and (iii) about 2 to about 3 layers when the inherent porosity of the wrapping material is between about 15 and about 40 CORESTA units. Preferred wrapping materials having bands which include two layers typically have base sheet inherent porosities in the range of about 15 to about 30 CORESTA units; and preferred wrapping materials having bands which include three layers typically have base sheet inherent porosities in the range of about 20 to about 60 CORESTA units. For each of the foregoing, the ability to provide cigarettes that meet certain cigarette extinction test criteria can be enhanced by incorporating an effective amount of suitable filler into at least one of the layers that make up each band. That is, as the inherent porosity of the wrapping material increases, it also is desirable to (i) select a film-forming material so as to cause a decrease the inherent porosity of the coated region of the wrapping material and/or (ii) provide a coating that provides a relatively large amount of added weight to the coated region of the wrapping material.

Paper wrapping materials of the present invention are useful as components of smoking articles such as cigarettes. Preferably, one layer of the wrapping material of the present invention is used as the wrapping material circumscribing the smokable material, and thereby forming the tobacco rod of a cigarette. In one regard, it is preferable that the wrapping material possesses the printed regions located on the "wire" side thereof, and the "wire" side of that wrapping material forms the inner surface of the circumscribing wrapping material of the tobacco rod. In another regard, it is preferable that the wrapping material possesses the printed regions located on the "felt" side thereof, as coating on the "felt" side of that wrapping material provides for a relatively great decrease in the porosity of that wrapping material for a relatively small amount of coating. The terms "wire side" and "felt side" in referring to the major surfaces of paper sheet are readily understood as terms of art to those skilled in the art of paper manufacture.

Wrapping materials of the present invention can be produced in such a manner so as to avoid the occurrence of "blocking." That is, when a previously manufactured paper wrapping material is printed using an offline process with a coating, or layers of coatings, and the resulting printed wrapping material is rewound into a roll for later manufacture of cigarettes, the coated wrapping material can have a tendency to stick or adhere to itself when that wrapping material is rewound. As a result, when the roll of printed wrapping material is unwound, that material can readily break or exhibit erratic payout. Problems associated with blocking also can be exacerbated as a result of the use of (i) coatings that are sticky or tacky, (ii) coatings that are wet and applied during a high speed printing operation thus resulting is poor drying, and (iii) paper wrapping materials that are of relatively low tensile strengths, such as is the case of wrapping materials of relatively high inherent porosities. Wrapping materials of the present invention, that is, those that have coatings applied in the form of layers, can be suitably dried. Thus, the undesirable effects associated with blocking can be minimized, and preferably avoided; particularly when top layers having anti-blocking properties are dried quickly to consistencies that are non-tacky. Preferred film-forming materials for the top layers of multi-layered printed patterns include ethylcellulose, polyvinyl acetate, nitrocellulose, cellulose acetate propionate, polyvinyl alcohol, and ethylene vinyl acetate copolymers; of which ethylcellulose is most preferred. The top anti-blocking layers provided by certain types of film-forming materials can be used in conjunction with other layers of film-forming materials that are used to reduce the inherent porosity of the wrapping material and provide an increase in weight to the wrapping material.

The following examples are provided in order to further illustrate various aspects of the invention but should not be construed as limiting the scope thereof. Unless otherwise noted, all parts and percentages are by weight.

EXAMPLES

With reference to FIG. 4-22, there are shown various enlarged, cross-sectional views of cigarette paper wrapping materials that are examples representative of the present invention. Each exemplary wrapping material possesses a base sheet. A typical base sheet or base web includes a mixture of materials, such as cellulosic fiber and inorganic filler; and an exemplary base web can include materials such as wood pulp and calcium carbonate. An exemplary base sheet also can incorporate a small amounts (i.e., less than about 3 percent of the base web) of burn chemical, such as potassium citrate or potassium phosphate; but the base sheet also can be absent of added burn chemical.

At least a portion of the base sheet is coated with at least one coating formulation on at least one of its two major surfaces in predetermined regions, so as to provide wrapping material having a plurality of coating layers. The coatings are applied to either side, or both sides, of the wrapping material base sheet (e.g., to the "felt" side of the paper, to the "wire" side of the paper, or to both the felt and wire sides of the paper). The printed patterns for the various substrates normally have the form of series of recurring bands, and those bands preferably are printed in the form of various layers. Most preferably, the coatings are applied to the major surface known as the "wire" side of the paper. Most preferably, the bands are printed onto the base sheet using gravure printing techniques.

The exemplary embodiments of the present invention that are described with reference to FIG. 4-22 are illustrated in such a manner so that the various layers appear as a distinct series of layers, or as coatings having the form of discrete layers. In addition, the exemplary embodiments are illustrated in such a manner that the various layers have distinct edges or corners. However, as a practical matter, the application of discrete layers does not necessarily result in a printed coating exhibiting the appearance of discrete layers, when viewed cross-sectionally. That is, the layers, though most preferably applied as discrete layers (e.g., as a coating resembling a laminate), do not necessarily maintain their identity as individual or independent layers. In particular, a coating formulation applied over a previously applied layer of printed material can undergo some mixing or commingling with that printed material, prior to the time that the coating formulation is dried after application. Thus, particularly for multi-layered patterns printed using several applications of the identical coating formulation, the resulting pattern may not resemble a laminated structure when viewed cross-sectionally. For example, the liquid form of a printing formulation can cause components of that formulation to soak into the wrapping material and layers upon which that formulation is applied, and removal of that solvent by evaporation can cause a change in shape of the coating formulation between the time of application and the time of drying. The thickness of a multi-layered band can vary, and the band can be very thin, as at least a portion of the coating can migrate into the wrapping material from the surface of the wrapping material to which the printing formulation is applied. Furthermore, the edges and corners of printed layers and patterns may have a "rounded" appearance due to factors such as "bleed out" that occur during conventional printing processes involving the printing of paper.

The exemplary embodiments of the present invention that are described with reference to FIG. 4-22 are illustrated in such a manner that the various bands are symmetrical about a cross-sectional axis of the wrapping material. Additionally, the bands are equally spaced from one another. This provides the ability for the wrapping material so provided to be used to manufacture cigarettes in such a manner that the wrapping material can be produce nearly identical smokable rods that can be burned in either direction along the longitudinal axis of that wrapping material.

The exemplary embodiments of the coated wrapping materials of the present invention that are described with reference to FIG. 4-22 are illustrated in such a manner so that the various layers can be positioned on the inside region of a tobacco rod of a cigarette manufactured from those wrapping materials, or less preferably, on the outside region of a tobacco rod of a cigarette manufactured from those wrapping materials.

Example 1

Figure 4:
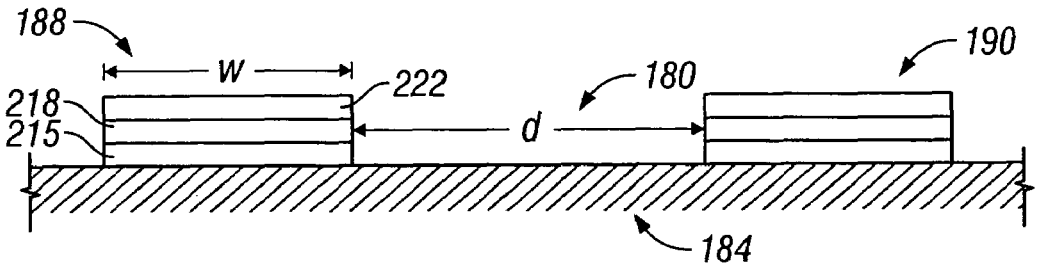
FIG. 4-22 are enlarged, cross-sectional side views of cigarette wrapping materials showing multi-layer coatings applied to the major surfaces of base sheets as bands that are longitudinally-spaced and extend transversely to the longitudinal axes of those materials.

Referring to FIG. 4, a printed paper wrapping material 180 has a paper base sheet 184 that possesses a printed a pattern having the form of a series of recurring bands, two of which are shown as bands 188, 190. The paper wrapping material has a dry basis weight of about 25 g/m$^2$, a porosity of about 38 CORESTA units, and is available as Tercig LK38 from Tervakoski. The bands 208, 210 both have maximum widths of about 4 mm. The width of each band is illustrated as width w. The bands are positioned at predetermined intervals, such that the spacing between each of the respective bands, as measured as the space separating each band, is about 20 mm. That spacing is illustrated as distance d. The bands are printed onto the base sheet as a plurality of continuous layers, and for the embodiment shown, there are three layers, 215, 218 and 222. The printing pattern of each layer is virtually the same, the layers are registered so that each successive layer directly and completely overlies the layer directly below, the formulation used to print each layer is virtually the same, and the amount of formulation used to print each layer is virtually the same. The layers are printed using rotogravure printing techniques, and the printed layers are aligned or registered using ultraviolet absorption calibration techniques.

The first or bottom layer 215 of printing formulation is printed onto the base web 184. That formulation includes about 20 parts calcium carbonate particles, about 7 parts nitrocellulose, about 2 parts triacetin, about 0.5 parts of a lecithin wetting agent, and about 0.02 parts of an optical brightener available as Uvitex OB from Ciba Specialty Chemicals, and at least about 70 parts isopropyl acetate solvent (which is sufficient to total the number of parts of the formulation to 100). The calcium carbonate is available as Albaglos PCC from Specialty Minerals, Inc. The nitrocellulose is available as Walocel nitrocellulose E 360 from Bayer AG.

Printed onto the first layer 215 is a second layer 218 which includes the same formulation, and the second layer is printed in virtually the same manner as the first layer. Printed onto the second layer 218 is a third layer 222 which includes the same formulation, and the third layer is printed in virtually the same manner as the first and second layers.

When the printed wrapping material is slit into a web of 27 mm width, that web possesses a plurality of spaced bands, each band being about 4 mm in width and about 27 mm across. The dry weight of each band is about 1.5 mg (i.e., the weight provided to the base sheet in the each printed region is about 1.5 mg). The amount of dry weight provided by each layer of each band is about 0.5 mg.

The wrapping material so provided represents a base sheet having a series of essentially equally spaced multi-layered bands of essentially equal width and dimension. Each band is continuous in nature, and each layer of each band is continuous. The width of each successive layer of each band is approximately equal to that of the layer beneath that layer, and the wrapping material is designed such that each successive layer directly and completely covers the layer beneath that layer. That wrapping material represents a base sheet having multi-layered application of polymeric film-forming agent that is soluble in a non-aqueous solvent, and is employed within a formulation that also includes particles of filler. That wrapping material represents a base sheet printed with a multi-layered pattern, wherein each layer incorporates the same polymeric film-forming material.

Example 2

Referring to FIG. 4, a printed wrapping material 184 is provided in the manner set forth in Example 1, and using the materials set forth in Example 1; except that the top or third layer of each band includes a different printing formulation, and the base sheet is paper wrapping material having a dry basis weight of about 25 g/m$^2$, a porosity of about 24 CORESTA units, and is available as Tercig LK24 from Tervakoski.

The printing formulation for the third or top layer of each band includes about 11 parts ethylcellulose, about 2 parts triacetin, about 0.5 parts of a lecithin wetting agent, and about 0.02 parts of an optical brightener available as Uvitex OB from Ciba Specialty Chemicals, and at least about 86 parts iso-propyl acetate solvent (which is sufficient to total the number of parts of the formulation to 100). The ethylcellulose is available as Aqualon N-7 from Hercules Incorporated.

When the printed wrapping material is slit into a web of 27 mm width, that web possesses a plurality of spaced bands, each band being about 4 mm in width and about 27 mm across. The dry weight of each band is about 1.5 mg. The amount of dry weight provided by each layer of the first two layers of each band is about 0.6 mg; and the amount of dry weight provided by the top layer is about 0.3 mg.

The wrapping material so provided represents a base sheet having a series of essentially equally spaced multi-layered bands of essentially equal width and dimension. Each band is continuous in nature, and each layer of each band is continuous. Each band possesses two layers incorporating nitrocellulose and filler, and a top layer incorporating a hydrophobic, polymeric film-forming material (e.g., ethylcellulose). The wrapping material is representative of a coating pattern having two or more layers, and not all of those layers incorporate the same polymeric film-forming materials.

Example 3

Referring to FIG. 4, a printed wrapping material 184 is provided in the manner set forth in Example 2; except that the base sheet is paper wrapping material having a dry basis weight of about 25 g/m$^2$, a porosity of about 18 CORESTA units, and is available as Tercig LK18 from Tervakoski.

Example 4

Referring to FIG. 4, a printed wrapping material 184 is provided in the manner set forth in Example 1, and using the base sheet set forth in Example 1; except each band has a maximum width of about 6 mm, and the printed bands are provided using a different printing formulation.

The printing formulation for each layer of each band includes about 16 parts calcium carbonate particles, about 8 parts ethylcellulose, about 2 parts triacetin, about 0.5 parts of a lecithin wetting agent, and about 0.02 parts of an optical brightener available as Uvitex OB from Ciba Specialty Chemicals, and at least about 74 parts iso-propyl acetate solvent (which is sufficient to total the number of parts of the formulation to 100). The calcium carbonate is available as Albaglos PCC from Specialty Minerals, Inc. The ethylcellulose is available as Aqualon N-7 from Hercules Incorporated.

When the printed wrapping material is slit into a web of 27 mm width, that web possesses a plurality of spaced bands, each band being about 6 mm in width and about 27 mm across. The dry weight of each band is about 1.5 mg. The amount of dry weight provided by each layer of each band is about 0.5 mg.

The wrapping material so provided represents a base sheet having a series of essentially equally spaced multi-layered bands of essentially equal width and dimension. Each band is continuous in nature, and each layer of each band is continuous. The width of each successive layer of each band is approximately equal to that of the layer beneath that layer, and the wrapping material is designed such that each successive layer directly and completely covers the layer beneath that layer. The dry weight of each layer is in the range of about 0.4 mg to about 0.6 mg. In addition, that wrapping material represents a base sheet having multi-layered application of ethylcellulose; and in particular, the multi-layered application of a coating formulation incorporating both ethylcellulose and filler (e.g., particles of calcium carbonate).

Example 5

Referring to FIG. 4, a printed wrapping material 184 is provided in the manner set forth in Example 1, and using the base sheet set forth in Example 1; except each band has a maximum width of about 6 mm, and the printed bands are provided using a different printing formulation.

The printing formulation for the first or bottom layer of each band is that nitrocellulose/calcium carbonate-containing printing formulation described in Example 1, and the printing formulation for the second and third layers of each band is that ethylcellulose/calcium carbonate-containing printing formulation described in Example 4.

When the printed wrapping material is slit into a web of 27 mm width, that web possesses a plurality of spaced bands, each band being about 6 mm in width and about 27 mm across. The dry weight of each band is about 2 mg. The amount of dry weight provided by each layer of each band is about 0.5 mg.

The wrapping material so provided represents a base sheet having a series of essentially equally spaced multi-layered bands of essentially equal width and dimension. Each band is continuous in nature, and each layer of each band is continuous. Each band possesses a bottom layer incorporating nitrocellulose, and two further layers incorporating ethylcellulose. That is, the polymeric film-forming agent of the bottom layer is different from the polymeric film-forming agent of the other layers. The bands of that wrapping material so provided also are representative of bands which include layers incorporating filler, such as calcium carbonate.

Example 6

Referring to FIG. 4, a printed wrapping material is provided in the manner set forth in Example 1; except that the base sheet is that which is set forth in Example 2, each band has a maximum width of about 6 mm, and each layer of each band is provided using a different printing formulation.

The printing formulation for the first or bottom layer of each band is that nitrocellulose/calcium carbonate-containing printing formulation described in Example 1.

The printing formulation for the second layer of each band is that ethylcellulose/calcium carbonate-containing printing formulation described in Example 4.

The printing formulation for the third layer of each band is that ethylcellulose-containing printing formulation described in Example 2.

When the printed wrapping material is slit into a web of 27 mm width, that web possesses a plurality of spaced bands, each band being about 6 mm in width and about 27 mm across. The dry weight of each band is about 1.5 mg.

Example 7

Referring to FIG. 4, a printed wrapping material 184 is provided in the manner set forth in Example 1, and using the base sheet set forth in Example 1; except that the printed bands are provided using different printing formulations.

The printing formulation for the first or bottom layer of each band is that ethylcellulose/calcium carbonate-containing printing formulation described in Example 4.

The printing formulation of the second layer of each band incorporates a water-based coating that is employed in liquid form, and that coating is an adhesive formulation of R. J. Reynolds Tobacco Company used as a cigarette seam adhesive and designated as CS-1242. The CS-1242 formulation is a water emulsion-based adhesive consisting of about 87 to about 88 percent ethylene vinyl acetate copolymer emulsion sold under the designation Resyn 32-0272 by National Starch & Chemical Company, and about 12 to about 13 percent adhesive concentrate stabilizer of R. J. Reynolds Tobacco Company known as AC-9. The AC-9 adhesive concentrate stabilizer consists of about 92 percent water and about 8 percent polyvinyl alcohol resin available as Celvol 205 from Celanese Chemicals. The final printing formulation is comprised of about 95 parts of the water-based coating and about 5 parts of a mixture. That mixture is produced by the optical brightener, Uvitex OB from Ciba Specialty Chemicals, in absolute ethyl alcohol; such that the amount of optical brightener dispersed in the final printing formulation is about 0.02 parts.

The printing formulation for the third layer of each band is that ethylcellulose-containing printing formulation described previously in Example 2.

When the printed wrapping material is slit into a web of 27 mm width, that web possesses a plurality of spaced bands, each band being about 4 mm in width and about 27 mm across. The dry weight of each band is about 1 mg.

The wrapping material so provided represents a base sheet printed with patterned bands comprising layers of film-forming material and filler; and individual layers of those bands are provided from formulations incorporating non-aqueous solvents and individual layers of those bands are provided from formulations incorporating an aqueous solvent. The first or bottom coating is a hydrophobic material; and as such the weakening or wrinkling of the wrapping material that is associated with certain water-based coatings is avoided. The wrapping material so provided further represents a wrapping material having multi-layered bands, wherein the first and third layers incorporate ethylcellulose and the second layer incorporates ethylene vinyl acetate. The wrapping material so provided represents a material having a hydrophobic coating layer applied directly to that wrapping material; a second layer overlying the first coating layer and in the form of a coating resulting from a water-based emulsion, that second layer providing weight and reduced porosity to the wrapping material; and a top layer effective to prevent blocking. As such, multi-layered coatings are used to allow the use of certain water-based coatings for reducing porosity of wrapping materials in certain regions thereof, without affecting the physical integrity of the wrapping material to any significant degree.

Example 8

Referring to FIG. 4, a printed wrapping material 184 is provided in the manner set forth in Example 1, and using the base sheet set forth in Example 1; except that the printed bands are provided using different printing formulations.

The printing formulation for the first or bottom layer of each band is that ethylcellulose/calcium carbonate-containing printing formulation described in Example 4.

The printing formulation of the second layer is that water-based printing formulation described in Example 7.

The printing formulation for the third layer of each band includes about 8 parts polyvinyl alcohol resin available as Celvol 205 from Celanese Chemicals, about 87 parts water, and about 5 parts of a mixture. That mixture is produced by the optical brightener, Uvitex OB from Ciba Specialty Chemicals, in absolute ethyl alcohol; such that the amount of optical brightener dispersed in the final printing formulation is about 0.02 parts.

When the printed wrapping material is slit into a web of 27 mm width, that web possesses a plurality of spaced bands, each band being about 4 mm in width and about 27 mm across. The dry weight of each band is about 1.5 mg.

The wrapping material so provided represents a base sheet printed with patterned bands comprising layers of film-forming material, and each layer is includes materials of different composition. The wrapping material so provided also is representative of a wrapping material having multi-layered bands having a water-based film-forming material (i.e., a film-forming material applied within an aqueous solvent) as the top layer of each band. The wrapping material so provided also is representative of a wrapping material having layers of film-forming material, and at least one of those layers possesses a film-forming material that which includes primarily, or consists essentially of, polyvinyl alcohol.

Example 9

Referring to FIG. 4, a printed wrapping material 184 is provided in the manner set forth in Example 1, and using the base sheet set forth in Example 1; except that the printed bands are provided using different printing formulations The printing formulation for the first or bottom layer is that printing ethylcellulose/calcium carbonate-containing formulation described in Example 4.

The printing formulation of the second layer is that water-based printing formulation described in Example 7.

The third layer is printed with a polyvinyl alcohol-based printing formulation. That printing formulation includes about 8 parts polyvinyl alcohol resin available as Celvol 205 from Celanese Chemicals, about 10 parts calcium carbonate, about 77 parts water, and about 5 parts of a mixture. That mixture is produced by the optical brightener, Uvitex OB from Ciba Specialty Chemicals, in absolute ethyl alcohol; such that the amount of optical brightener dispersed in the final printing formulation is about 0.02 parts.

When the printed wrapping material is slit into a web of 27 mm width, that web possesses a plurality of spaced bands, each band being about 4 mm in width and about 27 mm across. The dry weight of each band is about 1.5 mg.

The wrapping material so provided represents a base sheet printed with patterned bands comprising layers of film-forming material and filler; and at least one individual layer of each band is provided from a formulation incorporating an aqueous solvent, a water soluble film-forming material and filler.

Example 10

Figure 5:
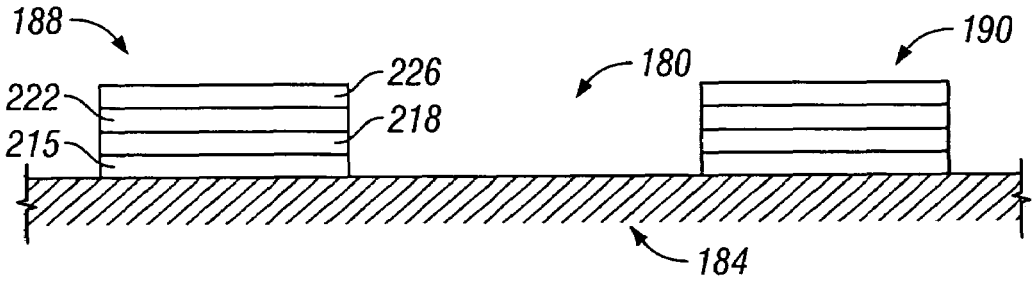

Referring to FIG. 5, a printed paper wrapping material 180 has a paper base sheet 184 that possesses a printed a pattern having the form of a series of recurring bands, two of which are shown as bands 188, 190. The paper wrapping material is available as Tercig LK60 from Tervakoski. The bands 208, 210 each have maximum widths of about 6 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are four layers, 215, 218, 222 and 226. The printing pattern of each layer is virtually the same, the layers are registered so that each successive layer directly and completely overlies the layer directly below, the formulation used to print each layer is virtually the same, and the amount of formulation used to print each layer is virtually the same. The four layers are printed as ethylcellulose/calcium carbonate-containing formulations described previously in Example 4, and in the manner generally described previously in Example 4.

When the printed wrapping material is slit into a web of 27 mm width, that web possesses a plurality of spaced bands, each band being about 6 mm in width and about 27 mm across. The dry weight of each band is about 2 mg.

Example 11

Referring to FIG. 5, a printed paper wrapping material 180 has a paper base sheet 184 that possesses a printed a pattern having the form of a series of recurring bands, two of which are shown as bands 188, 190. The paper wrapping material is available as Tercig LK46 from Tervakoski. The bands 208, 210 each have maximum widths of about 4 mm. The bands are positioned at predetermined intervals, such that the spacing between each of the respective bands, as measured as the space separating each band, is about 30 mm. The bands each are printed onto the base sheet as a plurality of continuous layers, and for the embodiment shown, there are four layers, 215, 218, 222 and 226. The layers are registered so that each successive layer directly and completely overlies the layer directly below.

The first or bottom layer is printed using the nitrocellulose/calcium carbonate-containing printing formulation described previously in Example 1. The second layer is printed using the water-based printing formulation described previously in Example 7, in the manner generally described previously in Example 7. The third layer is printed with a water-based, polyvinyl alcohol-containing printing formulation described previously in Example 8. The top or fourth layer is printed with the ethylcellulose-containing printing formulation described previously in Example 2.

When the printed wrapping material is slit into a web of 27 mm width, that web possesses a plurality of spaced bands, each band being about 4 mm in width and about 27 mm across. The dry weight of each band is about 2 mg.

The wrapping material so provided represents a base sheet printed with patterned bands, each band comprising four layers, and the printing formulation used to provide each layer is different in composition.

Example 12

Referring to FIG. 5, a printed paper wrapping material 180 has a paper base sheet 184 that possesses a printed a pattern having the form of a series of recurring bands, two of which are shown as bands 188, 190. The paper wrapping material is described in Example 11. The bands 208, 210 each have maximum widths of about 6 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are four layers, 215, 218, 222 and 226. The layers are registered so that each successive layer directly and completely overlies the layer directly below.

The first or bottom layer is printed using the nitrocellulose/calcium carbonate-containing printing formulation described previously in Example 1. The second layer is printed using a water-based printing formulation. That printing formulation is provided by mixing about 5 parts sodium chloride with about 95 parts of the printing formulation described previously in Example 7. The third layer is printed with a polyvinyl alcohol-containing printing formulation described previously in Example 9. The top or fourth layer is printed with the ethylcellulose-containing printing formulation described previously in Example 2.

When the printed wrapping material is slit into a web of 27 mm width, that web possesses a plurality of spaced bands, each band being about 6 mm in width and about 27 mm across. The dry weight of each band is about 2 mg.

Example 13

Referring to FIG. 5, a printed paper wrapping material 180 has a paper base sheet 184 that possesses a printed a pattern having the form of a series of recurring bands, two of which are shown as bands 188, 190. The paper wrapping material is described in Example 1. The bands 208, 210 each have maximum widths of about 6 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are four layers, 215, 218, 222 and 226. The layers are registered so that each successive layer directly and completely overlies the layer directly below.

The first or bottom layer is printed using the nitrocellulose/calcium carbonate-containing printing formulation described previously in Example 1. The second layer is printed using a water-based printing formulation. That printing formulation is provided by mixing about 15 parts sodium chloride with about 85 parts of the printing formulation described previously in Example 7. The third layer is printed with a polyvinyl alcohol-containing printing formulation described previously in Example 8. The top or fourth layer is printed with the ethylcellulose-containing printing formulation described previously in Example 2.

When the printed wrapping material is slit into a web of 27 mm width, that web possesses a plurality of spaced bands, each band being about 6 mm in width and about 27 mm across. The dry weight of each band is about 2 mg.

Example 14

Referring to FIG. 5, a printed paper wrapping material 180 has a paper base sheet 184 that possesses a printed a pattern having the form of a series of recurring bands, two of which are shown as bands 188, 190. The paper wrapping material is described in Example 10. The bands 208, 210 each have maximum widths of about 6 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are four layers, 215, 218, 222 and 226. The layers are registered so that each successive layer directly and completely overlies the layer directly below.

The first or bottom layer is printed using the nitrocellulose/calcium carbonate-containing printing formulation described previously in Example 1. The second layer is printed using a water-based printing formulation described previously in Example 7. The third layer is printed with the polyvinyl alcohol/calcium carbonate-containing printing formulation described previously in Example 9. The top or fourth layer is printed with the ethylcellulose-containing printing formulation described previously in Example 2.

When the printed wrapping material is slit into a web of 27 mm width, that web possesses a plurality of spaced bands, each band being about 6 mm in width and about 27 mm across. The dry weight of each band is about 2 mg.

Example 15

Referring to FIG. 5, a printed paper wrapping material 180 has a paper base sheet 184 that possesses a printed a pattern having the form of a series of recurring bands, two of which are shown as bands 188, 190. The paper wrapping material is described in Example 11. The bands 208, 210 each have maximum widths of about 5 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are four layers, 215, 218, 222 and 226. The layers are registered so that each successive layer directly and completely overlies the layer directly below.

The first or bottom layer is printed using the nitrocellulose/calcium carbonate-containing printing formulation described previously in Example 1. The second layer is printed using the water-based printing formulation incorporating sodium chloride that is described previously in Example 12. The third layer is printed using the polyvinyl alcohol-containing printing formulation described previously in Example 8.

The top or fourth layer is printed with a starch-based printing formulation. That formulation includes about 27 parts calcium carbonate particles, about 11 percent sodium chloride, about 20 parts dextrin (available as Crystal Tex 626 from National Starch & Chemical), about 0.05 parts potassium sorbate, about 4 parts urea, about 3 parts propylene glycol, about 5 parts of a mixture and about 30 parts water (which is sufficient to total the number of parts of the formulation to 100). The calcium carbonate is available as Albaglos PCC from Specialty Minerals, Inc. The mixture is about 0.02 parts of an optical brightener available as Uvitex OB from Ciba Specialty Chemicals in absolute ethyl alcohol.

When the printed wrapping material is slit into a web of 27 mm width, that web possesses a plurality of spaced bands, each band being about 5 mm in width and about 27 mm across. The dry weight of band is about 3 mg.

The wrapping material so provided represents a base sheet printed with patterned bands comprising layers of film-forming material, and the bottom layer of each band includes a hydrophobic film-forming material. The wrapping material so provided also is representative of a wrapping material substrate having multi-layered bands each possessing three layers of film-forming material provided from printing formulations employing an aqueous solvent.

Example 16

Referring to FIG. 5, a printed paper wrapping material 180 has a paper base sheet 184 that possesses a printed a pattern having the form of a series of recurring bands, two of which are shown as bands 188, 190. The paper wrapping material is described in Example 10. The bands 208, 210 each have maximum widths of about 6 mm. The bands are positioned at predetermined intervals, such that the spacing between each of the respective bands, as measured as the space separating each band, is about 44 mm. The bands each are printed onto the base sheet as a plurality of continuous layers, and for the embodiment shown, there are four layers, 215, 218, 222 and 226. The layers are registered so that each successive layer directly and completely overlies the layer directly below.

The first or bottom layer is printed using the nitrocellulose-containing printing formulation. That formulation includes about 5 parts sodium citrate, about 14 parts nitrocellulose, about 2 parts triacetin, about 0.5 parts of a lecithin wetting agent, and about 0.02 parts of an optical brightener available as Uvitex OB from Ciba Specialty Chemicals, and at least about 78 parts n-propyl acetate solvent (which is sufficient to total the number of parts of the formulation to 100). The nitrocellulose is available as Walocel nitrocellulose E 360 from Bayer AG.

The second layer is printed using a water-based printing formulation described previously in Example 7. The third layer is printed with a polyvinyl alcohol/calcium carbonate-containing printing formulation described previously in Example 9. The top or fourth layer is printed with the ethylcellulose-containing printing formulation described previously in Example 4.

When the printed wrapping material is slit into a web of 27 mm width, that web possesses a plurality of spaced bands, each band being about 6 mm in width and about 27 mm across. The dry weight of each band is about 2 mg.

The wrapping material so provided is representative of a wrapping material having printed multi-layered bands, wherein at least one of the layers of each band is includes a mixture including a water soluble salt and film-forming material that is soluble in a non-aqueous solvent.

Example 17

Referring to FIG. 5, a printed paper wrapping material 180 has a paper base sheet 184 that possesses a printed a pattern having the form of a series of recurring bands, two of which are shown as bands 188, 190. The paper wrapping material is described in Example 10. The bands 208, 210 each have maximum widths of about 4 mm. The bands are positioned at predetermined intervals, such that the spacing between each of the respective bands, as measured as the space separating each band, is about 39 mm. The bands each are printed onto the base sheet as a plurality of continuous layers, and for the embodiment shown, there are four layers, 215, 218, 222 and 226. The layers are registered so that each successive layer directly and completely overlies the layer directly below.

The first or bottom layer is printed using the nitrocellulose-containing printing formulation. That formulation includes about 15 parts sodium citrate, about 14 parts nitrocellulose, about 2 parts triacetin, about 0.5 parts of a lecithin wetting agent, and about 0.02 parts of an optical brightener available as Uvitex OB from Ciba Specialty Chemicals, and at least about 68 parts n-propyl acetate solvent (which is sufficient to total the number of parts of the formulation to 100). The nitrocellulose is available as Walocel nitrocellulose E 360 from Bayer AG.

The second layer is printed using a water-based printing formulation described previously in Example 7. The third layer is printed with a polyvinyl alcohol/calcium carbonate-containing printing formulation described previously in Example 9. The top or fourth layer is printed with the ethylcellulose/calcium carbonate-containing printing formulation described previously in Example 4.

When the printed wrapping material is slit into a web of 27 mm width, that web possesses a plurality of spaced bands, each band being about 6 mm in width and about 27 mm across. The dry weight of band is about 3 mg.

Example 18

Referring to FIG. 5, a printed paper wrapping material 180 has a paper base sheet 184 that possesses a printed a pattern having the form of a series of recurring bands, two of which are shown as bands 188, 190. The paper wrapping material is described in Example 1. The bands 208, 210 each have maximum widths of about 4 mm. The bands are positioned at predetermined intervals, such that the spacing between each of the respective bands, as measured as the space separating each band, is about 39 mm. The bands each are printed onto the base sheet as a plurality of continuous layers, and for the embodiment shown, there are four layers, 215, 218, 222 and 226. The layers are registered so that each successive layer directly and completely overlies the layer directly below.

The first or bottom layer is printed using the nitrocellulose/sodium citrate-containing printing formulation described in Example 16. The second layer is printed using a water-based printing formulation described previously in Example 7. The third layer is printed using a polyvinyl alcohol-containing printing formulation described previously in Example 8.

The top or fourth layer is printed with the ethylcellulose-containing printing formulation. That formulation includes about 16 parts magnesium hydroxide, about 10 parts ethylcellulose, about 2 parts triacetin, about 0.5 parts of a lecithin wetting agent, and about 0.02 parts of an optical brightener available as Uvitex OB from Ciba Specialty Chemicals, and at least about 71 parts isopropyl acetate solvent (which is sufficient to total the number of parts of the formulation to 100). The ethylcellulose is available as Aqualon N-7 from Hercules Incorporated.

When the printed wrapping material is slit into a web of 27 mm width, that web possesses a plurality of spaced bands, each band being about 6 mm in width and about 27 mm across. The dry weight of each band is about 2.5 mg.

The wrapping material so provided represents a base sheet printed with patterned multi-layered bands; and at least one of the layers from each band is provided from a printing formulation incorporating hydrophobic film-forming material and magnesium-containing filler material (e.g., magnesium hydroxide).

Example 19

Referring to FIG. 5, a printed paper wrapping material 180 has a paper base sheet 184 that possesses a printed a pattern having the form of a series of recurring bands, two of which are shown as bands 188, 190. The paper wrapping material is described in Example 11. The bands 208, 210 each have maximum widths of about 6 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are four layers, 215, 218, 222 and 226. The layers are registered so that each successive layer directly and completely overlies the layer directly below.

The first or bottom layer is printed using the nitrocellulose/sodium citrate-containing printing formulation described previously in Example 16. The second layer is printed using the water-based printing formulation described previously in Example 7. The third layer is printed using the polyvinyl alcohol/calcium carbonate-containing printing formulation described previously in Example 9. The top or fourth layer is printed with the ethylcellulose/magnesium hydroxide-containing printing formulation described previously in Example 18.

When the printed wrapping material is slit into a web of 27 mm width, that web possesses a plurality of spaced bands, each band being about 6 mm in width and about 27 mm across. The dry weight of each band is about 2 mg.

Example 20

Figure 6:
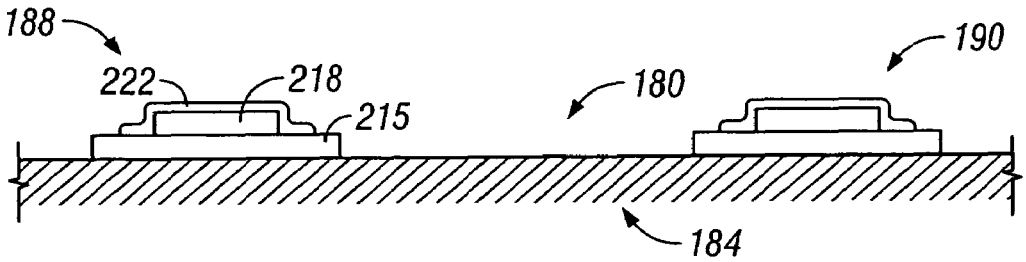

Referring to FIG. 6, a printed paper wrapping material 180 has a paper base sheet 184 that possesses a printed a pattern having the form of a series of recurring bands, two of which are shown as bands 188, 190. The paper wrapping material is described in Example 1. The bands 188, 190 each have maximum widths of about 8 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are three layers, 215, 218 and 222.

The first or bottom layer 215 is printed onto the base web 184 as a printing formulation. That formulation is the ethylcellulose/calcium carbonate-containing formulation described previously in Example 4.

Printed onto the first layer 215 is a second layer 218. The width of that layer is about 4 mm. The second layer is positioned such that about 2 mm at each of the extreme ends of the upper region of the first layer is not covered by the second layer. The second layer 218 includes the water-based printing formulation described previously in Example 7.

Printed onto and over the second layer 218 is a third layer 222 that incorporates a film-forming material that can cover and seal the adhesive component of the second layer 218. The width of that layer is about 6 mm. The second layer is positioned such that about 1 mm at each of the extreme ends of the upper region of the first layer is not covered by the second layer. The printing formulation of the third layer 222 is that polyvinyl alcohol-containing formulation described previously in Example 8.

When the printed wrapping material is slit into a web of 27 mm width, that web possesses a plurality of spaced bands, each band being about 8 mm in width and about 27 mm across. The dry weight of each band is about 1.4 mg. The dry weight of the first layer of each band is about 0.3 mg. The dry weight of the second layer of each band is about 0.8 mg. The dry weight of the third layer is about 0.3 mg.

For the printed wrapping material described with reference to FIG. 6, the printing pattern of each layer is different, the layers are registered so that each successive layer overlies less than all or more than all of the layer directly below, formulations used to print each layer all are not identical in overall composition, and the amount of formulation used to print each layer is not identical for every layer.

Cigarettes manufactured so as to have tobacco rods produced using those wrapping materials possessing bands which include appropriate amounts of appropriate components have the ability to meet the aforementioned cigarette extinction criteria. One or more of those layers of those bands printed onto the wrapping material are effective in assisting in reducing the ignition propensity of cigarettes manufactured from that wrapping material. One of the layers (e.g., the third layer of film-forming material used to cover the second layer of adhesive composition) provides a manner for adhesive formulation to be used in the printing of bands onto wrapping materials while providing a manner or method for avoiding blocking.

Example 21

Referring to FIG. 6, a printed paper wrapping material 180 has a paper base sheet 184 that possesses a printed a pattern having the form of a series of recurring bands, two of which are shown as bands 188, 190. The paper wrapping material is described in Example 1. The bands 208, 210 each have maximum widths of about 8 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are three layers, 215, 218 and 222.

The first or bottom layer has a width of about 8 mm and is the nitrocellulose/sodium citrate-containing formulation described previously in Example 16.

Printed onto the first layer 215 is a second layer 218. The width of that layer is about 4 mm. The second layer is positioned such that about 2 mm at each of the extreme ends of the upper region of the first layer is not covered by the second layer. The second layer 218 includes the water-based printing formulation described previously in Example 7.

Printed onto and over the second layer 218 is a third layer 222 that incorporates a film-forming material that can cover and seal the adhesive component of the second layer 218. The width of that layer is about 6 mm. The second layer is positioned such that about 1 mm at each of the extreme ends of the upper region of the first layer is not covered by the second layer. The printing formulation of the third layer 222 is that polyvinyl alcohol/calcium carbonate-containing formulation described previously in Example 9.

When the printed wrapping material is slit into a web of 27 mm width, that web possesses a plurality of spaced bands, each band being about 6 mm in width and about 27 mm across. The dry weight of each band is about 2.5 mg.

Example 22

Referring to FIG. 6, a printed paper wrapping material 180 has a paper base sheet 184 that possesses a printed a pattern having the form of a series of recurring bands, two of which are shown as bands 188, 190. The paper wrapping material is described in Example 1. The bands 208, 210 each have maximum widths of about 8 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are three layers, 215, 218 and 222.

The first or bottom layer has a width of about 8 mm and is the nitrocellulose/sodium citrate-containing formulation described previously in Example 16.

Printed onto the first layer 215 is a second layer 218. The width of that layer is about 4 mm. The second layer is positioned such that about 2 mm at each of the extreme ends of the upper region of the first layer is not covered by the second layer. The second layer 218 includes the water-based printing formulation incorporating sodium chloride described previously in Example 12.

Printed onto and over the second layer 218 is a third layer 222 that incorporates a film-forming material that can cover and seal the adhesive component of the second layer 218. The width of that layer is about 8 mm. The second layer is positioned such that the first layer is covered by the second layer. The printing formulation of the third layer 222 is that polyvinyl alcohol-containing formulation described previously in Example 8.

When the printed wrapping material is slit into a web of 27 mm width, that web possesses a plurality of spaced bands, each band being about 6 mm in width and about 27 mm across. The dry weight of each band is about 2.5 mg.

Example 23

Referring to FIG. 6, a printed paper wrapping material 180 has a paper base sheet 184 that possesses a printed a pattern having the form of a series of recurring bands, two of which are shown as bands 188, 190. The paper wrapping material is described in Example 1. The bands 208, 210 each have maximum widths of about 8 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are three layers, 215, 218 and 222.

The first or bottom layer has a width of about 8 mm. The printing formulation for that layer includes about 5 parts sodium chloride, about 8 parts ethylcellulose, about 2 parts triacetin, about 0.5 parts of a lecithin wetting agent, and about 0.02 parts of an optical brightener available as Uvitex OB from Ciba Specialty Chemicals, and at least about 84 parts iso-propyl acetate solvent (which is sufficient to total the number of parts of the formulation to 100). The ethylcellulose is available as Aqualon N-7 from Hercules Incorporated.

Printed onto the first layer 215 is a second layer 218. The width of that layer is about 4 mm. The second layer is positioned such that about 2 mm at each of the extreme ends of the upper region of the first layer is not covered by the second layer. The second layer 218 includes the water-based printing formulation described previously in Example 7.

Printed onto and over the second layer 218 is a third layer 222 that incorporates a film-forming material that can cover and seal the adhesive component of the second layer 218. The width of that layer is about 6 mm. The second layer is positioned such that about 1 mm at each of the extreme ends of the upper region of the first layer is not covered by the second layer. The printing formulation of the third layer 222 is that starch-based formulation described previously in Example 15.

When the printed wrapping material is slit into a web of 27 mm width, that web possesses a plurality of spaced bands, each band being about 6 mm in width and about 27 mm across. The dry weight of each band is about 2.5 mg.

Example 24

Referring to FIG. 6, a printed paper wrapping material 180 has a paper base sheet 184 that possesses a printed a pattern having the form of a series of recurring bands, two of which are shown as bands 188, 190. The paper wrapping material is described in Example 1. The bands 208, 210 each have maximum widths of about 8 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are three layers, 215, 218 and 222.

The first or bottom layer has a width of about 8 mm and is the ethylcellulose/sodium chloride-containing formulation described previously in Example 23.

Printed onto the first layer 215 is a second layer 218. The width of that layer is about 4 mm. The second layer is positioned such that about 2 mm at each of the extreme ends of the upper region of the first layer is not covered by the second layer. The second layer 218 includes the water-based printing formulation incorporating sodium chloride described previously in Example 12.

Printed onto and over the second layer 218 is a third layer 222 that incorporates a film-forming material that can cover and seal the adhesive component of the second layer 218. The width of that layer is about 8 mm. The second layer is positioned such that the first layer is covered by the second layer. The printing formulation of the third layer 222 is that ethylcellulose-containing formulation described previously in Example 2.

When the printed wrapping material is slit into a web of 27 mm width, that web possesses a plurality of spaced bands, each band being about 6 mm in width and about 27 mm across. The dry weight of each band is about 3 mg.

Example 25

Referring to FIG. 6, a printed paper wrapping material 180 has a paper base sheet 184 that possesses a printed a pattern having the form of a series of recurring bands, two of which are shown as bands 188, 190. The paper wrapping material is described in Example 1. The bands 208, 210 each have maximum widths of about 8 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are three layers, 215, 218 and 222.

The first or bottom layer has a width of about 8 mm. The printing formulation for that layer is that ethylcellulose-containing formulation described in Example 2.

Printed onto the first layer 215 is a second layer 218. The width of that layer is about 4 mm. The second layer is positioned such that about 2 mm at each of the extreme ends of the upper region of the first layer is not covered by the second layer. The second layer 218 includes the water-based printing formulation incorporating sodium chloride described previously in Example 13.

Printed onto and over the second layer 218 is a third layer 222 that incorporates a film-forming material that can cover and seal the adhesive component of the second layer 218. The width of that layer is about 6 mm. The second layer is positioned such that about 1 mm at each of the extreme ends of the upper region of the first layer is not covered by the second layer. The printing formulation of the third layer 222 is that starch-based formulation described previously in Example 15.

When the printed wrapping material is slit into a web of 27 mm width, that web possesses a plurality of spaced bands, each band being about 6 mm in width and about 27 mm across. The dry weight of each band is about 2.5 mg.

Example 26

Referring to FIG. 6, a printed paper wrapping material 180 has a paper base sheet 184 that possesses a printed a pattern having the form of a series of recurring bands, two of which are shown as bands 188, 190. The paper wrapping material is described in Example 1. The bands 208, 210 each have maximum widths of about 8 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are three layers, 215, 218 and 222.

The first or bottom layer has a width of about 8 mm. The printing formulation is that printing nitrocellulose/calcium carbonate-containing formulation described in Example 1.

Printed onto the first layer 215 is a second layer 218. The width of that layer is about 4 mm. The second layer is positioned such that about 2 mm at each of the extreme ends of the upper region of the first layer is not covered by the second layer. The second layer 218 includes the water-based printing formulation. The printing formulation for that layer includes about 22 parts starch available as Flokote 64 from National Starch, about 2.5 parts sodium citrate dihydrate, about 3 parts potassium citrate monohydrate, about 1 part diammonium phosphate, about 5 parts of a mixture, and at least about 66 water (which is sufficient to total the number of parts of the formulation to 100). That mixture is produced by mixing the optical brightener, Uvitex OB from Ciba Specialty Chemicals, in absolute ethyl alcohol; such that the amount of optical brightener dispersed in the final printing formulation is about 0.02 parts.

Printed onto and over the second layer 218 is a third layer 222 that incorporates a film-forming material that can cover and seal the adhesive component of the second layer 218. The width of that layer is about 6 mm. The second layer is positioned such that about 1 mm at each of the extreme ends of the upper region of the first layer is not covered by the second layer. The printing formulation of the third layer 222 is that ethylcellulose-containing formulation described previously in Example 2.

When the printed wrapping material is slit into a web of 27 mm width, that web possesses a plurality of spaced bands, each band being about 6 mm in width and about 27 mm across. The dry weight of each band is about 2.5 mg.

Example 27

Referring to FIG. 6, a printed paper wrapping material 180 has a paper base sheet 184 that possesses a printed a pattern having the form of a series of recurring bands, two of which are shown as bands 188, 190. The paper wrapping material is described in Example 1. The bands 188, 190 each have maximum widths of about 8 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are three layers, 215, 218 and 222.

The first or bottom layer has a width of about 8 mm and is the ethylcellulose-containing formulation described previously in Example 2.

Printed onto the first layer 215 is a second layer 218. The width of that layer is about 4 mm. The second layer is positioned such that about 2 mm at each of the extreme ends of the upper region of the first layer is not covered by the second layer. The second layer 218 includes the water-based printing formulation described previously in Example 7.

Printed onto and over the second layer 218 is a third layer 222 that incorporates a film-forming material that can cover and seal the adhesive component of the second layer 218. The width of that layer is about 6 mm. The second layer is positioned such that about 1 mm at each of the extreme ends of the upper region of the first layer is not covered by the second layer. The printing formulation of the third layer 222 is that nitrocellulose/calcium carbonate-containing formulation described previously in Example 1.

When the printed wrapping material is slit into a web of 27 mm width, that web possesses a plurality of spaced bands, each band being about 8 mm in width and about 27 mm across. The dry weight of the each band is about 2 mg.

Example 28

Referring to FIG. 6, a printed paper wrapping material 180 has a paper base sheet 184 that possesses a printed a pattern having the form of a series of recurring bands, two of which are shown as bands 188, 190. The paper wrapping material is described in Example 1. The bands 208, 210 each have maximum widths of about 8 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are three layers, 215, 218 and 222.

The first or bottom layer has a width of about 8 mm and is the ethylcellulose-containing formulation described previously in Example 2.

Printed onto the first layer 215 is a second layer 218. The width of that layer is about 4 mm. The second layer is positioned such that about 2 mm at each of the extreme ends of the upper region of the first layer is not covered by the second layer. The second layer 218 includes the starch-based printing formulation described previously in Example 15.

Printed onto and over the second layer 218 is a third layer 222 that incorporates a film-forming material that can cover and seal the adhesive component of the second layer 218. The width of that layer is about 6 mm. The second layer is positioned such that about 1 mm at each of the extreme ends of the upper region of the first layer is not covered by the second layer. The printing formulation of the third layer 222 is that starch-based formulation described previously in Example 26.

When the printed wrapping material is slit into a web of 27 mm width, that web possesses a plurality of spaced bands, each band being about 8 mm in width and about 27 mm across. The dry weight of each band is about 2 mg.

Example 29

Figure 7:
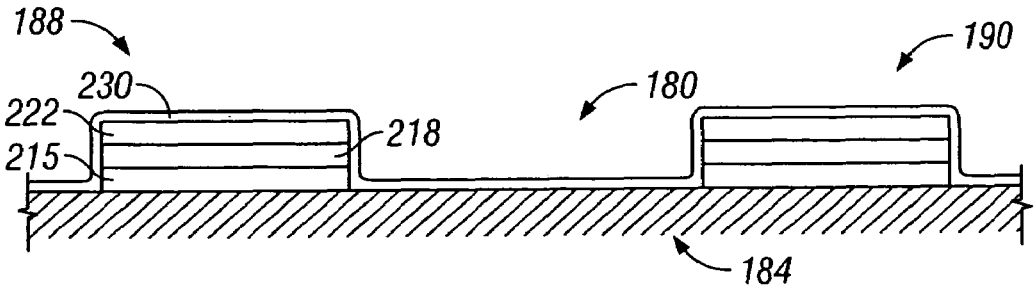

Referring to FIG. 7, a printed paper wrapping material 180 has a paper base sheet 184 that possesses a printed a pattern having the form of a series of recurring bands, two of which are shown as bands 188, 190. The paper wrapping material has a porosity of about 18 CORESTA units, and is available as Tercig LK18 from Tervakoski. The bands 188, 190 each have maximum widths of about 4 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are three layers, 215, 218 and 222. The printing pattern of each layer is virtually the same, the layers are registered so that each successive layer directly and completely overlies the layer directly below, the formulation used to print the bottom layer is described previously in Example 4; and each of the middle and top layers are virtually the same, and the amount of formulation used to print each layer is virtually the same. The middle and top layers are printed using the formulations described previously in Example 2, and are printed in virtually the same manner described previously in Example 2.

The wrapping material also includes a continuous fourth layer 230. The formulation of that layer is about 10 parts sodium citrate and about 90 parts water. That formulation is printed over the entire surface of the wrapping material; for example, at a line screen of 300. The amount of formulation employed is sufficient to provide a wrapping material having the sodium citrate applied in the amount of about 0.5 percent, based on the dry weight of the base sheet. Overcoat layers do not require optical brightener, as the full coverage of the major surface of the wrapping material using that printing formulation does not require registration. The further or fourth layer is provided from a formulation that is virtually absent of film-forming material. Furthermore, although represented in FIG. 7 as a continuous layer, the absence of film-forming material in the overcoat layer results in the salt of the aqueous solution being drawn into intimate contact with the wrapping material when the aqueous solvent is removed.

When the printed wrapping material is slit into a web of 27 mm width, that web possesses a plurality of spaced bands, each band being about 4 mm in width and about 27 mm across. The dry weight of each band is about 1.7 mg.

For the printed wrapping material described with reference to FIG. 7, an overcoat layer is printed over virtually the entire major surface of the wrapping material. That overcoat layer also is applied so as to cover bands that previously have been printed onto that wrapping material. The overcoat layer also is employed in such a manner so as to allow burn chemical to be incorporated into the wrapping material using a printing process.

Example 30

Figure 8:
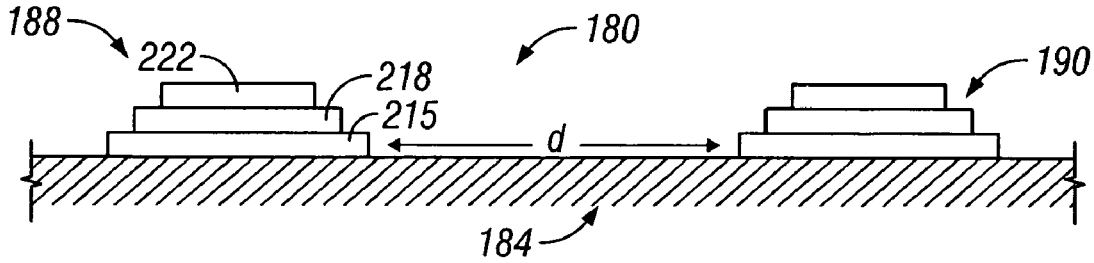

Referring to FIG. 8, a printed paper wrapping material 180 has a paper base sheet 184 that possesses a printed a pattern having the form of a series of recurring bands, two of which are shown as bands 188, 190. The paper wrapping material is described in Example 1. The bands 188, 190 each have maximum widths of about 6 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are three layers, 215, 218 and 222. The printing pattern for each layer is different, the layers are registered so that each successive layer overlies the layer directly below, and the formulation used to print each layer is virtually the same.

The first or bottom layer 215 is printed onto the base web 184 as a printing formulation. That printing formulation is the ethylcellulose/calcium carbonate-containing formulation described previously in Example 4.

Printed onto the first layer 215 is a second layer 218 which includes the same formulation, and the second layer and the width of that layer is about 5 mm. The second layer is positioned such that about 0.5 mm at each of the extreme ends of the upper region of the first layer is not covered by the second layer. Printed onto the second layer 218 is a third layer 222 which includes the same formulation. The third layer is positioned such that about 0.5 mm at each of the extreme ends of the upper region of the second layer is not covered by the third layer.

When the printed wrapping material is slit into a web of 27 mm width, that web possesses a plurality of spaced bands, each band being about 6 mm in maximum width and about 27 mm across. The dry weight of each band is about 3 mg.

The wrapping material depicted in FIG. 8 represents a base sheet having a series of essentially equally spaced multi-layered bands of essentially equal width and dimension, whereby the width of each successive layer of each band is less than that of the layer beneath that layer, and whereby the ends of each successive layer are equally off-set from the ends of the layer beneath that layer. That wrapping material also represents a wrapping material possessing bands having three layers, each layer being different in size, but each layer includes printing formulation incorporating hydrophobic film-forming material.

Example 31

Figure 9:
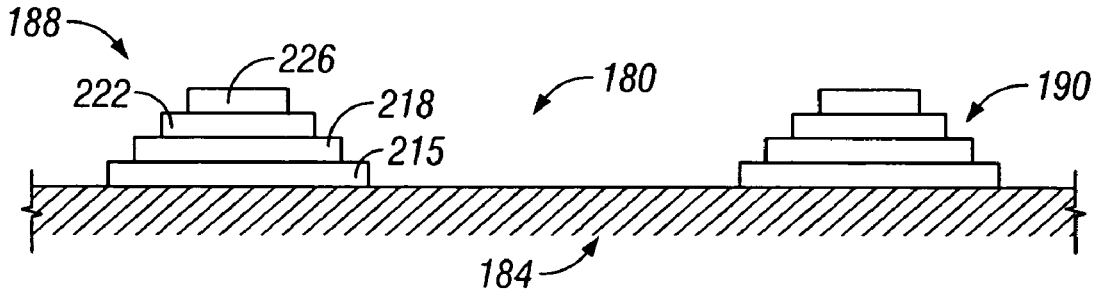

Referring to FIG. 9, a printed paper wrapping material 180 has a paper base sheet 184 that possesses a printed a pattern having the form of a series of recurring bands, two of which are shown as bands 188, 190. The paper wrapping material is described in Example 1. The bands 188, 190 each have maximum widths of about 8 mm. The bands are positioned at predetermined intervals, such that the spacing between each of the respective bands, as measured as the space separating each band, is about 30 mm. The bands each are printed onto the base sheet as a plurality of continuous layers, and for the embodiment shown, there are four layers, 215, 218, 222 and 226. For each band, the width of each layer is different, the layers are registered so that each successive layer overlies the layer directly below, and the formulation used to print each layer is virtually the same.

The first or bottom layer 215 is printed onto the base web 184 as a printing formulation. That formulation is described previously in Example 1. That layer has a width of about 8 mm.

Printed onto the first layer 215 is a second layer 218 which includes the starch-based printing formulation described in Example 26, and the second layer has a width of about 6 mm. The second layer is positioned such that about 1 mm at each of the extreme ends of the upper region of the first layer is not covered by the second layer.

Printed onto the second layer 218 is a third layer 222 which includes the polyvinyl alcohol-based printing formulation described in Example 9, and the third layer has a width of about 5 mm. The third layer is positioned such that about 0.5 mm at each of the extreme ends of the upper region of the second layer is not covered by the third layer.

Printed onto the third layer 222 is a fourth layer 226 which includes the ethylcellulose-containing printing formulation described in Example 2, and the fourth layer has a width of about 3 mm. The fourth layer is positioned such that about 1 mm at each of the extreme ends of the upper region of the third layer is not covered by the fourth layer.

When the printed wrapping material is slit into a web of 27 mm width, that web possesses a plurality of spaced bands, each band being about 8 mm in maximum width and about 27 mm across. The dry weight of each band is about 3 mg.

Example 32

Figure 10:
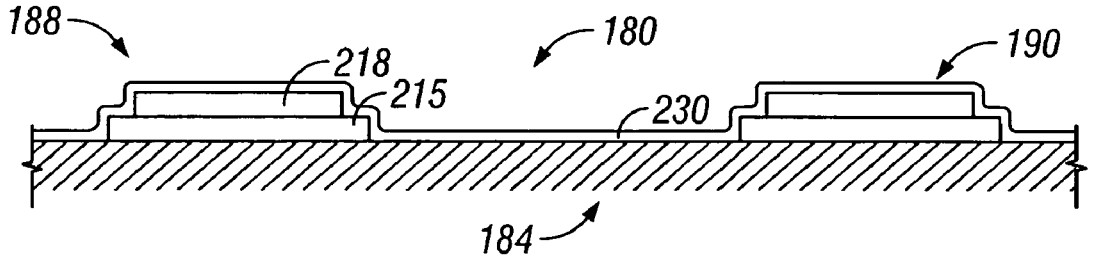

Referring to FIG. 10, a printed paper wrapping material 180 has a paper base sheet 184 that possesses a printed a pattern having the form of a series of recurring bands, two of which are shown as bands 188, 190. The paper wrapping material is described in Example 3. The bands 188, 190 each have maximum widths of about 7 mm. The bands are positioned at predetermined intervals, such that the spacing between each of the respective bands, as measured as the space separating each band, is about 20 mm. The bands each are printed onto the base sheet as a plurality of continuous layers, and for the embodiment shown, there are two layers, 215 and 218. The width of each layer is different, the layers are registered so that the upper layer overlies the lower layer, and the formulation used to print each layer is virtually the same.

The first or bottom layer 215 is printed onto the base web 184 as a printing formulation, and the width of that layer is about 7 mm. That formulation is the ethylcellulose/calcium carbonate-containing formulation described previously in Example 4.

Printed onto the first layer 215 is a second layer 218 which includes the printing formulation described in Example 4, and the second layer and the width of that layer is about 5 mm. The second layer is positioned such that about 1 mm at each of the extreme ends of the upper region of the first layer is not covered by the second layer.

The wrapping material also includes an optional continuous third layer 230. The formulation is that salt-containing formulation described previously in Example 29. That formulation is printed over the entire surface of the wrapping material, essentially in the manner set forth in Example 29.

When the printed wrapping material is slit into a web of 27 mm width, that web possesses a plurality of spaced bands, each band being about 7 mm in maximum width and about 27 mm across. The dry weight of each band is about 2 mg.

The wrapping material having the pattern depicted in FIG. 9 is representative of a wrapping material having a series of spaced bands; and the amount of coating applied to the wrapping material for each band is relatively high towards the center of each band and relatively low towards each side of each band. That is, for each band possessing a center portion and two side portions; there exists a greater amount of printing formulation applied toward the center portion than toward each side portion.

Example 33

Figure 11:
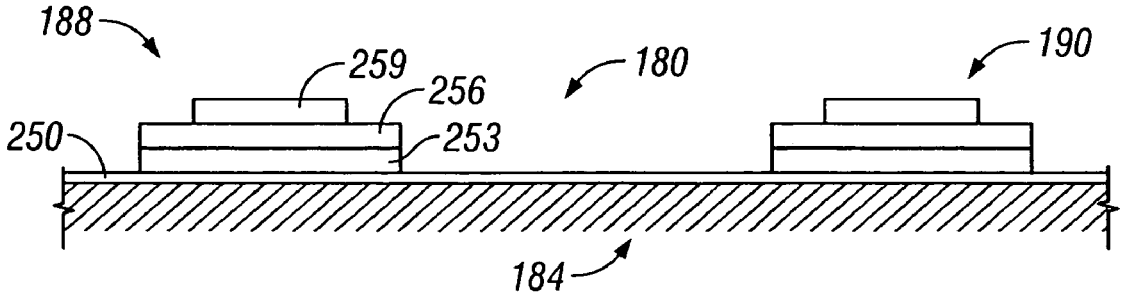

Referring to FIG. 11, printed paper wrapping material 180 has a base sheet 184 that possesses a printed a pattern having the form of a series of recurring bands, two of which are shown as bands 188, 190. The paper wrapping material is described in Example 3. The bands each have maximum widths of about 5 mm. The bands are positioned at predetermined intervals, such that the spacing between each of the respective bands, as measured as the space separating each band, is about 30 mm.

The wrapping material includes an optional continuous first layer 250. The printing formulation of that layer is about 10 parts sodium citrate and about 90 parts water. That formulation is printed over the entire surface of the wrapping material; for example, at a line screen of 300. The amount of formulation employed is sufficient to provide a wrapping material having the sodium citrate applied in the amount of about 0.5 percent, based on the dry weight of the base sheet. Such a primer coating does not require optical brightener, as the full coverage of the major surface of the wrapping material using that printing formulation does not require registration. The primer layer is provided from a formulation that is virtually absent of film-forming material. Furthermore, although represented in FIG. 11 as a continuous layer, the absence of film-forming material in the primer layer results in the salt of the aqueous solution being drawn into intimate contact with the wrapping material when the aqueous solvent is removed.

The bands each are printed onto the base sheet as a plurality of continuous layers, and for the embodiment shown, there are three layers, 253, 256 and 259. The printing pattern of the bottom two layers, 253, 256, are virtually the same, the layers are registered so that the upper layer 256 completely overlies the layer 253 directly below, and the formulation used to print each layer is virtually the same. Each of the bottom two layers of the bands are applied to the coated base sheet as a printing formulation. That formulation is the ethylcellulose-calcium carbonate-containing formulation described previously in Example 4.

Printed onto the second layer 256 of each band is a third layer 259 which includes the printing formulation described previously in Example 15, and the second layer and the width of that layer is about 4 mm. The second layer is positioned such that about 0.5 mm at each of the extreme ends of the upper region of the second layer is not covered by the third layer.

When the printed wrapping material is slit into a web of 27 mm width, that web possesses a plurality of spaced bands, each band being about 6 mm in maximum width and about 27 mm across. The dry weight of each band is about 2 mg.

The wrapping material depicted in FIG. 11 represents a base sheet having a series of essentially equally spaced multi-layered bands of essentially equal width and dimension, whereby the widths of certain successive layers of each band are virtually the same, and the widths of certain successive layers of each band are less than that of the layer or layers beneath those layers. The wrapping material depicted in FIG. 11 also represents a base sheet having a series of essentially equally spaced multi-layered bands of essentially equal width and dimension that are printed onto a base sheet that previously has had a primer layer of printing formulation applied to virtually the whole surface thereof. That is, the primer layer is applied so that patterned bands can be printed onto that wrapping material over the material that is printed onto the wrapping material. The primer layer can incorporate a water soluble salt, and the primer layer can be virtually absent of film-forming material. The primer layer also is employed in such a manner so as to allow burn chemical to be incorporated into the wrapping material using a printing process.

Example 34

Referring to FIG. 1, printed paper wrapping material 180 has a base sheet 184 that possesses a printed a pattern having the form of a series of recurring bands, two of which are shown as bands 188, 190. The paper wrapping material is described in Example 1. Those bands each have maximum widths of about 5 mm. The bands are positioned at predetermined intervals, such that the spacing between each of the respective bands, as measured as the space separating each band, is about 20 mm.

The wrapping material also includes an optional continuous first layer 250. The formulation and application of that layer are described in Example 33.

The bands each are printed onto the base sheet as a plurality of continuous layers, and for the embodiment shown, there are three layers, 253, 256 and 259. The printing pattern of the bottom two layers, 253, 256, are virtually the same, the layers are registered so that the upper layer 256 completely overlies the layer 253 directly below, and the formulation used to print each layer is virtually the same. Each of the bottom two layers of the bands are applied to the coated base sheet as a printing formulation.

The printing formulation for the bottom layers 253, 256 of each band includes about 16 parts calcium carbonate particles, about 6 parts ethylcellulose, about 2 parts nitrocellulose, about 2 parts triacetin, about 0.5 parts of a lecithin wetting agent, and about 0.02 parts of an optical brightener available as Uvitex OB from Ciba Specialty Chemicals, and at least about 74 parts iso-propyl acetate solvent (which is sufficient to total the number of parts of the formulation to 100). The calcium carbonate is available as Albaglos PCC from Specialty Minerals, Inc. The ethylcellulose is available as Aqualon N-7 from Hercules Incorporated. The nitrocellulose is available as Walocel nitrocellulose E-360 from Bayer AG.

Printed onto the second layer 256 of each band is a third layer 259 which includes the printing formulation described previously in Example 9, and the second layer and the width of that layer is about 4 mm. The second layer is positioned such that about 0.5 mm at each of the extreme ends of the upper region of the second layer is not covered by the third layer.

When the printed wrapping material is slit into a web of 27 mm width, that web possesses a plurality of spaced bands, each band being about 6 mm in maximum width and about 27 mm across. The dry weight of each band is about 2 mg.

Example 35

Referring to FIG. 11, printed paper wrapping material 180 has a base sheet 184 that possesses a printed a pattern having the form of a series of recurring bands, two of which are shown as bands 188, 190. The paper wrapping material is described in Example 1. The bands each have maximum widths of about 5 mm. The bands are positioned at predetermined intervals, such that the spacing between each of the respective bands, as measured as the space separating each band, is about 20 mm.

The wrapping material also includes an optional continuous first layer 250. The formulation and application of that layer are described in Example 33.

The bands each are printed onto the base sheet as a plurality of continuous layers, and for the embodiment shown, there are three layers, 253, 256 and 259. The printing pattern of the bottom two layers, 253, 256, are virtually the same, the layers are registered so that the upper layer 256 completely overlies the layer 253 directly below, and the formulation used to print each layer is virtually the same. Each of the bottom two layers of the bands are applied to the coated base sheet as a printing formulation. The printing formulation for each layer of each band includes about 16 parts calcium carbonate particles, about 6 parts ethylcellulose, about 2 parts polyvinyl acetate, about 2 parts triacetin, about 0.5 parts of a lecithin wetting agent, and about 0.02 parts of an optical brightener available as Uvitex OB from Ciba Specialty Chemicals, and at least about 74 parts iso-propyl acetate solvent (which is sufficient to total the number of parts of the formulation to 100). The calcium carbonate is available as Albaglos PCC from Specialty Minerals, Inc. The ethylcellulose is available as Aqualon N-7 from Hercules Incorporated. The polyvinyl acetate is available a B-15 from McGean-Rohco.

Printed onto the second layer 256 of each band is a third layer 259 which includes the printing formulation described previously in Example 1, and the second layer and the width of that layer is about 4 mm. The second layer is positioned such that about 0.5 mm at each of the extreme ends of the upper region of the second layer is not covered by the third layer.

When the printed wrapping material is slit into a web of 27 mm width, that web possesses a plurality of spaced bands, each band being about 6 mm in maximum width and about 27 mm across. The dry weight of each band is about 2 mg.

Example 36

Figure 12:
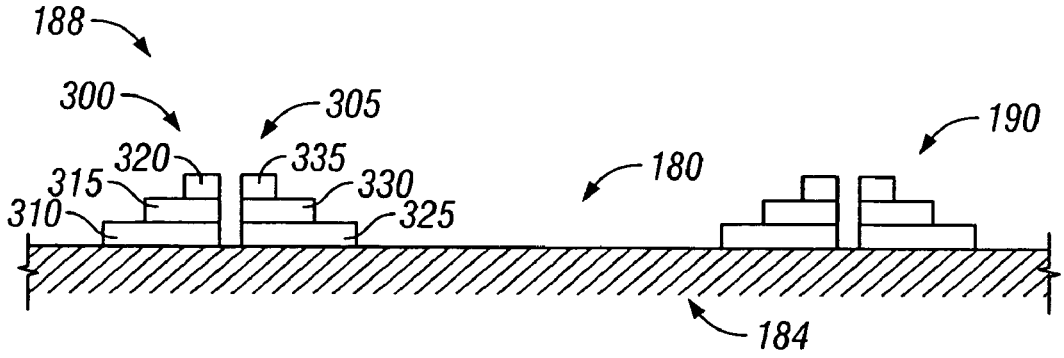

Referring to FIG. 12, printed paper wrapping material 180 has a base sheet 184 that possesses a printed a pattern having the form of a series of recurring bands, two of which are shown as bands 188, 190. The paper wrapping material is described in Example 1. The bands each have maximum widths of about 7 mm. The bands are discontinuous bands, each band being constructed from two band portions 300, 305. The bands are positioned at predetermined intervals, such that the spacing as measured between the respective bands is about 20 mm.

For the embodiment shown, first band portion 300 possesses three layers, 310, 315 and 320; and the second band portion 305 also possesses three layers, 325, 330 and 335. The band portions each are separated by 1 mm. Each bottom layer 310, 325 has a width of about 3 mm. Those layers are provided from the ethylcellulose/calcium carbonate-containing printing formulation described in Example 4. Printed onto those first layers 310, 325 are second layers 315, 330, respectively; and those second layers include the same printing formulation. Each second layer has a width of about 2 mm. The second layers 315, 330 each are positioned such that about 1 mm at one extreme end of the upper region of each respective first layer 310, 325 is not covered by the second layer. Printed onto those second layers are third layers 320, 335, respectively, and those third layers include the nitrocellulose/calcium carbonate-containing formulation described in Example 1. Each third layer has a width of about 1 mm. The third layers 320, 335 each are positioned such that about 1 mm at one extreme end of the upper region of each respective second layer 315, 330 is not covered by the third layer.

When the printed wrapping material is slit into a web of 27 mm width, that web possesses a plurality of spaced bands, each band being about 7 mm in maximum width and about 27 mm across. The dry weight of each band is about 2.5 mg.

The wrapping material depicted in FIG. 12 represents a base sheet having a series of essentially equally spaced multi-layered bands of essentially equal width and dimension. Those bands are discontinuous bands; which include two multi-layered sections. The wrapping material depicted in FIG. 12 also represents a base sheet having multi-layered discontinuous bands, whereby the widths of the layers of each individual section of each band are different from one another. In particular, the width of each successive layer of each band portion is less than that of the layer beneath that layer, and whereby one end of each successive layer is off-set from the ends of the layer beneath that layer; and the layers of each band portion are registered so as to have their respective ends virtually overlie one another at one end of the band.

Example 37

Figure 13:
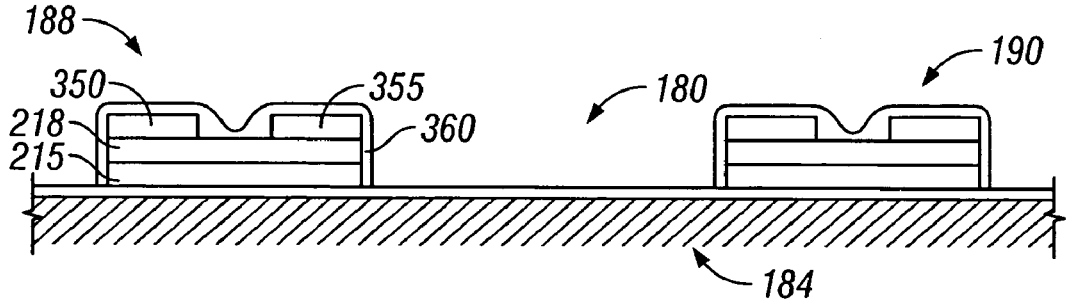

Referring to FIG. 13, printed paper wrapping material 180 has a base sheet 184 that possesses a printed a pattern having the form of a series of recurring bands, two of which are shown as bands 188, 190. The paper wrapping material described in Example 1. The bands each have maximum widths of about 7 mm. The bands are positioned at predetermined intervals, such that the spacing as measured between the respective bands is about 20 mm.

The bands each are printed onto the base sheet as a plurality of continuous layers, and for the embodiment shown, there are two continuous layers, 215, 218, and two discontinuous layers, 280 and 282.

The bottom layer 215 has a width of about 6 mm. That layer is provided from the nitrocellulose/calcium carbonate-containing formulation described in Example 1.

Printed onto the first layer 215 is a second layer 218 provided from the ethylcellulose/calcium carbonate formulation described in Example 4, and the width of that second layer is about 6 mm. The second layer is positioned so as to virtually overlie the first layer.

Printed onto the second layer is a third layer, which is a discontinuous layer having first and second portions 350, 355, each of about 2 mm width and positioned about 2 mm apart. Each of the first and second portions 350, 355 are provided from the ethylcellulose/magnesium hydroxide-containing printing formulation described previously in Example 18.

An optional fourth layer 360 has a width of about 7 mm and covers all of the lower layers of the wrapping material. The fourth layer 360 is positioned such that it extends about 0.5 mm beyond each extreme end of the first band layer. The printing formulation of the fourth layer 360 is the ethylcellulose-containing formulation described in Example 2.

When the printed wrapping material is slit into a web of 27 mm width, that web possesses a plurality of spaced bands, each band being about 7 mm in maximum width and about 27 mm across. The dry weight of each band is about 2.5 mg.

The wrapping material depicted in FIG. 13 represents a base sheet having a series of essentially equally spaced multi-layered bands of essentially equal width and dimension. Those bands are continuous in nature, but possess at least one discontinuous layer; the discontinuous layer includes two sections (e.g., two stripes that extend across the wrapping material).

Example 38

Referring to FIG. 13, printed paper wrapping material 180 has a base sheet 184 that possesses a printed a pattern having the form of a series of recurring bands, two of which are shown as bands 188, 190. The paper wrapping material described in Example 1. The bands each have maximum widths of about 7 mm. The bands are positioned at predetermined intervals, such that the spacing as measured between the respective bands is about 20 mm.

The bands each are printed onto the base sheet as a plurality of continuous layers, and for the embodiment shown, there are two continuous layers, 215, 218, and two discontinuous layers, 280 and 282.

The bottom layer 215 has a width of about 6 mm. That layer is provided from the ethylcellulose/calcium carbonate-containing formulation described in Example 4.

Printed onto the first layer 215 is a second layer 218 provided from the ethylcellulose formulation described in Example 2, and the width of that second layer is about 6 mm. The second layer is positioned so as to virtually overlie the first layer.

Printed onto the second layer is a third layer, which is a discontinuous layer having first and second portions 350, 355, each of about 2 mm width and positioned about 2 mm apart. Each of the first and second portions 350, 355 are provided from a printing formulation which includes about 8 parts polyvinyl alcohol resin available as Celvol 205 from Celanese Chemicals, about 5 parts sodium citrate, about 82 parts water, and about 5 parts of a mixture. That mixture is produced by the optical brightener, Uvitex OB from Ciba Specialty Chemicals, in absolute ethyl alcohol; such that the amount of optical brightener dispersed in the final printing formulation is about 0.02 parts.

An optional fourth layer 360 has a width of about 7 mm and covers all of the lower layers of the wrapping material. The fourth layer 360 is positioned such that it extends about 0.5 mm beyond each extreme end of the first band layer. The printing formulation of the fourth layer 360 is the ethylcellulose-containing formulation described in Example 2.

When the printed wrapping material is slit into a web of 27 mm width, that web possesses a plurality of spaced bands, each band being about 7 mm in maximum width and about 27 mm across. The dry weight of each band is about 2 mg.

Example 39

Referring to FIG. 13, printed paper wrapping material 180 has a base sheet 184 that possesses a printed a pattern having the form of a series of recurring bands, two of which are shown as bands 188,190. The paper wrapping material described in Example 1. The bands each have maximum widths of about 7 mm. The bands are positioned at predetermined intervals, such that the spacing as measured between the respective bands is about 20 mm.

The bands each are printed onto the base sheet as a plurality of continuous layers, and for the embodiment shown, there are two continuous layers, 215, 218, and two discontinuous layers, 280 and 282.

The bottom layer 215 has a width of about 6 mm. That layer is printed using a formulation which includes about 7 parts nitrocellulose, about 2 parts triacetin, about 0.5 parts of a lecithin wetting agent, and about 0.02 parts of an optical brightener available as Uvitex OB from Ciba Specialty Chemicals, and at least about 90 parts isopropyl acetate solvent (which is sufficient to total the number of parts of the formulation to 100). The nitrocellulose is available as Walocel nitrocellulose E 360 from Bayer AG.

Printed onto the first layer 215 is a second layer 218 provided from the ethylcellulose/calcium carbonate formulation described in Example 4, and the width of that second layer is about 6 mm. The second layer is positioned so as to virtually overlie the first layer.

Printed onto the second layer is a third layer, which is a discontinuous layer having first and second portions 350, 355, each of about 2 mm width and positioned about 2 mm apart. Each of the first and second portions 350, 355 are provided from the polyvinyl alcohol/calcium carbonate-containing printing formulation described previously in Example 14.

An optional fourth layer 360 has a width of about 7 mm and covers all of the lower layers of the wrapping material. The fourth layer 360 is positioned such that it extends about 0.5 mm beyond each extreme end of the first band layer. The printing formulation of the fourth layer 360 is the ethylcellulose-containing formulation described in Example 2.

When the printed wrapping material is slit into a web of 27 mm width, that web possesses a plurality of spaced bands, each band being about 7 mm in maximum width and about 27 mm across. The dry weight of each band is about 2 mg.

Example 40

Referring to FIG. 13, printed paper wrapping material 180 has a base sheet 184 that possesses a printed a pattern having the form of a series of recurring bands, two of which are shown as bands 188, 190. The paper wrapping material described in Example 1. The bands each have maximum widths of about 7 mm. The bands are positioned at predetermined intervals, such that the spacing as measured between the respective bands is about 20 mm.

The bands each are printed onto the base sheet as a plurality of continuous layers, and for the embodiment shown, there are two continuous layers, 215, 218, and two discontinuous layers, 280 and 282.

The bottom layer 215 has a width of about 6 mm. That layer is provided from the ethylcellulose/calcium carbonate-containing formulation described in Example 4.

Printed onto the first layer 215 is a second layer 218 provided from the ethylcellulose formulation described in Example 2, and the width of that second layer is about 6 mm. The second layer is positioned so as to virtually overlie the first layer.

Printed onto the second layer is a third layer, which is a discontinuous layer having first and second portions 350, 355, each of about 2 mm width and positioned about 2 mm apart. Each of the first and second portions 350, 355 are provided from the nitrocellulose-containing printing formulation described previously in Example 16.

An optional fourth layer 360 has a width of about 7 mm and covers all of the lower layers of the wrapping material. The fourth layer 360 is positioned such that it extends about 0.5 mm beyond each extreme end of the first band layer. The printing formulation of the fourth layer 360 is the ethylcellulose-containing formulation described in Example 2.

When the printed wrapping material is slit into a web of 27 mm width, that web possesses a plurality of spaced bands, each band being about 7 mm in maximum width and about 27 mm across. The dry weight of each band is about 2 mg.

Example 41

Figure 14:
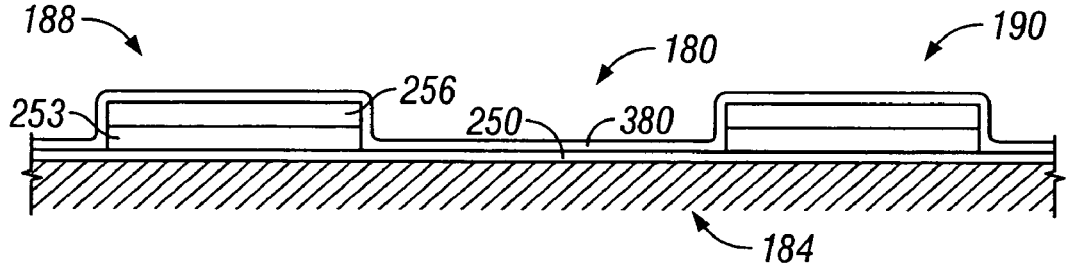

Referring to FIG. 14, printed paper wrapping material 180 has a base sheet 184 that possesses a printed a pattern having the form of a series of recurring bands, two of which are shown as bands 188, 190. The paper wrapping material is available as Tercig LK60 from Tervakoski. Those bands each have maximum widths of about 8 mm. The bands are positioned at predetermined intervals, such that the spacing between each of the respective bands, as measured as the space separating each band, is about 20 mm.

The wrapping material also includes an optional continuous first layer 250. The formulation used to print that layer is described in Example 33.

The bands each are printed onto the base sheet as a plurality of continuous layers, and for the embodiment shown, there are three layers, 253, 256 and 380. The bottom layer 253 of each band has a width of about 5 mm. The printing pattern of the top layer 256 is virtually the same, the layers are registered so that the upper layer 256 completely overlies the layer 253 directly below, and the formulation used to print each layer is virtually the same. Each of those two layers 253, 256 of the bands are applied to the coated base sheet as a printing formulation. That formulation used to print those layers is the ethylcellulose/calcium carbonate-containing formulation described previously in Example 4.

Printed onto and over the all of the previously described three band layers is a fourth layer 380 that incorporates a film-forming material that can cover the major surface of the wrapping material. The formulation is the ethylcellulose-containing printing formulation described in Example 2.

When the printed wrapping material is slit into a web of 27 mm width, that web possesses a plurality of spaced bands, each band being about 8 mm in maximum width and about 27 mm across. The dry weight of each band is about 2 mg.

Example 42

Figure 15:
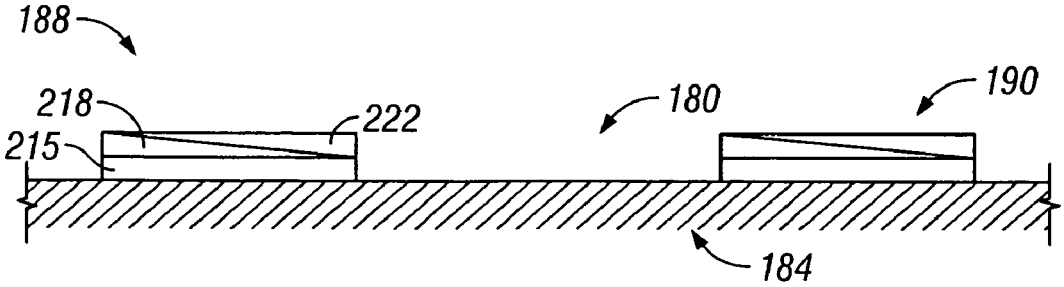

Referring to FIG. 15, printed paper wrapping material 180 has a base sheet 184 that possesses a printed a pattern having the form of a series of recurring bands, two of which are shown as bands 188, 190. The paper wrapping material that wrapping material described in Example 1. The bands each have maximum widths of about 7 mm. The bands are positioned at predetermined intervals, such that the spacing between each of the respective bands, as measured as the space separating each band, is about 30 mm.

The bottom layer 215 is applied to the wrapping material generally in a manner described previously. The middle layer 218 is applied over the bottom layer so that the amount of coating formulation at one side of that middle layer is greater than that at the other side of that layer. The top layer 222 is applied over the middle layer 218, and in a manner so that the amount of coating formulation at one side of that top layer is greater than that at the other side of the layer. The coating formulation for each of layers 215, 218 and 222 is that ethylcellulose-calcium carbonate-containing printing formulation described in Example 4. The applications of each of the coating layers are registered such that the resulting band is continuous, and possesses a relatively consistent total coating application across its width. The manner by which the top two layers are arranged, and coordination between the coating formulations and the application of those formulations, results in a printed wrapping material possessing bands having relatively consistent composition from top to bottom and side to side. The coating formulation applied such that each layer provided about 0.6 mg of dry weight to the wrapping material in each printed region (for wrapping materials slit to widths of 27 mm).

The manner by which a layer having a different coating application across its width is applied to a wrapping material can vary. Typically, printing cylinders having larger, deeper cells are used to apply greater amounts of printing formulation at one end of a layer, while smaller, shallower cells are used to apply lesser amounts of printing formulation at the other end of a layer.

The wrapping material depicted in FIG. 15 represents a base sheet having a series of essentially equally spaced multi-layered bands of essentially equal width and dimension, whereby at least one layer (and preferably an even number of layers) is applied in an altered amount across the width of that layer. Preferably, each such layer having an altered application rate of coating formulation is provided form an identical formulation, coating type and pattern; and as such, the relative symmetry of composition of that band across its width can be maintained.

Example 43

Figure 16:
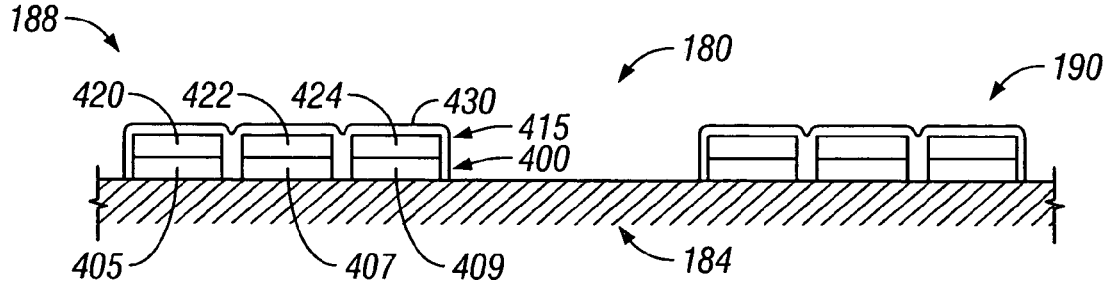

Referring to FIG. 16, printed paper wrapping material 180 has a base sheet 184 that possesses a printed a pattern having the form of a series of recurring bands, two of which are shown as bands 188, 190. The paper wrapping material is that material described in Example 1. The bands each have maximum widths of about 7.5 mm. The bands are positioned at predetermined intervals, such that the spacing between each of the respective bands, as measured as the space separating each band, is about 20 mm.

The first layer 400 is a discontinuous layer having first 405, second 407 and third 409 portions, each of about 1.5 mm width and positioned about 0.5 mm apart. The second layer 415 is a discontinuous layer having first 420, second 422 and third 424 portions, each of about 1.5 mm width and positioned about 0.5 mm apart. Those three first layers are printed onto the three first layer portions. Each of the aforementioned layers is provided using the ethylcellullose/calcium carbonate-containing coating formulation described in Example 4.

A third layer is printed over the aforementioned layers, and the width of that layer is about 7.5 mm. The third layer 430 is positioned such that about 0.5 mm past each of the extreme ends of the upper region of the first and second layers is covered by the third layer. The coating formulation for third layer 430 is that ethylcellulose-containing printing formulation described in Example 2.

The wrapping material depicted in FIG. 16 represents a base sheet having a series of essentially equally spaced multi-layered bands of essentially equal width and dimension. Each band includes a series of multi-layered coatings; that is, each band includes several discontinuous bands. The wrapping material depicted in FIG. 16 also represents a band that possesses an overall continuous nature (due to the top layer of coating formulation), while individual layers or portions of that band are discontinuous in nature.

Example 44

Figure 17:
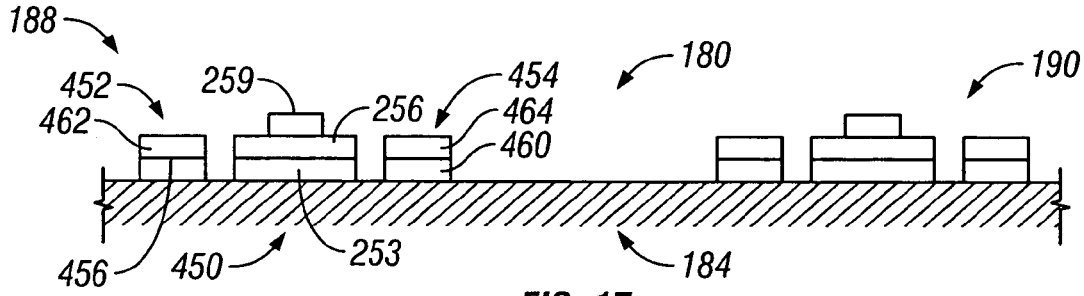

Referring to FIG. 17, a paper wrapping material 180 has a base sheet 184 that possesses a printed a pattern having the form of a set of recurring bands forming a series of recurring bands. Each set of bands is comprised of three bands. The middle band 450 has a width of about 5 mm, and is essentially of the type described previously in Example 34 with reference to FIG. 11. That is, the middle band possesses a bottom layer 253, a middle layer 256 and a top layer 259. Positioned on each side of that middle band 450, and spaced about 0.5 mm on each side of that band, are two smaller bands 452, 454. Both of those bands smaller bands have widths of about 2 mm. Both of those bands 452, 454 have first layers 456, 460, respectively, and second layers 462, 464 applied over those respective first layers. The layers of those smaller bands 452, 454 are provided using the ethylcellulose/calcium carbonate-containing printing formulation described in Example 4. As such, there is provided a discontinuous band having three sections.

When the printed wrapping material is slit into a web of 27 mm width, that web possesses a plurality of spaced bands, each band being about 8 mm in maximum width and about 27 mm across. The dry weight of each band is about 2 mg.

The wrapping material so provided represents a base sheet printed with patterned bands; and the bands are segmented, multi-layered bands that are discontinuous in nature. As such, several band segments are combined to form one band region.

Example 45

Figure 18:
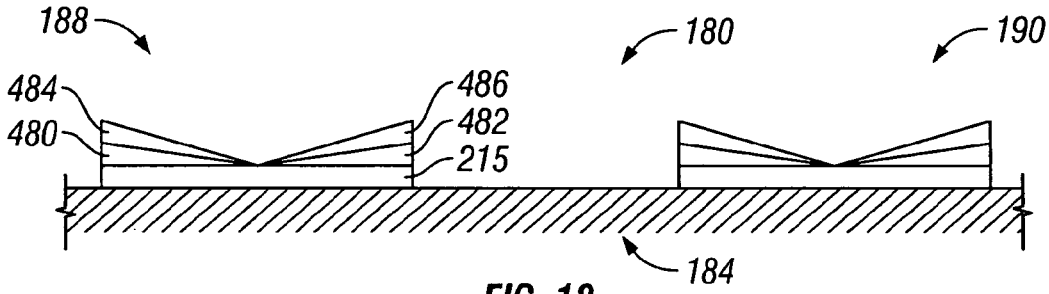

Referring to FIG. 18, printed paper wrapping material 180 has a base sheet 184 that possesses a printed a pattern having the form of a series of recurring bands, two of which are shown as bands 188, 190. The paper wrapping material that wrapping material described in Example 1. The bands each have maximum widths of about 7 mm. The bands are positioned at predetermined intervals, such that the spacing between each of the respective bands, as measured as the space separating each band, is about 20 mm.

The bottom layer 215 is applied to the wrapping material generally in a manner described previously. Two middle layer sections 480, 482 are applied over the bottom layer so that the amount of coating formulation at one side of each middle layer section is greater than that at the other side of that respective section. Two top layer sections 484, 486 are applied over the respective middle layer sections 480, 482, and in a manner so that the amount of coating formulation at one side of each top layer is greater than that at the other side of that respective layer. The coating formulation for each of layers 215, 480, 482, 484 and 486 is that printing formulation described in Example 4. The manner the top two layers are arranged, and coordination between the coating formulations and the application of those formulations, results in a printed wrapping material possessing bands having a relatively symmetrical shape, from side to side. The coating formulation applied such that each layer provided about 0.6 mg of dry weight to the wrapping material in each printed region (for wrapping materials slit to widths of 27 mm).

The manner by which a layer having a different coating application across its width is applied to a wrapping material can vary. Typically, printing cylinders having larger, deeper cells are used to apply greater amounts of printing formulation at one end of a layer, while smaller, shallower cells are used to apply lesser amounts of printing formulation at the other end of a layer.

The wrapping material depicted in FIG. 15 represents a base sheet having a series of essentially equally spaced multi-layered bands of essentially equal width and dimension, whereby a layer having two sections each are applied in altered amounts across the width of that layer. For the embodiment shown, the amount of printing formulation applied to the wrapping material at the edges of each band is greater than the amount applied toward the center of each band. That is, for each band, a lesser amount of printing formulation is applied toward the center portion than toward each side portion.

Example 46

Figure 19:
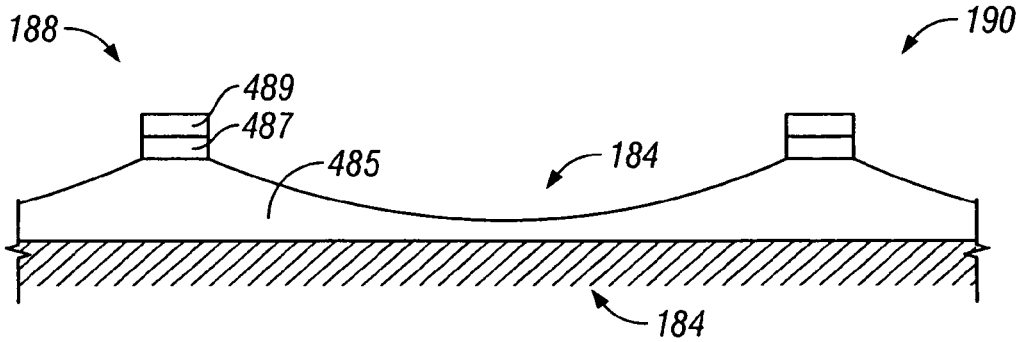

Referring to FIG. 19, a printed paper wrapping material 184 has a base sheet 180 that possesses spaced bands 188, 190. The base sheet is described in Example 1. A continuous printed first layer 485 is printed over the major surface of the base sheet such that amount printed is greater as it approaches each band region, and lower in the region between the bands. Onto that first layer 485 in the region of that first layer that has the highest amount of coating formulation is applied to the base sheet 180, are printed spaced bands 188, 190, each of which possess two patterned layers 487, 489. Bands 188, 190 each have maximum widths of about 4 mm. Those bands are positioned at predetermined intervals, such that the spacing between each of the respective bands is about 20 mm.

The first layer 485 is provided by printing that ethylcellulose-containing formulation described in Example 2.

The layers 487, 489 of each band 188 are provided from that printing formulation described in Example 4.

When the printed wrapping material is slit into a web of 27 mm width, that web possesses a plurality of spaced bands, each band being at least about 4 mm in maximum width and about 27 mm across. The dry weight of each band is about 2 mg.

The wrapping material so provided represents a base sheet printed with patterned bands having printed regions between those bands. The wrapping material so provided represents printed regions between bands, and the printing pattern between those bands changes along the length of that wrapping material. For example, a printed region possesses higher levels of printing formulation applied to the wrapping material in regions near each band, and lower levels of printing formulation applied to the wrapping material in central regions between bands and remote from those bands.

Example 47

Figure 20:
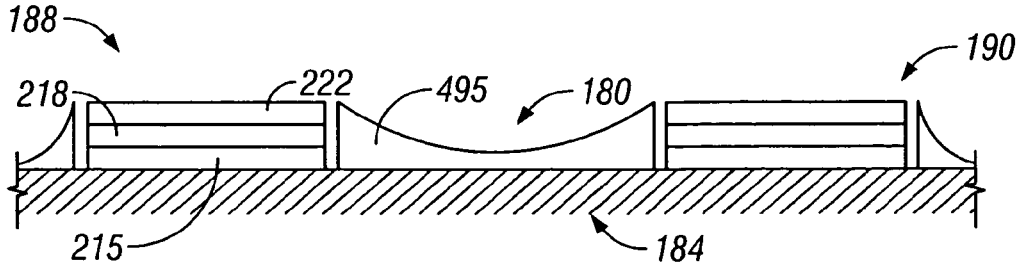

Referring to FIG. 20, a printed paper wrapping material 184 has a base sheet 180 that possesses spaced bands 188, 190. The base sheet is described in Example 1. A printed discontinuous coating layer 495 is printed between bands 188 and 190 such that amount printed is greater as it approaches each band, and lower in the region between the bands. At each end of layer 495, in the region of that first layer that has the highest amount of coating formulation applied to the base sheet 180, are printed bands 188, 190, each of which possess two patterned layers 215, 218 and 222. Bands 188, 190 each have maximum widths of about 6 mm. Those bands are positioned at predetermined intervals, such that the spacing between each of the respective bands is about 30 mm.

The discontinuous layer 495 is provided is provided by printing that ethylcellulose-containing formulation described in Example 2.

The layers 215, 218 and 222 of band 188 are provided from that printing formulation described in Example 4.

When the printed wrapping material is slit into a web of 27 mm width, that web possesses a plurality of spaced bands, each band being about 6 mm in maximum width and about 27 mm across. The dry weight of each band is about 2.5 mg.

The wrapping material depicted in FIG. 20 represents a base sheet having a series of essentially equally spaced multi-layered bands, and a series of printed regions between those bands. For example, between two bands there exists a printed region, and the amount of coating formulation applied to the wrapping material is not consistent over the distance between those bands. In particular, the degree of coating application is altered over that printed region, and the amount of coating is relatively high in regions approaching the vicinity of each band, and the amount of coating is relatively low in regions approaching the vicinity farthest from each band.

Example 48

Figure 21:
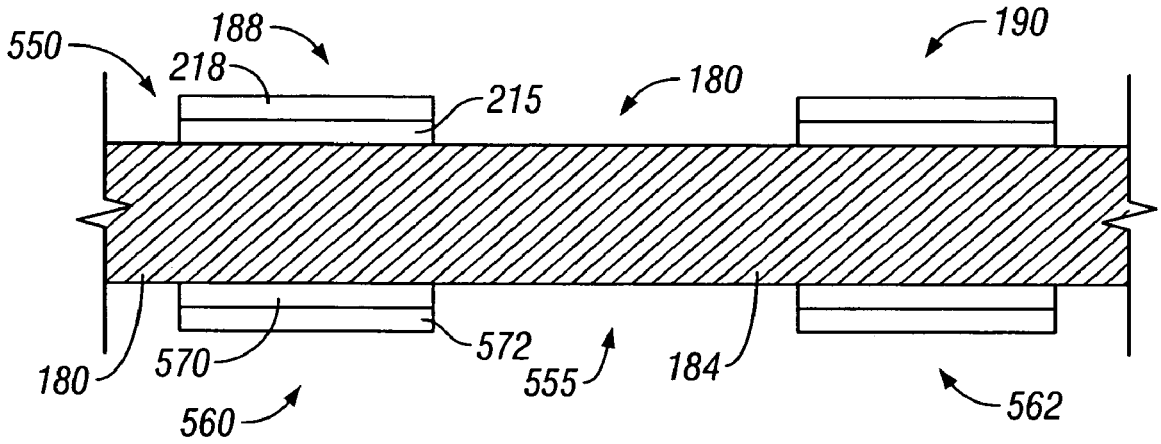

Referring to FIG. 21, a printed paper wrapping material 180 has a paper base sheet 184 that possesses a printed a pattern on each side of that sheet. The pattern has the form of a series of recurring bands, two of which are shown on the wire side major surface 550 of the sheet as bands 188, 190; and two of which are shown on the felt side major surface 555 of the sheet as bands 560, 562. The paper wrapping material is available as Tercig LK38 from Tervakoski. The bands 208, 210 each have maximum widths of about 4 mm. The bands are positioned at predetermined intervals, such that the spacing between each of the respective bands, as measured as the space separating each band, is about 20 mm.

The bands on the wire side 550 of the sheet each are printed onto the base sheet as a plurality of continuous layers, and for the embodiment shown, there are two layers, 215 and 218. The printing pattern of each layer is virtually the same, the layers are registered so that each successive layer directly and completely overlies the layer directly below, the formulation used to print each layer is virtually the same, and the amount of formulation used to print each layer is virtually the same. The printing formulation for those layers is described in Example 4.

The bands on the felt side 555 of the sheet each are printed onto the base sheet as a plurality of continuous layers, and for the embodiment shown, there are two layers, 570 and 572. The printing pattern of each layer is virtually the same, the layers are registered so that each successive layer directly and completely overlies the layer directly below, the formulation used to print each layer is virtually the same, and the amount of formulation used to print each layer is virtually the same. The printing formulation for those layers is described in Example 4. The layers of the bands on each major surface of the wrapping material are registered so as to be aligned directly across form one another.

When the printed wrapping material is slit into a web of 27 mm width, that web possesses a plurality of spaced bands, each band being about 4 mm in width and about 27 mm across. The dry weight of each band on each side of the wrapping material is about 1 mg. The amount of dry weight provided by each layer of each band is about 0.5 mg.

The wrapping material depicted in FIG. 21 represents a base sheet having a series of essentially equally spaced multi-layered bands, those bands being registered on both sides of a wrapping material. Also depicted is a wrapping material having a registered band pattern on both major surfaces, and at least one of those bands is multi-layered in structure.

Example 49

Figure 22:
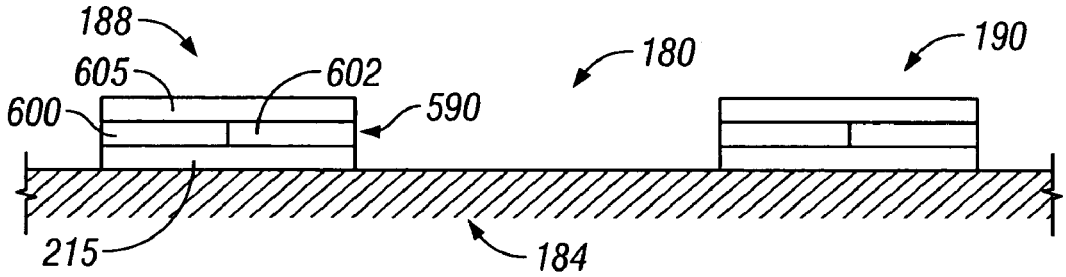

Referring to FIG. 22, a paper wrapping material 180 has a base sheet 184 that possesses a printed a pattern having the form of a set of recurring bands forming a series of recurring bands 188, 190. The bands each have widths of about 5 mm, and the distance between each band is about 30 mm.

The bottom layer 215 has a width of about 5 mm, and is provided using that ethylcellulose/calcium carbonate-containing printing formulation described in Example 4.

The middle layer 590 is provided from two layer portions 600, 602. Those layer portions abut one another to form a continuous layer. The printing formulation for each layer portion is the same, in order to provide a symmetrical band. Each middle layer portion has a width of about 2.5 mm, and is provided using that formulation described in Example 4.

The top layer 605 has a width of about 5 mm and overlies the middle layer 590. That layer is provided using the printing formulation described in Example 4.

When the printed wrapping material is slit into a web of 27 mm width, that web possesses a plurality of spaced bands, each band being about 5 mm in maximum width and about 27 mm across. The dry weight of each band is about 2 mg.

The wrapping material depicted in FIG. 22 represents a base sheet having a series of essentially equally spaced multi-layered bands of essentially equal width and dimension, whereby at least one of the layers includes two or more abutting layers that combine to form a larger layer.

Example 50

A cigarette paper wrapping material has a porosity of about 18 CORESTA units, and is available as Tercig LK18 from Tervakoski is provided. That wrapping material is printed with bands of 4 mm width and spaced at 20 mm. The wrapping material is coated with four layers of coating formulation, in the manner shown in FIG. 5.

The bottom layer 215 is provided using the ethylcellulose/calcium carbonate-containing printing formulation described in Example 4; and the two top layers 218, 222 are provided using the ethylcellulose-containing printing formulation described in Example 2. The resulting formulation is applied in such a manner that the wrapping material, when dried, has about 3 pounds/ream coated thereon.

The wrapping material also includes a continuous fourth layer 230. The formulation of that layer is that ethylcellulose-containing formulation described in Example 2; except that the optical brightener is an optional component. That formulation is printed over the entire surface of the wrapping material. The amount of formulation employed is sufficient to provide a wrapping material with a coating of ethylcellulose of about 0.5 pounds/ream.

Example 51

A cigarette paper wrapping material has a porosity of about 18 CORESTA units, and is available as Tercig LK18 from Tervakoski is provided. That wrapping material is printed with bands of 4 mm width and spaced at 20 mm. The wrapping material is coated with four layers of coating formulation, in the manner shown in FIG. 5.

The bottom layer 215 is provided using the ethylcellulose/calcium carbonate-containing printing formulation described in Example 4; and the two top layers 218, 222 are provided using the ethylcellulose-containing printing formulation described in Example 2. The resulting formulation is applied in such a manner that the wrapping material, when dried, has about 3 pounds/ream coated thereon.

The wrapping material also includes a continuous fourth layer 230. The formulation of that layer is that ethylcellulose/sodium chloride-containing formulation described in Example 23; except that the optical brightener is an optional component. That formulation is printed over the entire surface of the wrapping material. The amount of formulation employed is sufficient to provide a wrapping material with a coating of ethylcellulose of about 0.5 pounds/ream.

Example 52

A cigarette paper wrapping material having a porosity of about 53 CORESTA units and available as Ref. No. 460 from Ecusta is provided. That wrapping material is printed with bands of 6 mm width and spaced at 20 mm. The wrapping material is coated with three layers of coating formulation, with the width of each layer being about 6 mm, so as to provide a multi-layer band of the type shown in FIG. 4.

The bottom layer and top layers each are provided by an ethylcellulose-containing printing formulation available as FSBM6H70 from Color Converting Industries. The middle layer is the water-based printing formulation. The printing formulation of the middle layer of each band incorporates a water-based coating that is employed in liquid form, and that coating is an adhesive formulation of R. J. Reynolds Tobacco Company used as a cigarette seam adhesive and designated as CS-1242. The CS-1242 formulation is a water emulsion-based adhesive consisting of about 87 to about 88 percent ethylene vinyl acetate copolymer emulsion sold under the designation Resyn 32-0272 by National Starch & Chemical Company, and about 12 to about 13 percent adhesive concentrate stabilizer of R. J. Reynolds Tobacco Company known as AC-9. The AC-9 adhesive concentrate stabilizer consists of about 92 percent water and about 8 percent polyvinyl alcohol resin available as Celvol 205 from Celanese Chemicals. The final printing formulation is comprised of about 48 parts of the water-based coating, about 24.6 parts iso-propyl acetate, about 24 parts water, about 1.9 parts propylene glycol and about 1.5 parts of a mixture. That mixture is produced by the optical brightener, Uvitex OB from Ciba Specialty Chemicals, in absolute ethyl alcohol; such that the amount of optical brightener dispersed in the final printing formulation is about 0.02 parts.

The dry weight of coating applied to the wrapping material is about 3.21 pounds per ream. The porosity of each coated region is about 5.2 CORESTA units.

The banded wrapping material can be used to manufacture cigarettes having a Camel Light 85 format and configuration that meet cigarette extinction test criteria.

Example 53

A cigarette paper wrapping material having a porosity of about 53 CORESTA units and available as Ref. No. 460 from Ecusta is provided. That wrapping material is printed with bands of 6 mm width and spaced at 20 mm. The wrapping material is coated with four layers of coating formulation, with the width of each layer being about 6 mm, so as to provide a multi-layer band of the type shown FIG. 5.

The three bottom layers are provided by an ethylene vinyl acetate copolymer-containing printing formulation employing toluene as a solvent, which formulation is available as FSBM6H70 from Color Converting Industries. The top layer is provided by an ethylcellulose-containing printing formulation available as FSBM6H70 from Color Converting Industries. The dry weight of coating applied to the wrapping material is about 2.35 pounds per ream. The porosity of each coated region is about 5.4 CORESTA units.

The banded wrapping material can be used to manufacture cigarettes having a Camel Light 85 format and configuration that meet, to a certain degree, cigarette extinction test criteria. Cigarettes exhibiting improved performance in meeting cigarette extinction test criteria can be provided by using a wrapping material that employs the coating composition and format set forth, except that a lower porosity wrapping material can be employed and/or a higher weight of coating can be applied to the wrapping material.

Example 54

A cigarette paper wrapping material having a porosity of about 38 CORESTA units and available as Ref. No. 454 from Ecusta is provided. That wrapping material is printed with bands of 6 mm width and spaced at 14 mm. The wrapping material is coated with two layers of coating formulation, with the width of each layer being about 6 mm.

The bottom layer and top layers each are provided by an ethylene vinyl acetate/calcium carbonate-containing printing formulation having a toluene solvent and available as FSBM4H57 from Color Converting Industries. The printing formulation incorporates about 9 percent calcium carbonate particles. The dry weight of coating applied to the wrapping material is about 3.08 pounds per ream. The porosity of each coated region is about 5 CORESTA units.

The banded wrapping material can be used to manufacture cigarettes having a Camel Light 85 format and configuration that meet cigarette extinction test criteria.

Example 55

A cigarette paper wrapping material having a porosity of about 38 CORESTA units and available as Ref. No. 454 from Ecusta is provided. That wrapping material is printed with bands of 6 mm width and spaced at 14 mm. The wrapping material is coated with three layers of coating formulation, with the width of each layer being about 6 mm.

The layers each are provided by an ethylene vinyl acetate/calcium carbonate-containing printing formulation having a toluene solvent and available as FSBM4H57 from Color Converting Industries. The dry weight of coating applied to the wrapping material is about 3.58 pounds per ream. The porosity of each coated region is about 3.5 CORESTA units.

The banded wrapping material can be used to manufacture cigarettes having a Camel Light 85 format and configuration that meet cigarette extinction test criteria. The wrapping material printed with a printing formulation incorporating calcium carbonate filler is more effective in meeting cigarette extinction test criteria than a comparable wrapping material printed with a comparable formulation not incorporating filler.

Example 56

A cigarette paper wrapping material having a porosity of about 38 CORESTA units and available as Ref. No. 454 from Ecusta is provided. That wrapping material is printed with bands of 6 mm width and spaced at 14 mm. The wrapping material is coated with three layers of coating formulation, with the width of each layer being about 6 mm.

The layers each are provided by an ethylcellulose/calcium carbonate-containing printing formulation having an isopropyl acetate solvent and available as FSBM0H62 from Color Converting Industries. The printing formulation incorporates about 16 percent calcium carbonate particles. The dry weight of coating applied to the wrapping material is about 5.43 pounds per ream. The porosity of each coated region is about 2.7 CORESTA units.

The banded wrapping material can be used to manufacture cigarettes having a Camel Light 85 format and configuration that meet cigarette extinction test criteria. The wrapping material printed with a printing formulation incorporating calcium carbonate filler is more effective in meeting cigarette extinction test criteria than a comparable wrapping material printed with a comparable formulation not incorporating filler.

Example 57

A cigarette paper wrapping material having a porosity of about 38 CORESTA units and available as Ref. No. 454 from Ecusta is provided. That wrapping material is printed with bands of 6 mm width and spaced at 14 mm. The wrapping material is coated with three layers of coating formulation, with the width of each layer being about 6 mm.

The bottom layer is provided by an ethylcellulose/calcium carbonate-containing printing formulation having an isopropyl acetate solvent and available as FSBM0H62 from Color Converting Industries. The middle and top layers are provided by polyvinyl acetate containing printing formulation available as FSBM0H64 from Color Converting Industries. The dry weight of coating applied to the wrapping material is about 5.02 pounds per ream. The porosity of each coated region is about 3.9 CORESTA units.

The banded wrapping material can be used to manufacture cigarettes having a Camel Light 85 format and configuration that meet cigarette extinction test criteria. The wrapping material printed with a printing formulation incorporating calcium carbonate filler is more effective in meeting cigarette extinction test criteria than a comparable wrapping material printed with a comparable formulation not incorporating filler. The wrapping material printed with the patterned band is more effective in meeting cigarette extinction test criteria than a comparable formulation printed with patterned bands having only layers of printing formulation which include polyvinyl acetate and calcium carbonate filler.

The wrapping material so provided is representative of a wrapping material printed with a layer incorporating ethylcellulose, and the layer of ethylcellulose is covered with a layer of polyvinyl acetate.

Example 58

A cigarette paper wrapping material having a porosity of about 38 CORESTA units and available as Ref. No. 454 from Ecusta is provided. That wrapping material is printed with bands of 6 mm width and spaced at 20 mm. The wrapping material is coated with two layers of coating formulation, with the width of each layer being about 6 mm.

The layers each are provided by an ethylcellulose/calcium carbonate-containing printing formulation having an isopropyl acetate solvent and available as FSBM0H62 from Color Converting Industries. The printing formulation incorporates about 16 percent calcium carbonate particles. The dry weight of coating applied to the wrapping material is about 3.48 pounds per ream. The porosity of each coated region is about 6.3 CORESTA units.

The banded wrapping material can be used to manufacture cigarettes having a Camel Light 85 format and configuration that effectively meet cigarette extinction test criteria. The wrapping material printed with a printing formulation incorporating calcium carbonate filler is more effective in meeting cigarette extinction test criteria than a comparable wrapping material printed with a comparable formulation not incorporating filler.

Example 59

A cigarette paper wrapping material having a porosity of about 38 CORESTA units and available as Ref. No. 454 from Ecusta is provided. That wrapping material is printed with bands of 6 mm width and spaced at 20 mm. The wrapping material is coated with three layers of coating formulation, with the width of each layer being about 6 mm.

The layers each are provided by an ethylcellulose/calcium carbonate-containing printing formulation having an isopropyl acetate solvent and available as FSBM0H62 from Color Converting Industries. The printing formulation incorporates about 16 percent calcium carbonate particles. The dry weight of coating applied to the wrapping material is about 4.90 pounds per ream. The porosity of each coated region is about 3.5 CORESTA units.

The banded wrapping material can be used to manufacture cigarettes having a Camel Light 85 format and configuration that meet cigarette extinction test criteria. The wrapping material printed with a printing formulation incorporating calcium carbonate filler is more effective in meeting cigarette extinction test criteria than a comparable wrapping material printed with a comparable formulation not incorporating filler.

Example 60

A cigarette paper wrapping material having a porosity of about 38 CORESTA units and available as Ref. No. 454 from Ecusta is provided. That wrapping material is printed with bands of 6 mm width and spaced at 20 mm. The wrapping material is coated with four layers of coating formulation, with the width of each layer being about 6 mm.

The layers each are provided by an ethylcellulose/calcium carbonate-containing printing formulation having an isopropyl acetate solvent and available as FSBM0H62 from Color Converting Industries. The printing formulation incorporates about 16 percent calcium carbonate particles. The dry weight of coating applied to the wrapping material is about 7.32 pounds per ream. The porosity of each coated region is about 2.6 CORESTA units.

The banded wrapping material can be used to manufacture cigarettes having a Camel Light 85 format and configuration that meet cigarette extinction test criteria.

The wrapping material so provided is representative of such a material having a series of multi-layered bands, wherein each layer incorporates ethylcellulose, and at least one of those layers is provided from a mixture of ethylcellulose and filler (e.g., calcium carbonate).

Example 61

A cigarette paper wrapping material having a porosity of about 38 CORESTA units and available as Ref. No. 454 from Ecusta is provided. That wrapping material is printed with bands of 6 mm width and spaced at 20 mm. The wrapping material is coated with two layers of coating formulation, with the width of each layer being about 6 mm.

The layers each are provided by a nitrocellulose/calcium carbonate-containing printing formulation having an isopropyl acetate solvent and available as FSBM5H98 from Color Converting Industries. The printing formulation incorporates about 16 percent calcium carbonate particles. The dry weight of coating applied to the wrapping material is about 5.64 pounds per ream. The porosity of each coated region is about 5 CORESTA units.

The banded wrapping material can be used to manufacture cigarettes having a Camel Light 85 format and configuration that meet cigarette extinction test criteria.

Example 62

A cigarette paper wrapping material having a porosity of about 38 CORESTA units and available as Ref. No. 454 from Ecusta is provided. That wrapping material is printed with bands of 6 mm width and spaced at 20 mm. The wrapping material is coated with three layers of coating formulation, with the width of each layer being about 6 mm.

The layers each are provided by a nitrocellulose/calcium carbonate-containing printing formulation having an isopropyl acetate solvent and available as FSBM5H98 from Color Converting Industries. The printing formulation incorporates about 16 percent calcium carbonate particles. The dry weight of coating applied to the wrapping material is about 8.33 pounds per ream. The porosity of each coated region is about 2.8 CORESTA units.

The banded wrapping material can be used to manufacture cigarettes having a Camel Light 85 format and configuration that meet cigarette extinction test criteria.

Example 63

A cigarette paper wrapping material having a porosity of about 53 CORESTA units and available as Ref. No. 460 from Ecusta is provided. That wrapping material is printed with bands of 6 mm width and spaced at 20 mm. The wrapping material is coated with four layers of coating formulation, with the width of each layer being about 6 mm.

The layers each are provided by a ethylene vinyl acetate/calcium carbonate-containing printing formulation having a toluene solvent and available as FSBM5H99 from Color Converting Industries. The printing formulation incorporates about 9 percent calcium carbonate particles. The dry weight of coating applied to the wrapping material is about 4.98 pounds per ream. The porosity of each coated region is about 3.9 CORESTA units.

The banded wrapping material can be used to manufacture cigarettes having a Camel Light 85 format and configuration that meet cigarette extinction test criteria.

Example 64

A cigarette paper wrapping material having a porosity of about 38 CORESTA units and available as Ref. No. 454 from Ecusta is provided. That wrapping material is printed with bands of 6 mm width and spaced at 20 mm. The wrapping material is coated with four layers of coating formulation in the manner shown in FIG. 5. The bottom and top layers each are provided from an ethylcellulose-containing printing formulation having a toluene solvent, and that formulation is available as FSBM6H96 from Color Converting Industries. The middle two layers each are provided from an ethylene vinyl acetate copolymer formulation, and that formulation is FSBM6H69 from Color Converting Industries. Each band is printed in the amount of about 3.53 pounds per ream of wrapping material. The porosity of the wrapping material in each banded region is about 3 CORESTA units. Such a printed wrapping material is an example of band configuration incorporating a layer incorporating ethylcellulose applied over two layers incorporating polyvinyl acetate, that are applied over a layer incorporating ethylcellulose.

The banded wrapping material can be used to manufacture cigarettes having a Camel Light 85 format and configuration that meet cigarette extinction test criteria.

Example 65

Coated cigarette paper wrapping materials are provided as set forth in Example 64, except that the base sheet is available as Ref. No. 456 from Ecusta, which has a porosity of 24 CORESTA units. The coating is applied at 3.07 pounds per ream. The porosity of the wrapping material in each banded region is about 2.6 CORESTA units. The banded wrapping material can be used to manufacture cigarettes having a Camel Light 85 format and configuration that meet cigarette extinction test criteria.

Coated cigarette paper wrapping materials also are provided from papers available as Ref. Nos. 460 and 473 from Ecusta; and those wrapping materials have porosities of 53 CORESTA units and 60 CORESTA units, respectively. Similar coatings are applied to each paper in a similar fashion, with about 3.45 and 3.24 pounds per ream of coating applied to each, respectively; such that the porosity in the banded regions is 3.5 and 9.4 CORESTA units, respectively. Those printed papers, when used to manufacture cigarettes having Camel Light 85 formats and configurations, are not as effective in meeting cigarette extinction test criteria.

Example 66

A cigarette paper wrapping material having a porosity of about 53 CORESTA units and available as Ref. No. 460 from Ecusta is provided. That wrapping material is printed with bands of 6 mm width and spaced at 20 mm. The wrapping material is coated with four layers of coating formulation in the manner shown in FIG. 5. The first three layers are provided from an ethylene vinyl acetate-containing printing formulation available as FSMB6H69 from Color Converting Industries. The top layer is an ethylcellulose-containing printing formulation available as FSBM6H96 from Color Converting Industries. Each band is printed in the amount of about 4.96 pounds per ream of wrapping material. The porosity of the wrapping material in each banded region is about 3.3 CORESTA units.

The banded wrapping material can be used to manufacture cigarettes having a Camel Light 85 format and configuration that meet cigarette extinction test criteria.

Example 67

A cigarette paper wrapping material has a porosity of about 38 CORESTA units, and is available as Tercig LK38 from Tervakoski is provided. That wrapping material is printed with bands of 4 mm width and spaced at 20 mm. The wrapping material is coated with three layers of coating formulation, in the manner shown in FIG. 4.

The bottom layer 215 and the top layer 222 are provided using the ethylcellulose/calcium carbonate-containing printing formulation described in Example 4.

The middle layer 218 is provided using xanthan gum-containing printing formulation. That formulation is provided by mixing about 2 parts xanthan gum, about 5 parts rhamnose, about 90 parts water and about 5 parts of a mixture. That mixture is produced by mixing the optical brightener, Uvitex OB from Ciba Specialty Chemicals, in absolute ethyl alcohol; such that the amount of optical brightener dispersed in the final printing formulation is about 0.02 parts.

Example 68

A cigarette paper wrapping material has a porosity of about 38 CORESTA units, and is available as Tercig LK38 from Tervakoski is provided. That wrapping material is printed with bands of 4 mm width and spaced at 20 mm. The wrapping material is coated with three layers of coating formulation, in the manner shown in FIG. 4.

The bottom layer 215 and the top layer 222 are provided using the ethylcellulose/calcium carbonate-containing printing formulation described in Example 4.

The middle layer 218 is provided using xanthan gum-containing printing formulation. That formulation is provided by mixing about 2 parts xanthan gum, about 5 parts rhamnose, about 10 parts calcium carbonate, about 80 parts water and about 5 parts of a mixture. That mixture is produced by mixing the optical brightener, Uvitex OB from Ciba Specialty Chemicals, in absolute ethyl alcohol; such that the amount of optical brightener dispersed in the final printing formulation is about 0.02 parts.

The wrapping material so provided is representative of a wrapping material having multi-layered bands applied thereto (e.g., bands include two, three or four layers), wherein at least one of those layers incorporates xanthan gum.

Example 69

A cigarette paper wrapping material has a porosity of about 38 CORESTA units, and is available as Tercig LK38 from Tervakoski is provided. That wrapping material is printed with bands of 4 mm width and spaced at 20 mm. The wrapping material is coated with three layers of coating formulation, in the manner shown in FIG. 4.

The bottom layer 215 and the middle layer 218 are provided using the ethylcellulose/calcium carbonate-containing printing formulation described in Example 4.

The top layer 222 is provided using the xanthan gum-containing printing formulation described in Example 68.

Example 70

A cigarette paper wrapping material has a porosity of about 38 CORESTA units, and is available as Tercig LK38 from Tervakoski is provided. That wrapping material is printed with bands of 6 mm width and spaced at 20 mm. The wrapping material is coated with three layers of coating formulation, in the manner shown in FIG. 4.

The bottom layer 215 is provided using the ethylcellulose/calcium carbonate-containing printing formulation described in Example 4.

The middle layer 218 is provided using the ethylcellulose-containing printing formulation described in Example 2.

The top layer 222 is provided using the xanthan gum-containing printing formulation described in Example 68. A top layer containing xathan gum is desirable because xanthan gum is flexible and malleable and has a tendency not to be brittle.

Example 71

A cigarette paper wrapping material has a porosity of about 38 CORESTA units, and is available as Tercig LK38 from Tervakoski is provided. That wrapping material is printed with bands of 6 mm width and spaced at 20 mm. The wrapping material is coated with three layers of coating formulation, in the manner shown in FIG. 4.

The bottom layer 215 is provided using the ethylcellulose/calcium carbonate-containing printing formulation described in Example 4.

The middle layer 218 is provided using the xanthan gum-containing printing formulation described in Example 67.

The top layer 222 is provided using the xanthan gum-containing printing formulation described in Example 68.

Example 72

A cigarette paper wrapping material has a porosity of about 24 CORESTA units, and is available as Tercig LK24 from Tervakoski is provided. That wrapping material is printed with bands of 4 mm width and spaced at 20 mm. The wrapping material is coated with three layers of coating formulation, in the manner shown in FIG. 4.

The bottom layer 215 is provided using the ethylcellulose/calcium carbonate-containing printing formulation described in Example 4.

The middle layer 218 and the top layer 222 of each band includes about 8 parts calcium carbonate particles, about 8 parts of finely ground magnesium sulfate decahydrate, about 8 parts ethylcellulose, about 2 parts triacetin, about 0.5 parts of a lecithin wetting agent, and about 0.02 parts of an optical brightener available as Uvitex OB from Ciba Specialty Chemicals, and at least about 74 parts iso-propyl acetate solvent (which is sufficient to total the number of parts of the formulation to 100). The calcium carbonate is available as Albaglos PCC from Specialty Minerals, Inc. The ethylcellulose is available as Aqualon N-7 from Hercules Incorporated.

This example is representative of a wrapping material having hydrated salts that have the tendency to lose water upon approach of a fire cone of a lit cigarette. It is believed that the resulting loss of water or the latent heat of cooling released by the decomposition of the hydrate can result in the cooling of that wrapping material and the extinction of the fire cone.

Example 73

A cigarette paper wrapping material has a porosity of about 24 CORESTA units, and is available as Tercig LK24 from Tervakoski is provided. That wrapping material is printed with bands of 4 mm width and spaced at 20 mm. The wrapping material is coated with three layers of coating formulation, in the manner shown in FIG. 4.

The bottom layer 215 and the top layer 222 each is provided using the ethylcellulose/calcium carbonate-containing printing formulation described in Example 4.

The middle layer 218 of each band includes about 16 parts of finely ground magnesium sulfate decahydrate, about 8 parts ethylcellulose, about 2 parts triacetin, about 0.5 parts of a lecithin wetting agent, and about 0.02 parts of an optical brightener available as Uvitex OB from Ciba Specialty Chemicals, and at least about 74 parts iso-propyl acetate solvent (which is sufficient to total the number of parts of the formulation to 100). The ethylcellulose is available as Aqualon N-7 from Hercules Incorporated.

Example 74

A cigarette paper wrapping material has a porosity of about 24 CORESTA units, and is available as Tercig LK24 from Tervakoski is provided. That wrapping material is printed with bands of 4 mm width and spaced at 20 mm. The wrapping material is coated with three layers of coating formulation, in the manner shown in FIG. 4.

The layers each are provided by an ethylcellulose/calcium carbonate containing printing formulation having an iso-propyl acetate solvent and available as FSBM0H62 from Color Converting Industries to which has been added about 0.46 percent caryophyllene oxide, about 0.004 percent ethyl vanillin and about 0.004 percent gamma-dodecalactone, based on the printing formulation. The dry weight of each band is about 1.5 milligrams, of which about 6.9 micrograms are attributed to the added caryophyllene oxide and about 0.06 microgram each of ethyl vanillin and gamma-dodecalactone.

Example 75

A cigarette paper wrapping material has a porosity of about 24 CORESTA units, and is available as Tercig LK24 from Tervakoski is provided. That wrapping material is printed with bands of 4 mm width and spaced at 20 mm. The wrapping material is coated with three layers of coating formulation, in the manner generally shown in FIG. 11.

The wrapping material is first printed with a solution of containing about 0.23 percent caryophyllene oxide, about 0.002 percent ethyl vanillin and about 0.002 percent gamma-dodecalactone in iso-propyl acetate. That layer is dried, and as such, a desired amount of flavoring agent is applied to the total surface of the wrapping material.

The layers each are provided by an ethylcellulose/calcium carbonate containing printing formulation having an iso-propyl acetate solvent and available as FSBM0H62 from Color Converting Industries. Both of the bottom two layers have widths of about 4 mm, and the top layer has a width of about 3 mm.

Example 76

A cigarette paper wrapping material has a porosity of about 38 CORESTA units, and is available as Tercig LK38 from Tervakoski is provided. That wrapping material is printed with bands of 6 mm width and spaced at 20 mm. The wrapping material is coated with three layers of coating formulation, in the manner shown in FIG. 4.

The bottom layer 215 and the middle layer 218 both are provided using the ethylcellulose/calcium carbonate-containing printing formulation described in Example 4.

The top layer 222 is provided using the ethylcellulose/magnesium hydroxide-containing printing formulation described in Example 18.

As such, a wrapping material having bands possessing layers of ethylcellulose/calcium carbonate and ethylcellulose/magnesium hydroxide is provided.

Example 77

A cigarette paper wrapping material has a porosity of about 38 CORESTA units, and is available as Tercig LK38 from Tervakoski is provided. That wrapping material is printed with bands of 6 mm width and spaced at 20 mm. The wrapping material is coated with three layers of coating formulation, in the manner shown in FIG. 4.

The bottom layer 215, middle layer 218 and the top layer 222 all are provided using the ethylcellulose/magnesium hydroxide-containing printing formulation described in Example 18.

Example 78

A cigarette paper wrapping material has a porosity of about 38 CORESTA units, and is available as Tercig LK38 from Tervakoski is provided. That wrapping material is printed with bands of 6 mm width and spaced at 20 mm. The wrapping material is coated with three layers of coating formulation, in the manner shown in FIG. 4.

The bottom layer 215 and the middle layer 218 both are provided using the ethylcellulose/magnesium hydroxide-containing printing formulation described in Example 18.

The top layer 222 is provided using the ethylcellulose/calcium carbonate-containing printing formulation described in Example 4.

Example 79

A cigarette paper wrapping material has a porosity of about 38 CORESTA units, and is available as Tercig LK38 from Tervakoski is provided. That wrapping material is printed with bands of 6 mm width and spaced at 20 mm. The wrapping material is coated with three layers of coating formulation, in the manner shown in FIG. 4.

The bottom layer 215 is provided using the ethylcellulose/calcium carbonate-containing printing formulation described in Example 4.

The middle layer 218 and the top layer 222 both are provided using the starch-based printing formulation described in Example 26.

Example 80

A cigarette paper wrapping material has a porosity of about 38 CORESTA units, and is available as Tercig LK38 from Tervakoski is provided. That wrapping material is printed with bands of 6 mm width and spaced at 20 mm. The wrapping material is coated with three layers of coating formulation, in the manner shown in FIG. 4.

The bottom layer 215 is provided using the ethylcellulose-containing printing formulation described in Example 2.

The middle layer 218 is provided using the starch-based printing formulation described in Example 26.

The top layer 222 is provided using the ethylcellulose/calcium carbonate-containing printing formulation described in Example 4.

Example 81

A cigarette paper wrapping material has a porosity of about 38 CORESTA units, and is available as Tercig LK38 from Tervakoski is provided. That wrapping material is printed with bands of 6 mm width and spaced at 20 mm. The wrapping material is coated with three layers of coating formulation, in the manner shown in FIG. 10.

The bottom layer 215 is provided using the ethylcellulose/calcium carbonate-containing printing formulation described in Example 4.

The two middle layers 218, 222 are provided using the starch-based printing formulation described in Example 26.

The top layer 226 is provided using the ethylcellulose-containing printing formulation described in Example 2.

Example 82

A cigarette paper wrapping material having a porosity of about 24 CORESTA units and available as Ref. No. 456 from Ecusta is provided. That wrapping material is printed with bands of 6 mm width and spaced at 20 mm. The wrapping material is coated with four layers of coating formulation in the manner shown in FIG. 5. The first three layers are provided from an ethylene vinyl acetate-containing printing formulation available as FSMB6H69 from Color Converting Industries. The top layer is an ethylcellulose-containing printing formulation available as FSBM6H96 from Color Converting Industries. Each band is printed in the amount of about 3.28 pounds per ream of wrapping material. The porosity of the wrapping material in each banded region is about 2 CORESTA units.

The banded wrapping material can be used to manufacture cigarettes having a Camel Light 85 format and configuration that meet cigarette extinction test criteria.

Example 83

A cigarette paper wrapping material having a porosity of about 60 CORESTA units and available as Ref. No. 473 from Ecusta is provided. That wrapping material is printed with bands of 6 mm width and spaced at 20 mm. The wrapping material is coated with three layers of coating formulation in the manner shown in FIG. 4. The first two layers are provided from an ethylene vinyl acetate-containing printing formulation available as FSMB5H99 from Color Converting Industries. The top layer is an ethylcellulose-containing printing formulation available as FSBM0J13 from Color Converting Industries. Each band is printed in the amount of about 4.96 pounds per ream of wrapping material. The porosity of the wrapping material in each banded region is about 8.2 CORESTA units.

The banded wrapping material can be used to manufacture cigarettes having a Camel Light 85 format and configuration that meet cigarette extinction test criteria.

Example 84

A cigarette paper wrapping material having a porosity of about 53 CORESTA units and available as Ref. No. 460 from Ecusta is provided. That wrapping material is printed with bands of 6 mm width and spaced at 20 mm. The wrapping material is coated with four layers of coating formulation in the manner shown in FIG. 5. The first two layers are provided from a continuous coating of an ethylene vinyl acetate-containing printing formulation available as FSMB6H69 from Color Converting Industries. The third layer is provided from a discontinuous coating of that ethylene vinyl acetate-containing formulation. The top layer is an ethylcellulose-containing printing formulation available as FSBM6H96 from Color Converting Industries. Each band is printed in the amount of about 4.96 pounds per ream of wrapping material. The porosity of the wrapping material in each banded region is about 3.3 CORESTA units.

The banded wrapping material can be used to manufacture cigarettes having a Camel Light 85 format and configuration that meet cigarette extinction test criteria.

The wrapping material so provided is representative of a wrapping material printed with two continuous patterned bottom layers of a coating incorporating ethylene vinyl acetate, an upper middle layer printed with a discontinuous patterned coating incorporating ethylene vinyl acetate, and an upper continuous layer of a coating incorporating ethylcellulose.

Example 85

A cigarette paper wrapping material has a porosity of about 60 CORESTA units, and is available as Tercig LK60 from Tervakoski is provided. That wrapping material is printed with bands of 6 mm width and spaced at 33 mm. The wrapping material is coated with four layers of coating formulation, in the manner shown in FIG. 5.

All four layers are provided using the ethylcellulose/calcium carbonate-containing printing formulation described in Example 4. The resulting formulation is applied in such a manner that the wrapping material, when dried, has about 5 to about 7 pounds/ream coated thereon.

Example 86

A cigarette paper wrapping material has a porosity of about 60 CORESTA units, and is available as Tercig LK60 from Tervakoski is provided. That wrapping material is printed with bands of 6 mm width and spaced at 28 mm. The wrapping material is coated with four layers of coating formulation, in the manner shown in FIG. 5.

All four layers are provided using the ethylcellulose/calcium carbonate-containing printing formulation described in Example 4. The resulting formulation is applied in such a manner that the wrapping material, when dried, has about 5 to about 7 pounds/ream coated thereon.

Example 87

A cigarette paper wrapping material has a porosity of about 60 CORESTA units, and is available as Tercig LK60 from Tervakoski is provided. That wrapping material is printed with bands of 6 mm width and spaced at 20 mm. The wrapping material is coated with four layers of coating formulation, in the manner shown in FIG. 5.

All four layers are provided using the ethylcellulose/calcium carbonate-containing printing formulation described in Example 4. The resulting formulation is applied in such a manner that the wrapping material, when dried, has about 5 to about 7 pounds/ream coated thereon.

Example 88

A cigarette paper wrapping material has a porosity of about 24 CORESTA units, and is available as Tercig LK24 from Tervakoski is provided. That wrapping material is printed with bands of 6 mm width and spaced at 20 mm. The wrapping material is coated with three layers of coating formulation, in the manner shown in FIG. 4.

All three layers are provided using the ethylcellulose/calcium carbonate-containing printing formulation described in Example 4. The resulting formulation is applied in such a manner that the wrapping material, when dried, has about 5 to about 7 pounds/ream coated thereon.

Example 89

A cigarette paper wrapping material has a porosity of about 24 CORESTA units, and is available as Tercig LK24 from Tervakoski is provided. That wrapping material is printed with bands of 6 mm width and spaced at 28 mm. The wrapping material is coated with three layers of coating formulation, in the manner shown in FIG. 4.

All three layers are provided using the ethylcellulose/calcium carbonate-containing printing formulation described in Example 4. The resulting formulation is applied in such a manner that the wrapping material, when dried, has about 5 to about 7 pounds/ream coated thereon.

Example 90

A cigarette paper wrapping material has a porosity of about 24 CORESTA units, and is available as Tercig LK24 from Tervakoski is provided. That wrapping material is printed with bands of 6 mm width and spaced at 33 mm. The wrapping material is coated with three layers of coating formulation, in the manner shown in FIG. 4.

All three layers are provided using the ethylcellulose/calcium carbonate-containing printing formulation described in Example 4. The resulting formulation is applied in such a manner that the wrapping material, when dried, has about 5 to about 7 pounds/ream coated thereon.

Example 91

A cigarette paper wrapping material has a porosity of about 38 CORESTA units, and is available as Tercig LK38 from Tervakoski is provided. That wrapping material is printed with bands of 6 mm width and spaced at 20 mm. The wrapping material is coated with three layers of coating formulation, in the manner shown in FIG. 4.

All three layers are provided using the ethylcellulose/calcium carbonate-containing printing formulation described in Example 4. The resulting formulation is applied in such a manner that the wrapping material, when dried, has about 5 to about 7 pounds/ream coated thereon.

Example 92

A cigarette paper wrapping material has a porosity of about 38 CORESTA units, and is available as Tercig LK38 from Tervakoski is provided. That wrapping material is printed with bands of 6 mm width and spaced at 28 mm. The wrapping material is coated with three layers of coating formulation, in the manner shown in FIG. 4.

All three layers are provided using the ethylcellulose/calcium carbonate-containing printing formulation described in Example 4. The resulting formulation is applied in such a manner that the wrapping material, when dried, has about 5 to about 7 pounds/ream coated thereon.

Example 93

A cigarette paper wrapping material has a porosity of about 38 CORESTA units, and is available as Tercig LK38 from Tervakoski is provided. That wrapping material is printed with bands of 6 mm width and spaced at 33 mm. The wrapping material is coated with three layers of coating formulation, in the manner shown in FIG. 4.

All three layers are provided using the ethylcellulose/calcium carbonate-containing printing formulation described in Example 4. The resulting formulation is applied in such a manner that the wrapping material, when dried, has about 5 to about 7 pounds/ream coated thereon.

Example 94

A cigarette paper wrapping material has a porosity of about 46 CORESTA units, and is available as Tercig LK46 from Tervakoski is provided. That wrapping material is printed with bands of 6 mm width and spaced at 20 mm. The wrapping material is coated with three layers of coating formulation, in the manner shown in FIG. 4.

All three layers are provided using the ethylcellulose/calcium carbonate-containing printing formulation described in Example 4. The resulting formulation is applied in such a manner that the wrapping material, when dried, has about 5 to about 7 pounds/ream coated thereon.

Example 95

A cigarette paper wrapping material has a porosity of about 46 CORESTA units, and is available as Tercig LK46 from Tervakoski is provided. That wrapping material is printed with bands of 6 mm width and spaced at 28 mm. The wrapping material is coated with three layers of coating formulation, in the manner shown in FIG. 4.

All three layers are provided using the ethylcellulose/calcium carbonate-containing printing formulation described in Example 4. The resulting formulation is applied in such a manner that the wrapping material, when dried, has about 5 to about 7 pounds/ream coated thereon.

Example 96

A cigarette paper wrapping material has a porosity of about 46 CORESTA units, and is available as Tercig LK46 from Tervakoski is provided. That wrapping material is printed with bands of 6 mm width and spaced at 33 mm. The wrapping material is coated with three layers of coating formulation, in the manner shown in FIG. 4.

All three layers are provided using the ethylcellulose/calcium carbonate-containing printing formulation described in Example 4. The resulting formulation is applied in such a manner that the wrapping material, when dried, has about 5 to about 7 pounds/ream coated thereon.

Example 97

A cigarette paper wrapping material has a porosity of about 24 CORESTA units, and is available as Tercig LK24 from Tervakoski is provided. That wrapping material is printed with bands of 6 mm width and spaced at 18 mm. The wrapping material is coated with three layers of coating formulation, in the manner shown in FIG. 4.

All three layers are provided using the ethylcellulose/calcium carbonate-containing printing formulation described in Example 4. The resulting formulation is applied in such a manner that the wrapping material, when dried, has about 5 to about 7 pounds/ream coated thereon.

Example 98

A cigarette paper wrapping material has a porosity of about 38 CORESTA units, and is available as Tercig LK38 from Tervakoski is provided. That wrapping material is printed with bands of 6 mm width and spaced at 24 mm. The wrapping material is coated with three layers of coating formulation, in the manner shown in FIG. 4.

All three layers are provided using the ethylcellulose/calcium carbonate-containing printing formulation described in Example 4. The resulting formulation is applied in such a manner that the wrapping material, when dried, has about 5 to about 7 pounds/ream coated thereon.

What is claimed is:

1. A wrapping material for a smoking article, the wrapping material comprising: a smoking article wrapping material substrate and having a wire side major surface and a felt side major surface; and a pattern applied to the wire side major surface of the wrapping material substrate as a plurality of layers, including at least three layers; at least one of the layers comprising ethylcellulose and calcium carbonate, the calcium carbonate being present in an amount greater than the ethylcellulose, on a weight basis.

2. The wrapping material of claim 1, wherein all of the layers comprise ethylcellulose and calcium carbonate, the calcium carbonate being present in each layer in an amount greater than the ethylcellulose, on a weight basis.

3. The wrapping material of claim 1, wherein the pattern possesses four layers.

4. The wrapping material of claim 3, wherein all of the layers comprise ethylcellulose and calcium carbonate, the calcium carbonate being present in each layer in an amount greater than the ethylcellulose, on a weight basis.

5. The wrapping material of claim 1, wherein the layer comprising ethylcellulose and calcium carbonate also includes at least one plasticizer.

6. The wrapping material of claim 2, wherein the layers comprising ethylcellulose and calcium carbonate also include at least one plasticizer.

7. The wrapping material of claim 4, wherein the layers comprising ethylcellulose and calcium carbonate also include at least one plasticizer.

8. The wrapping material of claim 1, wherein the layer comprising ethylcellulose and calcium carbonate also includes at least one wetting agent.

9. The wrapping material of claim 2, wherein the layers comprising ethylcellulose and calcium carbonate also include at least one wetting agent.

10. The wrapping material of claim 4, wherein the layers comprising ethylcellulose and calcium carbonate also include at least one wetting agent.

11. The wrapping material of claim 1, wherein the layer comprising ethylcellulose and calcium carbonate also includes at least one plasticizer and at least one wetting agent.

12. The wrapping material of claim 2, wherein the layers comprising ethylcellulose and calcium carbonate also include at least one plasticizer and at least one wetting agent.

13. The wrapping material of claim 4, wherein the layers comprising ethylcellulose and calcium carbonate also include at least one plasticizer and at least one wetting agent.

14. The wrapping material of claim 1, wherein the layer comprising ethylcellulose and calcium carbonate also includes at least one optical brightener, at least one plasticizer and at least one wetting agent.

15. The wrapping material of claim 2, wherein the layers comprising ethylcellulose and calcium carbonate also include at least one optical brightener, at least one plasticizer and at least one wetting agent.

16. The wrapping material of claim 4, wherein the layers comprising ethylcellulose and calcium carbonate also include at least one optical brightener, at least one plasticizer and at least one wetting agent.

17. The wrapping material of claim 1, wherein the layer comprising ethylcellulose and calcium carbonate also includes at least one optical brightener.

18. The wrapping material of claim 2, wherein the layers comprising ethylcellulose and calcium carbonate also include at least one optical brightener.

19. The wrapping material of claim 4, wherein the layers comprising ethylcellulose and calcium carbonate also include at least one optical brightener.

20. The wrapping material of claim 1, wherein the wrapping material substrate comprises about 70 weight parts to about 90 weight parts fibrous material and about 10 weight parts to about 90 weight parts filler, based on the combined weight of fibrous material and filler; has a dry basis weight of about 20 g/m$^2$ to about 30 g/m$^2$; and has an inherent porosity of about 20 CORESTA units to about 60 CORESTA units.

21. The wrapping material of claim 1, wherein the pattern has a form of a series of bands, the bands each having widths between at least about 3 mm and up to about 8 mm; and the bands being spaced at a spacing of at least about 15 mm.

22. The wrapping material of claim 1, wherein the pattern has a form of a series of bands, the bands each having widths between at least about 4 mm and up to about 7 mm; and the bands being spaced at a spacing of at least about 15 mm.

23. The wrapping material of claim 21, wherein the bands are spaced at a spacing that does not exceed about 50 mm.

24. A smoking article comprising a smokable material contained within the wrapping material of claim 1.

25. A smoking article comprising a smokable material contained within the wrapping material of claim 1, wherein (i) the pattern of the wrapping material has a form of a series of bands, (ii) the bands each have widths between at least about 3 mm and up to about 8 mm; (iii) the bands are spaced at a spacing of at least about 15 mm; and (iv) the wrapping material of the smoking article possesses at least two bands.

26. A method of making a wrapping material for a smoking article, said method comprising the steps of:

providing a smoking article wrapping material substrate having a wire side major surface and a felt side major surface; and applying a pattern to at least one of the wire side major surface or the felt side major surface, wherein the pattern is applied in at least three layers and at least one of the layers comprises ethylcellulose and calcium carbonate, the calcium carbonate being present in an amount greater than the ethylcellulose, on a weight basis.

27. The method of claim 26, wherein the pattern layer comprising ethylcellulose and calcium carbonate also includes at least one optical brightener, at least one plasticizer, and at least one wetting agent.

28. The method of claim 26, wherein the pattern layer comprising ethylcellulose and calcium carbonate also includes at least one optical brightener.

29. The method of claim 26, wherein the pattern layer comprising ethylcellulose and calcium carbonate also includes at least one plasticizer.

30. The method of claim 26, wherein the pattern layer comprising ethylcellulose and calcium carbonate also includes at least one wetting agent.

* * * * *